US007198505B2

(12) United States Patent
Cherian

(10) Patent No.: US 7,198,505 B2
(45) Date of Patent: Apr. 3, 2007

(54) LIGHT SOCKET 3

(76) Inventor: Gabe Cherian, P.O. Box 1335, Sun Valley, ID (US) 83353

( * ) Notice: Subject to any disclaimer, the term of this patent is extended or adjusted under 35 U.S.C. 154(b) by 0 days.

(21) Appl. No.: 11/325,653

(22) Filed: Jan. 3, 2006

(65) Prior Publication Data

US 2006/0110984 A1 May 25, 2006

Related U.S. Application Data

(62) Division of application No. 10/953,600, filed on Sep. 28, 2004, and a division of application No. 10/391,417, filed on Mar. 17, 2003, now Pat. No. 6,979,230.

(60) Provisional application No. 60/366,294, filed on Mar. 20, 2002.

(51) Int. Cl.
*H01R 11/20* (2006.01)

(52) U.S. Cl. ..... 439/419; 439/614; 439/662; 439/667; 439/241; 439/137

(58) Field of Classification Search ..... 439/662, 439/614, 667, 241, 137, 419
See application file for complete search history.

(56) References Cited

U.S. PATENT DOCUMENTS 4,768,966 A * 9/1988 Doherty ..... 439/137

* cited by examiner

*Primary Examiner*—Truc Nguyen

(57) ABSTRACT

Improvements to a 3-way light bulb socket are shown. The major improvement is to replace or complement the rigid middle contact element of the socket with an elastic/flexible contact spring.

The 3-way light bulb has a solder blob on its middle contact ring, where said blob usually has a rough, uneven surface, and frequently does protrude beyond the general surface of the bulb middle contact ring. The solder blob interferes with the conventional socket middle contact element, which is rigid, and prevents the system from creating a good, permanent and reliable electrical connection between the socket and the bulb. Potential flicker and discomfort to the user can occur as a result. Also, the operating life of the bulb as well as the power consumption can be affected.

The proposed flexible middle contact spring can alleviate most of these problems.

20 Claims, 74 Drawing Sheets

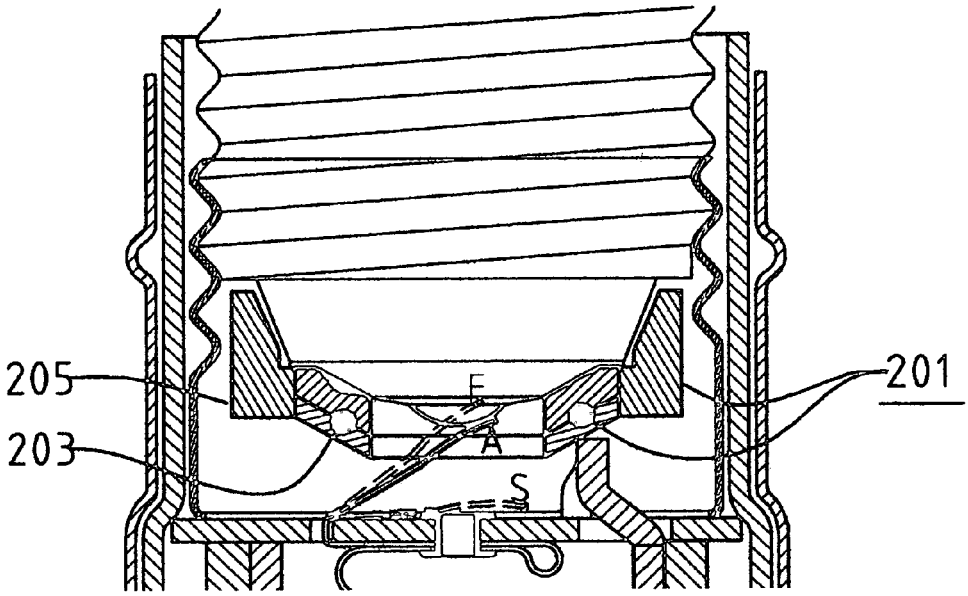
FIG. 66A
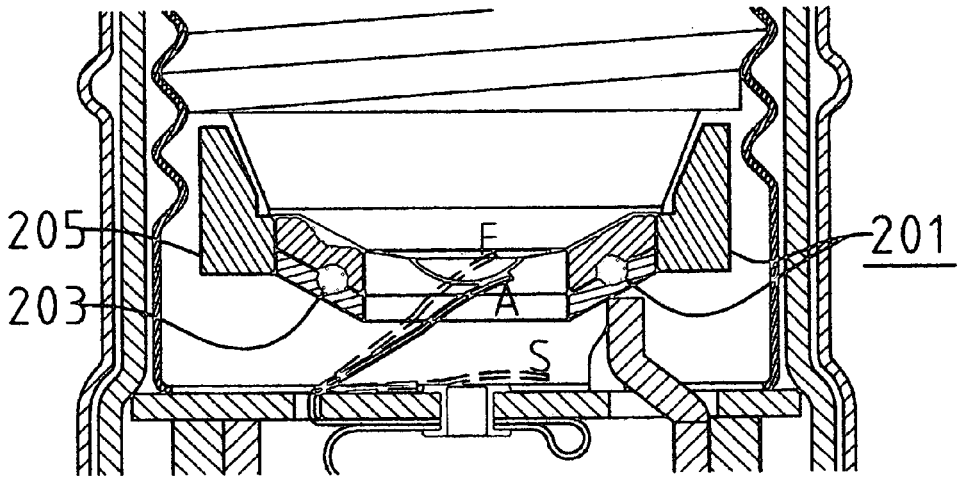
FIG. 66B
FIG. 66

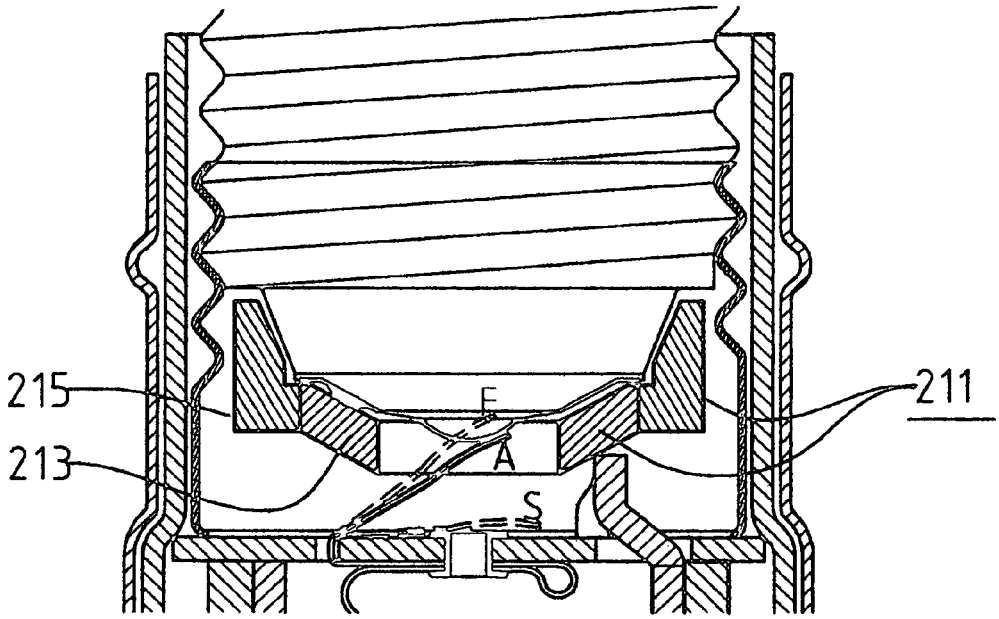
FIG. 69A
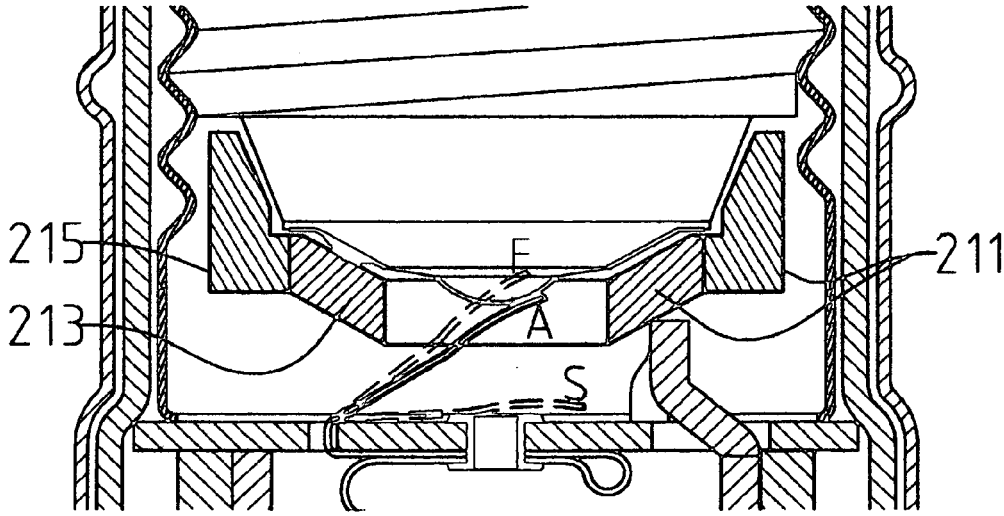
FIG. 69B
FIG. 69

LIGHT SOCKET 3

CROSS-REFERENCE TO RELATED APPLICATIONS

This application is a NON-PROVISIONAL DIVISIONAL UTILITY PATENT APPLICATION, BASED ON the mother patent application Ser. No. 10/391,417, ENTITLED "LIGHT SOCKET", which was filed on Mar. 17, 2003. This mother application was published on Aug. 12, 2004, as US 2004/0157495. This mother application has been examined and allowed, as U.S. Pat. No. 6,979,230 B2, issued on Dec. 27, 2005.

This application is claiming the priority and benefits of the mother patent application mentioned above, which is incorporated herein in its entirety by reference and which will be referred to as Ref2.

This application is claiming also the priority and benefits of the same reference, which was claimed by the mother application. That reference is Provisional Patent Application Ser. No. 60/366,294, filed on Mar. 20, 2002, entitled "Lamp Sockets & Micro-Probes", which is also incorporated herein in its entirety by reference, and which will be referred to as Ref1.

Lastly, the inventor wants to mention that there has been another DIVISIONAL APPLICATION, Ser. No. 10/953,600, filed Sep. 28, 2004, dependent on the same Mother Application mentioned above. This Divisional Application is incorporated herein in its entirety by reference and will be referred to as Ref3. This divisional application, Ref3, is still pending at the USPTO, as of the filing date of the present application.

Note:

I will refer in this application to certain pages, drawings or sketches that are included in the above Reference. I would like to explain here the numbering system that was used in that reference, so that it will be clear, which pages or drawing I would be referring to later on. I will use Ref1 to illustrate.

Ref1 covers 2 products groups. They are 1) Lamp Sockets or simply Sockets and 2) Micro-Probes or simply Probes.

The pages in Ref1 are identified as follows. The pages of the Lamp Sockets are identified by LS, and those of the Micro-Probes are identified by MP.

Each one of these two groups' documents was divided into three sections. The Specifications, the Drawings and the Additional Documents. The pages were identified as follows as well. The pages in the Specifications sections by S, the Drawings by D, and the Additional Documents either by AD or by A.

So for example, page 7 in the Specifications of the Micro-Probes group would be marked thus: "MP-S-7".

PS: During the prosecution of the mother application, I was requested to clean-up the drawings, which I did. So, the drawings included in this Divisional Application reflect those improved drawings.

STATEMENT REGARDING FEDERALLY SPONSORED RESEARCH OR DEVELOPMENT

Not Applicable

REFERENCE TO A MICROFICHE APPENDIX

Not Applicable

DEFINITIONS

For the purpose of the following invention description, I will use certain words or terms that may be peculiar to this application. They will be explained in the following definitions, or as I go along during the application.

Beside the Ref #s, I will sometimes use the following legend to identify certain parts, although this may be superfluous.

B for Bulb, S for Socket.

BR for Bulb Return, SR for Socket Return.

SC for Socket Central Contact, SM for Socket Middle Contact.

H for the Socket Hot Terminal.

A, B, C, D for the four Faces of the Rotating Cam in the Socket.

F for the Free shape of any spring, A for the Acting position of any spring and S for Seated or fully compressed position of any spring.

"F" means the FREE shape of any spring.

"A" means the ACTING shape or position of any spring.

"S" means the SEATED shape or position of any spring.

BMCR, Ref #3=Bulb Middle Contact Ring.

SMCE, Ref #31=Socket Middle Contact Element.

Stop, Ref #31 =The same rigid SMCE, Ref #31.

SCCS, Ref #23=Socket Center Contact Spring.

Solder Spot, Ref #19=The connecting spot, or connecting means, which usually is a solder spot, or solder joint, located on the BMSR, to one or more filaments or other elements, inside the bulb. I will use the following terms in the Specifications and in the Claims as synonymous: solder joint, solder spot, connecting spot, connecting means.

Definitions

Rigid vs. Flexible or springy

See Specifications, under 3. HOW THE 3-WAY SOCKETS WORK.

BACKGROUND OF THE INVENTION

Field of the Invention

The present invention generally relates to electrical contacts and elements and their surfaces and physical properties, and especially to electrical light bulbs and to electrical sockets. More particularly it relates to 3-way electrical light bulbs and their electrical sockets and related components. The invention also relates to 3-way light sockets, whether they incorporate a switch or not. The invention further relates to washers or devices or inserts or adapters in general that can be used in conjunction with such light bulbs and/or their sockets.

BACKGROUND OF THE INVENTION

Reference to a Related Article

The January 2002 issue of "DESIGNFAX" Magazine had, in page 64, an interesting article that triggered my thoughts towards the inventions covered by this application.

The article in question was entitled: "Side Jobs", or "Problem of the Month". I have copied it and am attaching it as "Additional Documents" at the end of this application. A photocopy of the articles is shown in page LS-A-2. It is not quite legible. So, I scanned the article and with OCR, I created a "text" version of it and I am showing it in page LS-A-1.

The gist of the article is the problems that are found with 3-way light bulbs and their sockets. These sockets are referred to sometimes as light sockets and other times as lamp sockets. Most of the sales packages of such sockets, on the market, refer to them as lamp sockets. So, in this specification I will most often use the term "lamp socket" or simply "socket".

The referenced article states the following complaint.

"Recently, one of our staffers posed this problem to us. Why is it, he asked, that they can't make a decent three-way light bulb? It seems that all four 3-way lamps in his house are afflicted with flicker—that is, when switched to the lowest or highest output, the light tends to blink on and off.

Adjust the contacts? Yes, he's cleaned and adjusted the contacts of the sockets of all the lamps (unplugged from the wall first, of course), as well as sanding and cleaning of the bulbs. In frustration he's just installed single-wattage bulbs into the fixtures—obviously a solution, but it does offer a challenge. So we ask you for suggestions, not just for our staffer's immediate illumination needs, but also for alternative designs that won't require the complete overhaul of existing light-bulbs and can be done for a low cost."

Personal Verification

I, the inventor, remembered that occasionally I, too, had the same "flicker" problem with some of my 3-way light lamps in my house.

However, I wanted to verify that the problem really existed. So I talked to a friend of mine, whose name is Ed V. E. Ed is an electrician and teaches the trade to aspiring electricians at a local college. At one time, Ed was working with a large local company and was responsible for the maintenance operation, especially the electrical side of the operation. That company owned a few hotels, among other things. Ed told me the following.

Yes, there is a problem with 3-way electrical light bulbs and their sockets. It was so bad, that at one time, some companies have tried to solve the problem, but have given up. He remember that Phillips and Duro-Test had offered some solutions, but they were either too expensive or did not get enough appeal or acceptance from the market.

One solution was very expensive compared to regular 3-way light bulbs. The "improved" bulbs was "guaranteed for long life", but their cost was prohibitive.

Another solution was to provide the light bulb with a wavy spring instead of the solid ring. But for some reason, this solution did not work either. Not successful. Did not last long on the market.

Ed recalled also that they were telling the maids, at the company's hotels, not to tighten the light bulbs into the sockets too tightly. But that did not help either. It seems that the maids noticed the flicker. So, they thought that the bulb was not seated properly. So, they went and tried to tighten the bulb more in the socket, and they often broke the bulbs.

Then, I did a small market search.

This is what I discovered.

Potential Problem Sources

I discovered basically THREE potential sources for the problem:

1. The bulbs have a problem, but by themselves and on their own, they are OK.
2. The sockets have a problem, but by themselves and on their own, they are OK.
3. The system, or the combination of, using such bulbs and sockets creates problems. It is mainly the orientation or correlation of the threads in the bulbs and sockets together with the presence of the solder spot 19 of the bulb that create the problems.

Potential Problem Source #1: The bulbs have, or could cause, a problem.

The problem is the way the middle contact ring 3 of the bulbs is manufactured. Here is what I mean. The bulbs, as shown in FIGS. 1 & 2, are made with the standard center contact point 1, like the standard one-way bulbs, also known as "one-wattage bulbs, plus a middle contact ring 3, that is located between the center contact point and the outside bulb threaded metal base 5, that acts as the return terminal. Insulations 7 and 9 are in-between for proper electrical separation.

The bulb middle contact ring 3 is connected to the middle filament 11 inside the glass body 13 of the bulb 15 by soldering the filament wire 11 or the filament carrying wire 17 to the bulb middle contact ring 3. The solder joint 19 is usually pretty rough, bumpy and out of plane with respect to the bulb middle contact ring 3 itself, i.e. it is higher than the rest of the surface of that bulb middle contact ring 3. It protrudes over the surface of the bulb middle contact ring 3 and it creates an uneven contact surface. Sometimes, it protrudes as high as 0.030 inch or higher, over the surface of the bulb middle contact ring 3.

So, when a person inserts such a bulb into the socket 21 in FIG. 3 and turns it in, and "reaches bottom", the contact elements inside the socket would touch the corresponding contact points of the bulb. First, you make contact between the center points and then you make contact between the middle contacts. I will explain what occurs at this time, in a moment.

Potential Problem Source #2: The sockets have, or could cause, a problem.

The 3-way sockets have three contact elements that touch three corresponding elements of the bulb.

FIG. 3 shows a cross-section view of such a 3-way bulb sitting inside a 3-way socket. FIG. 4 shows a close-up view of the socket. FIG. 5 and the subsequent figures show an even larger close-up view.

When a light bulb is properly seated in the socket, the following three pairs of elements are making contact.

1. The bulb threaded metal base 5 is touching the socket threaded shell 27.
2. The center contact point 1 of the bulb is touching the center contact spring 23 of the socket. Actually, the socket center contact spring 23 is applying a certain contact force against the bulb center contact point 1, pushing the bulb threaded metal base 5 upwards against the thread of the socket threaded shell 27, by an equal amount of force.
3. The bulb middle contact ring 3 is touching the socket middle contact element 31.

How Present Bulbs and Sockets Work

I will describe how they work, in three different steps, as follows. I will use FIGS. 1 through 8. While doing this, I will also point out the potential sources of problems, and possibly mention briefly some suggestions for corrective action. I will then elaborate later on these suggestions.

A-HOW 1-WAY (SINGLE-WATTAGE) BULBS WORK IN THEIR SOCKETS

B-HOW 3-WAY BULBS WORK IN THEIR SOCKETS

C-HOW THE 3-WAY SOCKETS THEMSELVES WORK.

1. How 1-Way (Single-Wattage) Bulbs Work in Their Sockets

Now, I will first describe the standard one-way bulb and its corresponding socket, and how they interact. Then I will compare them with the 3-way bulb and socket.

The sockets for standard one-way bulbs have only one contact spring, the socket center contact spring 23, in the center of the socket, which is similar to the center contact spring 23 of the 3-way socket, to make contact with the center point 1 of the bulb, which again is similar to the 3-way bulbs from this respect. They do not have the "stop" 31, which we see in the 3-way sockets. The return current goes through the bulb threaded metal base 5 to the socket threaded shell 27 of the socket. This is similar to the 3-way sockets. The center contact element 23 of the socket 21 is a "spring", as I said. When a person threads a bulb into the socket, one of two things can happen. First, if the power is already turned on, then when the bulb is threaded in far enough for the bulb center contact point 1 to reach the socket center contact spring, the light would turn on, and most probably the person would stop and leave the bulb at that position. It is not the ideal thing to do. If the bulb is wiggled slightly, there could be a good chance of getting some flicker, because the socket center contact spring may separate from the bulb center point 1. The second thing that can happen is that the person would thread the bulb in a little bit more. This would be advisable. But when would you stop? Most of the time, you would stop when you feel enough resistance to the threading process. You could keep on threading the bulb in, all the way, until the bulb has bottomed down all the way into the socket. This is probably the best way. At this situation, the socket center contact spring 23 would be compressed all the way down and would be seated on top of the bottom part 29 of the socket. This should not harm the contact spring because the spring should still have enough springiness (flexibility) in it to work with this bulb or any other replacement bulb that may be inserted later in the same socket.

So far so good, for standard one-way bulbs. But now let us compare this with the 3-way bulbs and their sockets.

2. How 3-Way Bulbs Work in Their Sockets

The 3-way sockets 21 have two contact elements beside the return, instead of only one in the 1-way sockets. The first contact element is the center contact spring 23. This is exactly like the one for the standard one-way sockets as mentioned above. The second contact element is what I call the socket middle contact element 31. And this is the one part that creates the major part of the problem, as far as I can see.

The socket middle contact element 31 of all the 3-way sockets that I have found in the market is "RIGID". It is not springy like the center contact spring. It seems the manufacturers of these sockets wanted to use this MC as a "STOP". This is my interpretation of the existing design and the thought process behind it.

The way I see it, this is what happens.

When you thread the 3-way bulb into the socket, you first make contact with the center points, i.e. bulb center contact point 1 with socket center contact spring 23, as I said before. You may or may not get the light on, if you have the power on. Officially you should not have the power on, when you are inserting the bulb in the socket. It is dangerous. It can create a spark, which could cause harm. So, you would not know whether you made any contact or not yet. So, you keep threading the bulb in further until you feel some appreciable resistance. This is most probably when the middle contact ring 3 of the bulb touches the socket middle contact element 31 of the socket. This is the time when your luck can be very important. If you hit the socket middle contact element 31 with a point on the bulb middle contact ring 3 that does not have the solderjoint 19 on it, or near it, you should be OK. But, if the solder joint 19 just happens to be near the area where you are touching the socket middle contact element 31, then you may hit a high spot at one instant and then you may hit a low spot at another instant. The change can be just a slight change in turning the bulb or some other change due to temperature or whatever. Basically you create an "unstable" electrical contact, and that is the bad news. Another possibility is that if you have threaded the bulb in just enough to make electrical contact, but "mechanically" the contact (touching) is not strong enough, the electrical resistance at the contact area can be relatively high. This could create some localized heating, which in turn could create some expansion and contraction at the local contact area and that can create havoc with the system.

This is my interpretation of the problem. Also based on my experience with connector and interconnection device, I would not design a connector or a socket with such a rigid contact element. It is simply not done, as far as I know.

3. How the 3-Way Sockets Themselves Work

FIG. 1 shows the basics of the 3-way light bulb, with the filaments and the filament carrying wires "simplified" for clarity of illustration.

FIG. 2 shows a close-up view of the lower portion of the same bulb.

FIG. 3 shows a cross-section of the socket, with a bulb in it.

FIG. 4 shows an enlarged view of the lower portion of FIG. 3.

FIGS. 5 through 8 show an even closer view of the main mechanism of the socket and the base of the bulb with the different contact elements of both. They also show the four different positions of the switch that controls which filament will be turned on or off, at any of these four positions. I will explain.

FIG. 5 shows the position of the switch cam 41, which I will refer to also as the rotating cam 41, when no filaments are on. The light is OFF.

FIG. 6 shows the position when the "middle filament" 11 is ON. The power is connected from the switch hot wiper 43 through the rotating cam 41, to the switch middle wiper 45, and then from it to the "RIGID" socket middle contact element 31, which touches bulb middle contact ring 3. Then the power flows from there to the middle filament 11 and then back to the bulb threaded base 5 and from it to socket threaded shell 27. So, the result is that the middle filament 11 will be turned ON.

Please note that the rotating cam 41 has four cam surfaces, cam surface B 49, cam surface C 51, cam surface D 53, and cam surface A 55. The rotating cam 41 itself is made of an insulating material. So, if any contact element is touching cam surface A 55, then no electrical power can be conveyed to it.

However, each of the other three cam surfaces, i.e. cam surface B 49, cam surface C 51, cam surface D 53 are covered by a metallic surface, which is connected to a metallic plate 57, shown in dotted lines, in the back of the rotating cam 41. So, these three cam surfaces are connected electrically to each other.

Consequently, in this position in FIG. 6, the switch hot wiper 43 is connected to cam surface B 49, which in turn is connected to cam surface D 53 through the hidden metallic plate 57, which then is connected to switch middle wiper 45.

FIG. 7 shows the position when the "center filament" 10 is ON. The power is connected from the switch hot wiper 43 through the rotating cam 41, through cam surface C 51, the hidden metallic plate 57, cam surface B 49, to the switch center wiper 59, which is integral with the "springy" socket center contact spring 23, which touches the bulb's Center Contact Point 1. Then the power flows from there to the center filament 10 and then back to the bulb threaded metal base 5 and from it to the socket threaded shell 27. So, the result is that the center filament 10 will be turned ON.

FIG. 8 shows the position when both the "center filament" 10 as well as the "middle filament" 11 are ON. The power is connected from the switch hot wiper 43 through the rotating cam 41 through cam surface D 53 and hidden metallic plate 57, to the switch center wiper 59 as well as to the switch middle wiper 45 through cam surface D 53, hidden metallic plate 57, cam surface B 49, and then from there to the two bulb filaments 10 and 11, as described above. So, the power flows through both filaments 10 and 11, which then will be turned ON.

In all these four figures, we can see that the socket center contact spring 23, which is a springy contact, can operate through a large arc. At its highest position 61, marked "F", the contact spring is under no load. This position is called the FREE position of the spring, hence the letter "F". If the spring is compressed all the way down, it will be seated against the bottom 29 of the socket, hence the letter "S" for this position 63. Usually the bulb is threaded down until it is seated on the socket middle contact element 31, which seems to also act as the "STOP". In this position, the socket center contact spring 23 is at its "acting" position 65, hence the letter "A".

NOTE: Hence, we will use the following legend:

"F" means the FREE shape of any spring.

"A" means the ACTING shape or position of any spring.

"S" means the SEATED shape or position of any spring.

Discussion Re the Socket Middle Contact Element 31

The purpose of this part, and the effect of the fact that it is rigid.

The socket center contact spring 23 has a wide range of acceptable positions, practically from position F 61 through position S 63, FIGS. 1 through 8. Ideally, the operating position 65 of the spring should be somewhere close to the center of its range. The way it is shown here in all the figures is pretty good.

This socket central contact spring can be considered as an ideal electrical contact spring. The reasons are: 1) It has a wide range of elastic travel. When it is fully seated, i.e. pushed as far down as it can go, it does not undergo any permanent plastic deformation, i.e. once released, it goes back to its original free position, hence it does not loose its force-deflection curve characteristics. 2) When the bulb is threaded in, the spring applies a force that is relatively constant. It is a relatively soft spring, and its force-deflection curve is relatively flat. This means the force magnitude remains roughly the same, for slight changes in the position of the bulb.

Compare this with the socket middle contact element 31 below.

The socket middle contact element 31 is a rigid mechanical part. You may have noticed that I keep referring to it as an "element", not as a "spring". In reality, every mechanical part can be considered as a spring. When a force is applied to any mechanical part, it will flex to some extent. But under the same amount of force, we can intuitively see that a member like the socket middle contact element 31 would deflect an infinitesimal amount, compared with the deflection of a member like socket center contact spring 23 under the same amount of force. So, for all practical purposes, we can safely say that socket middle contact element 31 is not a spring, but is a rigid body.

The way I see it, the original purpose of the socket middle contact element 31 seems to be two-folds. First and foremost, it is supposed to function as an electrical contact And incidentally, it is also supposed to function as a mechanical stop, I guess. I personally do not see the need to have a mechanical stop, because the bulb can safely be threaded in all the way until the central spring is fully seated against the floor 29 of the socket. This is what happens with the single wattage light bulbs. They do not have and do need an additional element to act as a stop. So, why would a 3-way bulb need one? So, if the sole purpose of socket middle contact element 31 is to act as an electrical contact spring, then a better design is needed. And this is what I am offering here by this invention.

What happens when we thread a light bulb in such a socket against this socket middle contact element 31. If the bulb is pushed tightly against it, by threading/turning it tightly, then the top surface of socket middle contact element 31 starts to rub and scratch the surface of the bulb middle contact ring 3. The socket middle contact element 31 would not deflect like the socket center contact spring 23. It would stand its ground. What would give in is the softer surface of the bulb middle contact ring 3. The socket middle contact element 31 may dig in and create a slight grove in bulb middle contact ring 3. This can continue until the resistance against further turning the bulb becomes too great, so we stop turning. This is fine. What we get in this case is two things. First, the scratching and digging exposes clean base metal on both surfaces of socket center contact spring 23 and socket middle contact element 31 and creates a good electrical connection. At the same time, it creates a stable mechanical connection, where the two parts are "locked-in" and would not be unlocked unless forcefully done so. Such a locked-in mechanical situation makes for a mechanically stable connection, and a relatively permanent one. Thus, the electrical contact in this case would be good and acceptable and it would work for a long time.

However, once in a while, we get the elevated rough uneven solder spot 19 in the picture. If the orientation of the thread on the base of the bulb, and the orientation of the socket threaded shell 27, and the circumferential position of the solder spot 19, all work in some strange way, we would end up having the solder spot 19 hit socket middle contact element 31 while we are just about ready to make the electrical/mechanical contact with it (socket middle contact element 31). It is like when the stars line up once in a while. If that happens, then we have a problem. This is what happens.

The solder spot 19 would hit the socket middle contact element 31 against its side, not along its upper surface. This is because the solder spot 19 is higher than it adjacent ring surface. This would prevent the bulb from turning any further. The user would feel the resistance against turning, so he would stop turning any further, thinking that he has done a good job inserting/installing the bulb into the socket. In fact, there is a "temporary" mechanical as well as an electrical contact at that moment, but in reality it is an unstable contact because the mechanical contact is unstable. It is not "locked-in", as compared to the previous situation described above. There is not enough friction or other restrains that would ensure that the solder spot 19 would remain in that position forever. Any slight disturbance may "dislodge" the spot from this position and would push it away from socket middle contact element 31. If that happens, then we would get an open electrical circuit and the electrical current/power would be interrupted and the light would go off. The disturbance could move the spot away from socket middle contact element 31 just temporarily or permanently. If it were temporary, then it would be a worse case. Because the electrical power would be interrupted for a short moment and the light would go off, and then the disturbance would push the spot back against the socket middle contact element 31 and the power and light would go on again. This may repeat often enough and we would get the undesirable "flicker". This disturbance could be a vibration from any outside source or could be due to temperature fluctuation or any other source. The disturbance does not need to be extremely large. Even a few thousandth of an inch movement could result in such an undesirable result. Again, the reason is that the contact between the spot and socket middle contact element 31 is not a "stable" one, as explained above. The connection is not locked-in mechanically, so it is unstable and unreliable.

In contrast, if we do the same thing with a contact spring, like socket center contact spring 23, and we move the bulb by similar distances, the electrical current flow would hardly be affected at all. The contact spring, being elastic, would "follow" the bulb and would still exert/apply approximately the same amount of contact force, thus maintaining the required conditions for a good electrical connection. We would not get any interruptions in the current flow and the light would stay on and would not flicker.

Back to the Problem

So, the problem, as explained above, is with the rigidity of socket middle contact element 31 of the socket, in conjunction with the elevated uneven surface of the solder spots 19 of the bulbs and their position on the bulb middle contact ring 3.

Please note that if the socket is used by itself, then there is no problem. It works OK. Similarly, if the bulbs are used by themselves, then again there is no problem. They would work. However, when you use them together, then the problems arise.

If we look at FIGS. 5 through 8, we notice the solder joint 19 represented by the irregular blob at the left side of the bulb middle contact ring 3. It is shown at that position simply for illustration purposes. In reality, we do not know where it ends up, when the bulb is threaded into the socket. It can be exactly at the position shown, or it can end up right on top of socket middle contact element 31, or anywhere in between. If it happens to end up close to SM, then we can expect some difficulties, as explained above. In other words, if this happens, then we could get an intermittent contact, i.e. the electrical power may not be steady. It may be readily interrupted, thus creating the "flicker", or the contact resistance could be high, creating a hot spot, etc.

To repeat then, one source of potential problem is the fact that socket middle contact element 31 is rigid. This can be a problem, regardless of where the solder joint 19 ends up. During the operation of the bulb and socket system, the elements of the system gets exposed to varying temperatures. The result is that the elements change temperature and consequently expand or contract accordingly. Any such changes can force the contact elements to get closer to each other, which is not too bad. On the other hand, the contact elements could get farther apart. This is where trouble starts. We would get what could be considered an open circuit. Or at least, it could be a high resistance contact condition. In either case, the power could become discontinued or lowered because of the open circuit or the high resistance. This can manifest itself as the dreaded "flicker".

A Personal Experiment

To determine the Location of the Bulb Solder Spots 19 with respect to socket middle contact element 31.

I have purchased five 3-way light bulbs at random from a local store. I have inserted each one of them into one and the same 3-way socket, and threaded them down until I hit "bottom", i.e. until I felt enough resistance against threading in the bulb any further.

I have marked the rotational location 73 of each bulb with respect to a specific point on the socket. See the black mark 71 on the thread of the bulb, as shown in Picture 1.

In Pictures 2 and 3, the five bulbs, 71, 75, 79, 83 and 87, are positioned with their black marks, 73, 77, 81, 85 and 89, roughly in the same angular position, namely facing the viewer. It can be seen that the solder spots 19 of each of the five bulbs, on bulb middle contact ring 3, are not in the same comparable angular positions. They are distributed randomly around the ring, as follows:

Bulb #1 71 has the solder spot 19 spread from around 2 o'clock to around 5+o'clock.

Bulb #2 75 from around 3 o'clock to around 5+o'clock.

Bulb #3 79 from around 12 o'clock to around 2+o'clock.

Bulb #4 83 from around 9 o'clock to around 10+o'clock.

Bulb #5 87 from around 8 o'clock to around 9 o'clock.

Obviously, the bulbs are not consistent, as far as the angular location of the solder spot 19 with respect to the thread on the bulb base 5 is concerned.

Out of these five bulbs, one bulb ended up with the solder spot 19 hitting the rigid middle contact/stop element 31 of the socket. You may notice that I will refer to the socket middle contact element 31 also as the "stop 31" or the socket middle stop 31. This created an interference. It prevented the bulb from being rotated any further. The bulb simply hit the stop 31 and stopped rotating. It is because the high shape of the solder spot 19 hit the side of the stop 31, instead of its top contact surface, as it should do. This prevented the bulb from rotating any further. This type of "touching" could be considered a false contact condition and makes for an unstable contact and could create "flicker".

Although this has not been a statistically rigorous experiment, still one out of five bulbs proving defective is a high percentage (20%) of defects among this small sampling.

Prior Art:

As far as I know, there has never been any prior art covering anything similar to the concepts offered in this present invention. I am not aware of any. I am sorry; I could not find any.

In the following specifications I will propose some solutions that could help.

SUMMARY OF THE INVENTION

The present invention addresses the contact elements of the 3-way light bulbs and their corresponding sockets.

The invention tries to solve the problem at either side. First, it proposes some solutions that can be introduced and implemented for/with the sockets. Second, it proposes some other solutions that can be implemented for/with the bulbs themselves.

Then it addresses the system that comprise both a Bulb and a Socket together and the interaction between them.

And then it introduces some add-on devices that can be used as inserts or adapters, in conjunction with the bulbs and sockets.

The basic goal is to provide contact elements that can absorb and/or compensate for the expected irregularities in the surface of the bulb middle contact ring 3, or eliminate the irregularities or provide means to be able to live with such irregularities.

First, the sockets could have springy middle contacts. A number of alternatives are being proposed.

Second, the bulb could be manufactured such that the connection spot is flush with the surrounding general surface of the bulb middle contact ring 3. Other alternatives related to the bulbs will be considered. For example, we could provide some springy cushiony elements at the bulb middle contact ring 3. These could include a simple conductive paste or grease (although this may be hard to control) or some conductive sponge-like material, in the form of a washer or ring or doughnut, or inserts or adapters in general. Of course, we must at the same time ensure that this conductive material does not touch other contact elements. Note: Sometimes, I will use the spelling "donut" for "doughnut" and vice versa. It seems they are acceptable as interchangeable spellings.

Thirdly, the bulbs and the sockets could be manufactured in a way such that the orientation of the thread of either the socket shell of said socket and/or the bulb base is such that when a bulb is inserted into a socket and is threaded in all the way until fully seated, then the connection spot of the bulb will not touch, actually will not be near enough to touch the socket middle contact element 31.

Fourthly, the add-on devices that can be used as inserts or adapters, in conjunction with the bulbs and sockets, could be manufactured and sold separately on the after-market, to help the end users in coping with the problems with existing parts, i.e. with those bulbs or sockets that are already on the market and did not take advantage of the present inventions yet.

Still other objects and advantages of the present invention will become readily apparent to those skilled in this art from the following detailed description wherein I have shown and described only the preferred embodiments of the invention, simply by way of illustration of the best modes contemplated by carrying out my invention. As will be realized, the invention is capable of modification in various obvious respects all without departing from the invention. Accordingly, the drawings and description of the preferred embodiment are to be regarded as illustrative in nature, and not as restrictive.

There will be a few other details offered. They will all be described down below.

BRIEF DESCRIPTION OF THE DRAWINGS

All the drawings in these specifications.

Figure 1:
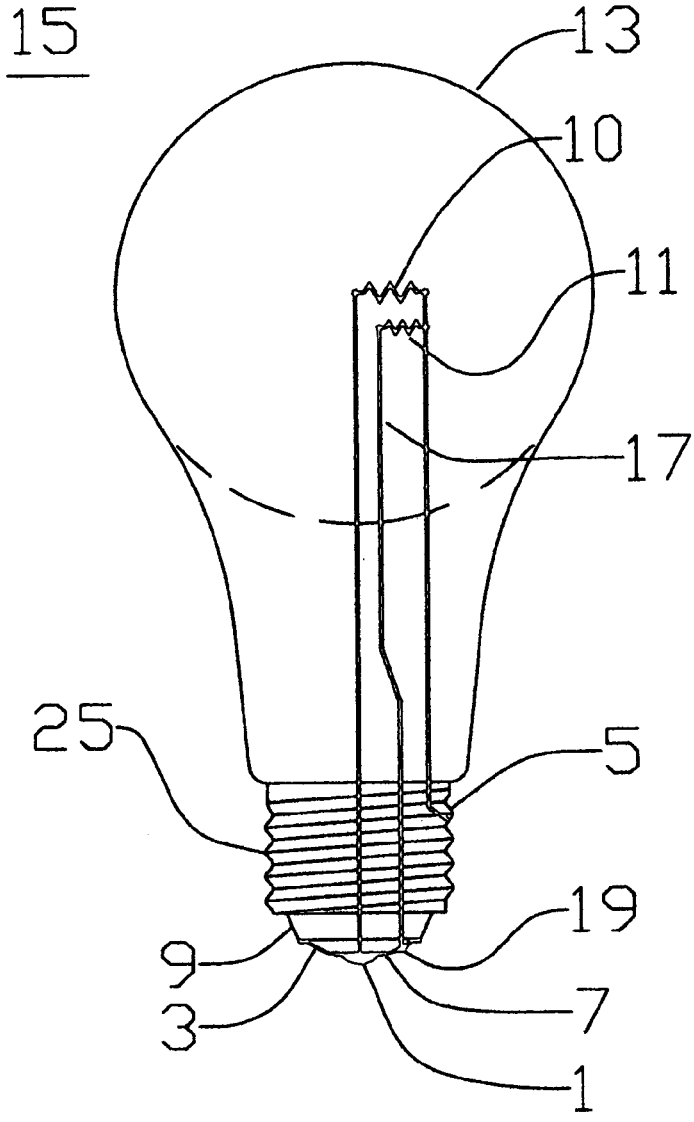
(PRIOR ART) FIG. 1
FIGS. 1 through 53 are exact copies of those figures with corresponding numbers, which were included with Ref1. However, FIGS. 47 through 51 have a small problem that I will discuss when I fully describe them in the Specifications. I have also added a few more drawings and included some photographic pictures and computer scanned pictures and some 3D-views from a 3D-CAD program, over and above what was included in Ref1. I am not sure whether the pictures are permissible to be included in the patent application, but I have included them for information at least. If the Patent Examiner decides against them, then we can discard them and if necessary I can replace them by some other figures that would be more acceptable to the Examiner.
Figure 2:
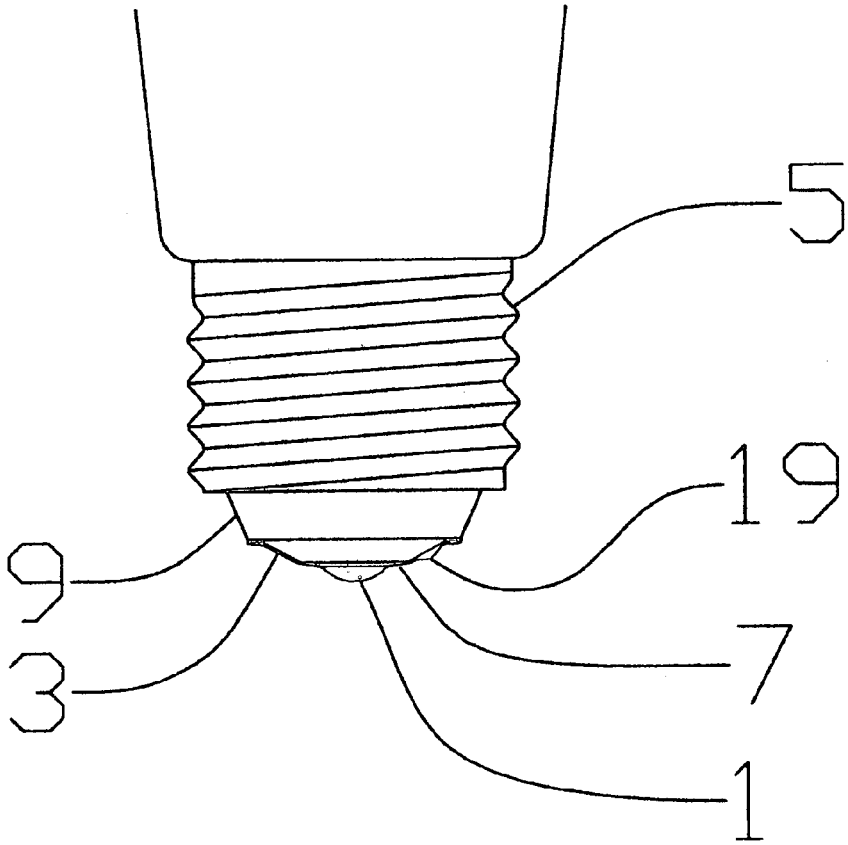
(PRIOR ART) FIG. 2
Figure 3:
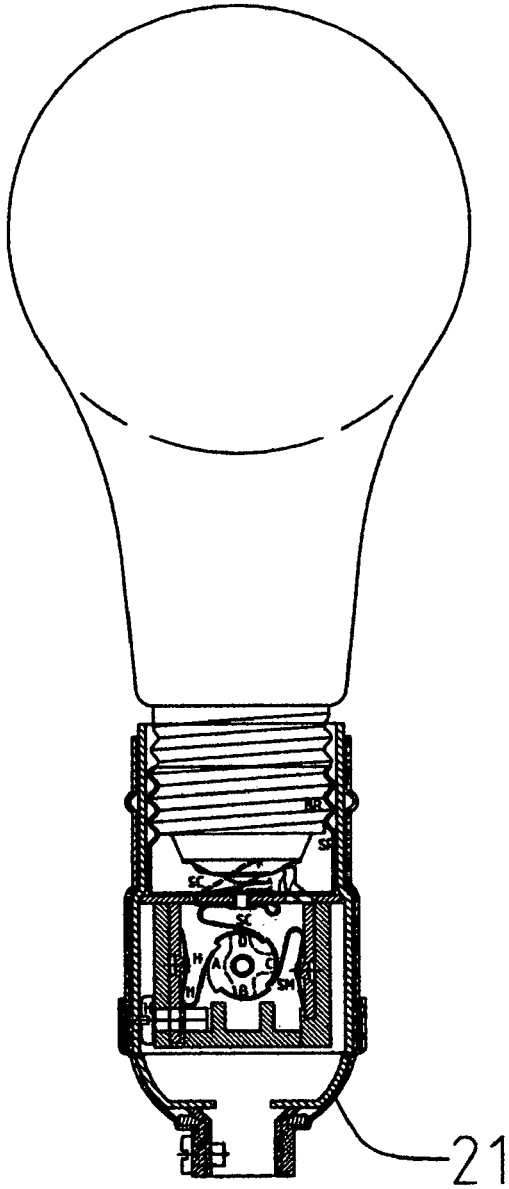
(PRIOR ART) FIG. 3
Figure 4:
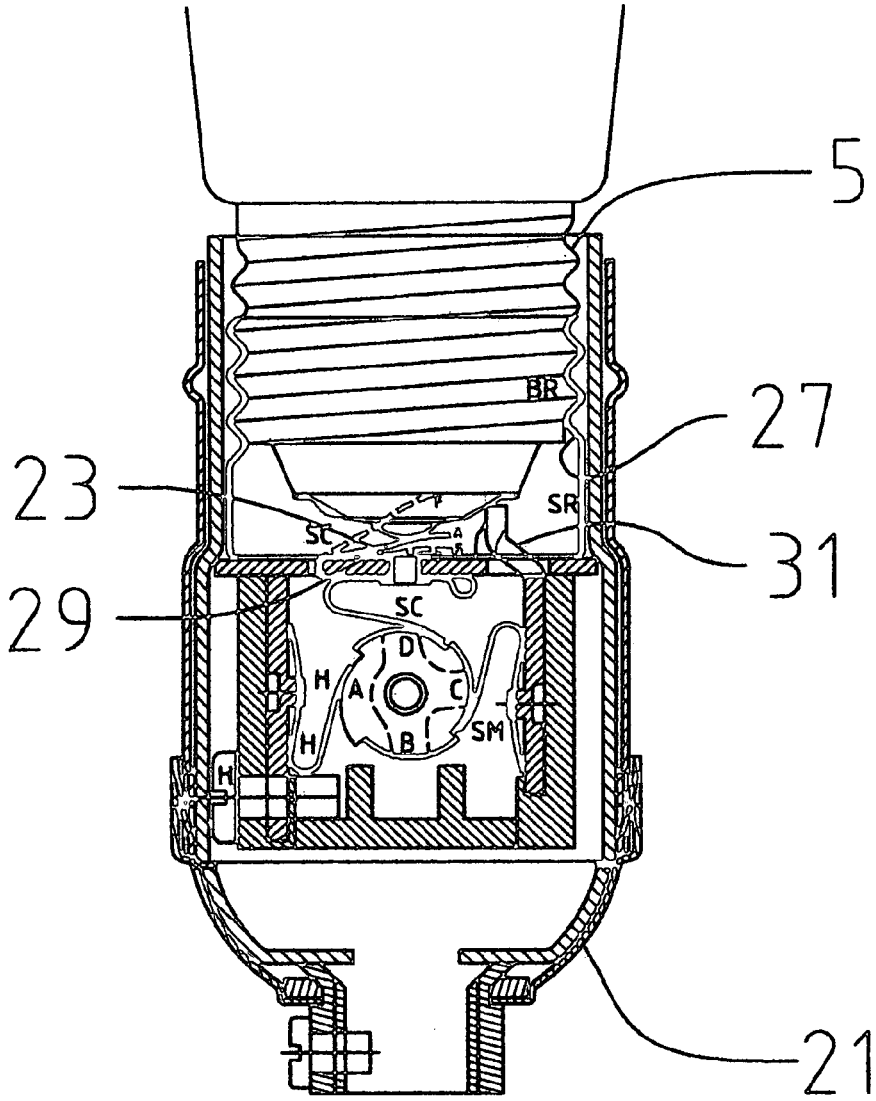
(PRIOR ART) FIG. 4
Figure 5:
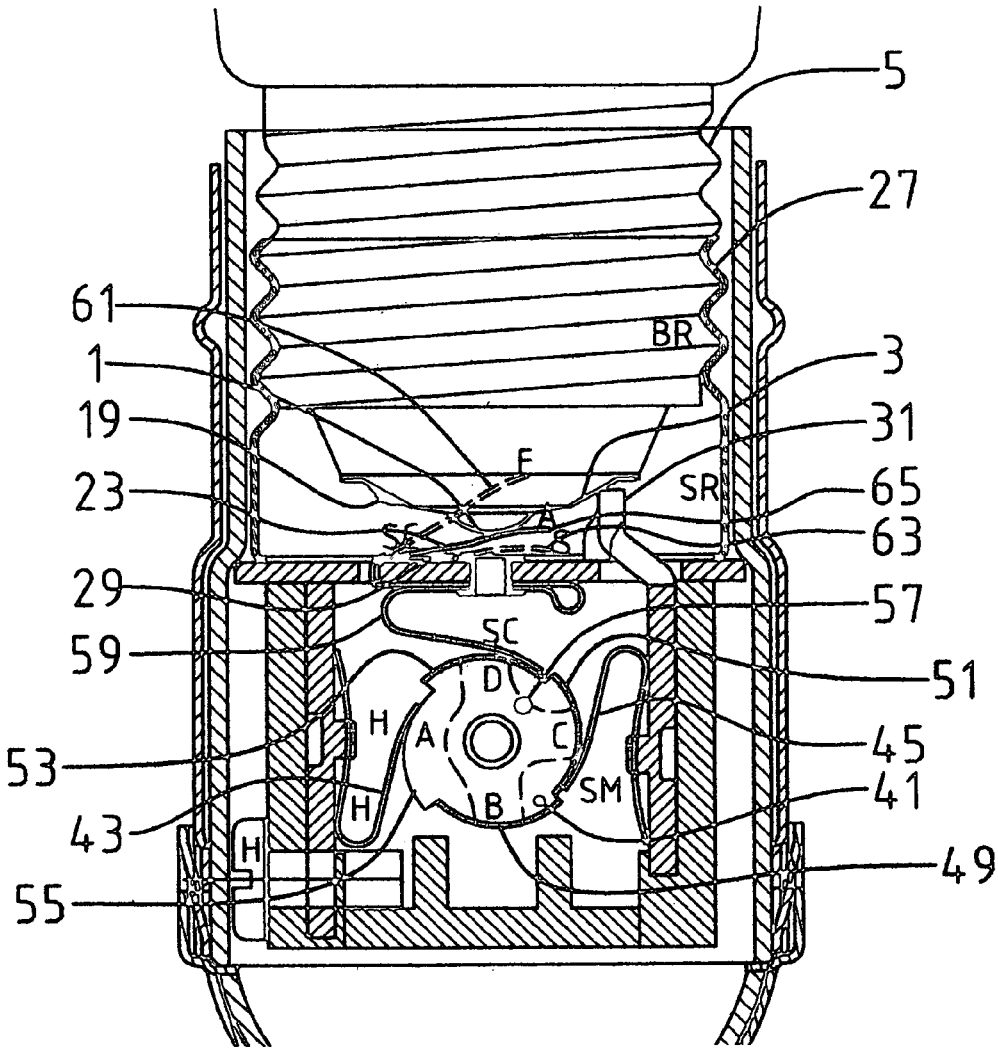
(PRIOR ART) FIG. 5
Figure 6:
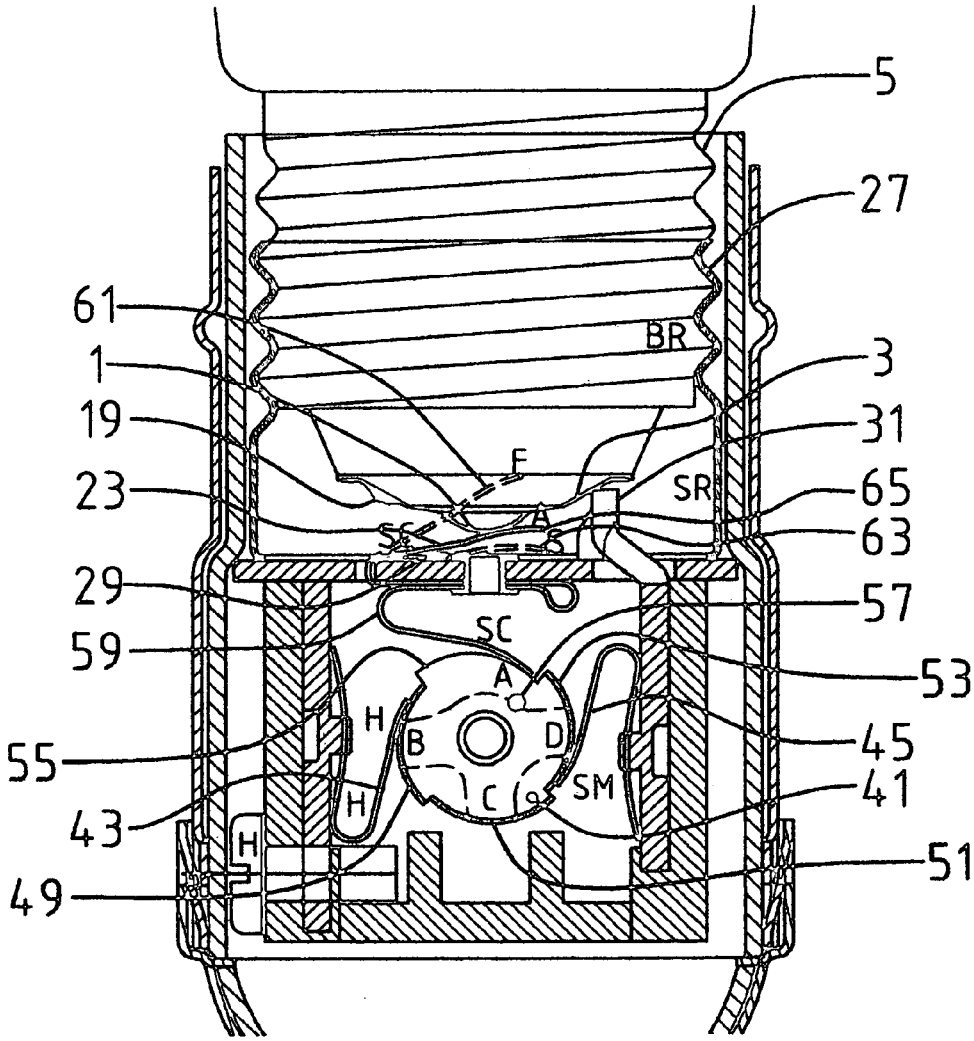
(PRIOR ART) FIG. 6
Figure 7:
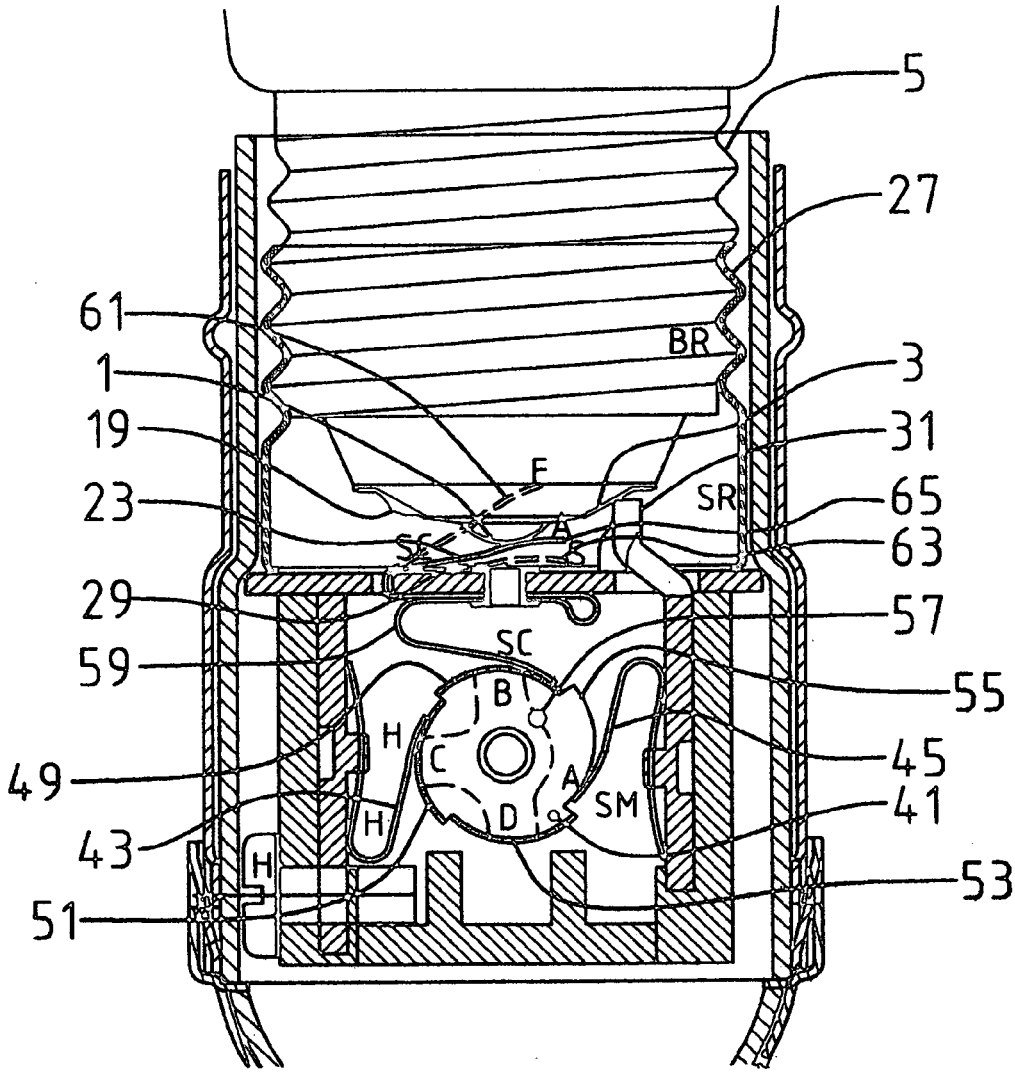
(PRIOR ART) FIG. 7
Figure 8:
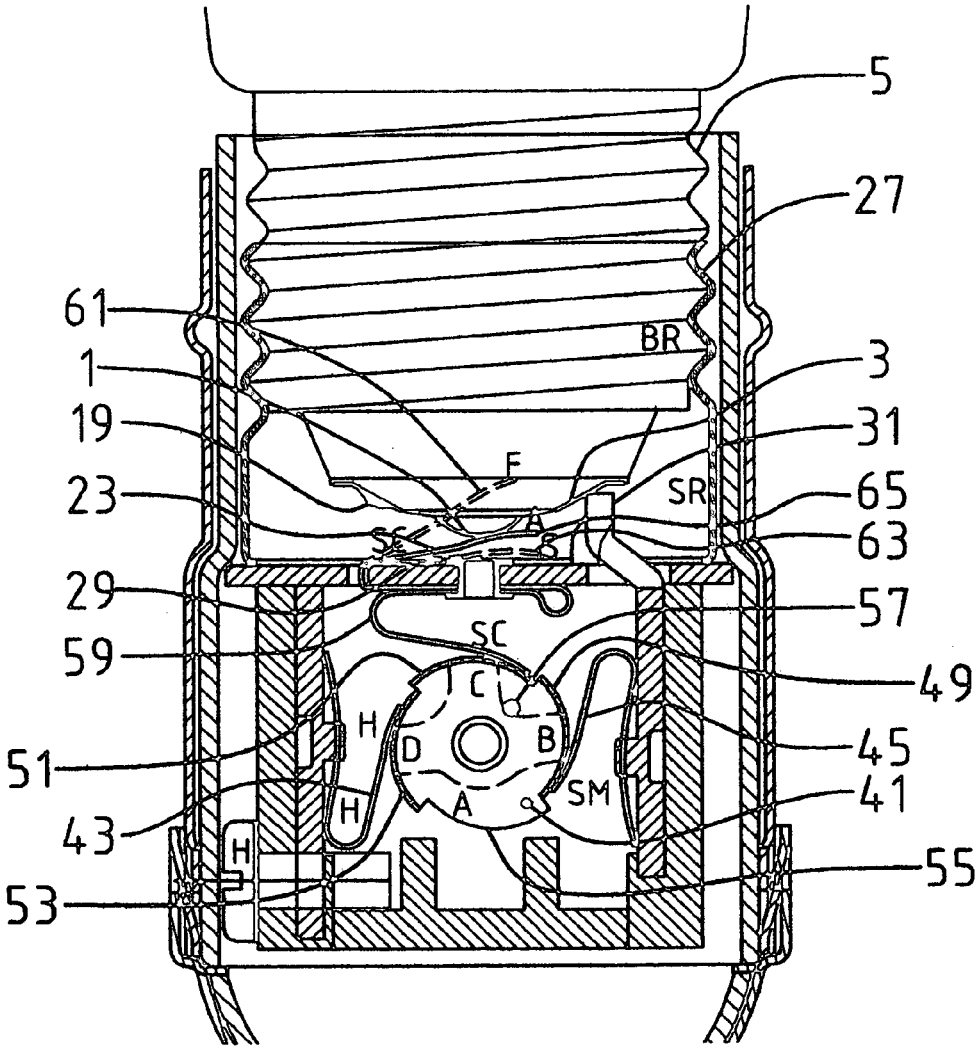
(PRIOR ART) FIG. 8

Drawings 1 through 4 show a 3-way light bulb and a 3-way electrical socket and their components.

Drawings 5 through 8 show how a 3-way socket works to turn on or off the filaments of a 3-way light bulb.

Drawings 9 through 22 show two views for each of seven new proposed contact springs as per present invention.

Drawings 23 through 27 show various 3-D views of one of the new proposed contact springs as per present invention.

Drawings 28 through 40 show various 3-D views of another one of the new proposed contact springs as per present invention and how it interacts with one of the existing contact elements in an existing 3-way electrical socket.

Drawings 41 and 42 show two views of an eighth new proposed contact spring as per present invention.

Drawings 43 through 46 show various 3-D views of the eighth new proposed contact spring as per present invention and how it interacts with one of the existing contact elements in an existing 3-way electrical socket.

Drawings 47 through 49 show various views of an add-on donut that would interact with the bulb and the socket.

Drawing 50 shows a view of an add-on ringed donut that would interact with the bulb and the socket.

Drawing 51 shows a view of an add-on guided donut that would interact with the bulb and the socket.

Drawings 52 and 53 show two views of the possible locations and/or orientation of the new proposed socket contact springs as per present invention.

Drawings 54 through 56 show various additional views of the add-on donut, which was shown in drawings 47 through 49.

Drawings 57 and 58 show two views of a second add-on, a two-layer donut that would interact with the bulb and the socket.

Drawings 59 through 61 show various views of a third add-on, a ringed donut that would interact with the bulb and the socket.

Drawings 62 and 63 show two views of a fourth add-on, a 2-layer ringed donut that would interact with the bulb and the socket.

Drawings 64 and 65 show two views of a fifth add-on, a guided donut that would interact with the bulb and the socket.

Drawings 66 through 68 show various views of a sixth add-on, a 2-layer guided donut that would interact with the bulb and the socket.

Drawings 69A and 69B show two views of a seventh add-on, a hard guided donut that would interact with the bulb and the socket.

Drawings 70 through 74 show various views of new proposed designs for 3-way light bulbs and how they might interact with their 3-way electrical sockets.

In addition, I am including the following pictures and scans and color 3-D drawings.

Picture 1 is a photographic picture, which shows a 3-way light bulb, together with certain markings indicating the performance of the bulb in conjunction with a 3-way electric socket.

Pictures 2 and 3 are photographic pictures, which show 5 such 3-way light bulbs, together with similar marking indicating their performance in conjunction with a 3-way electric socket, showing particularly how each of the 5 bulbs has performed differently than all the others.

Picture 4 is a photographic picture, which shows two 3-way electric sockets. One of the sockets is a standard conventional 3-way electric socket, while the second socket has been modified as per the present invention.

Picture 5 is a photographic picture, which shows an enlarged view of the second socket, shown in Picture 4.

Picture 6 is a computer scan, which shows two enlarged views of a new contact spring, according to the present invention, and which is being proposed to be used in the 3-way electric socket.

Picture 7 is a computer scan, which shows the components of a conventional 3-way electrical socket, together with the new proposed spring, that was shown in picture 6.

Pictures 8 and 9 are 3-D color drawings, made by a CAD program. They show two 3-D views of the conductive donut that was shown in Drawings 47, 48, 49, 54, 55, and 56.

Pictures 10 through 12 are 3-D color drawings, made by a CAD program. They show three 3-D views of the ringed donut that was shown in Drawings 50, 59, 60 and 61.

Pictures 10 through 12 are 3-D color drawings, made by a CAD program. They show three 3-D views of the ringed donut that was shown in Drawings 50, 59, 60 and 61. Picture 12 shows the outside ring as if it were made of a semi-transparent material, so that it would be possible to see some of the internal details of the component inside it.

Pictures 13 through 15 are 3-D color drawings, made by a CAD program. They show three 3-D views of the 2-layer guided donut that was shown in 66, 67 and 68. Picture 15 shows the outside ring as if it were made of a semi-transparent material, so that it would be possible to see some of the internal details of the component inside it. In addition, the inside compressible conductive donut is shown with a special color and texture to indicate the difference between it and the second layer, which is supposed to be of a solid harder metal.

Pictures 16 through 18 are 3-D color drawings, made by a CAD program. They show three 3-D views of the ringed donut that was shown in Drawing 69. Picture 18 shows the outside ring as if it were made of a semi-transparent material, so that it would be possible to see some of the internal details of the component inside it.

Figure 52:
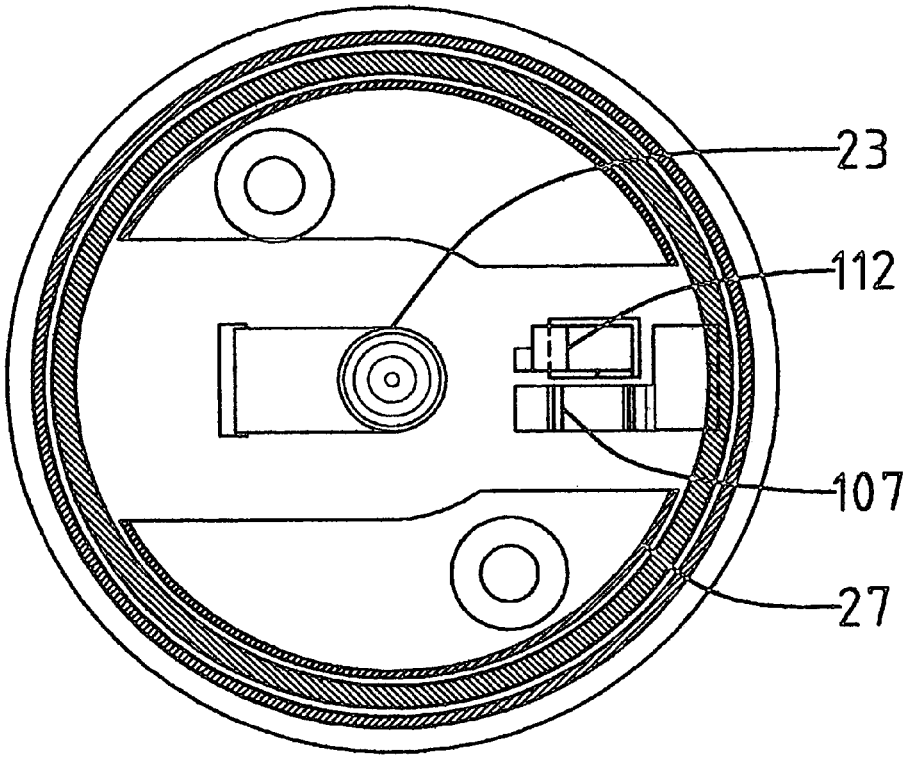
Figure 53:
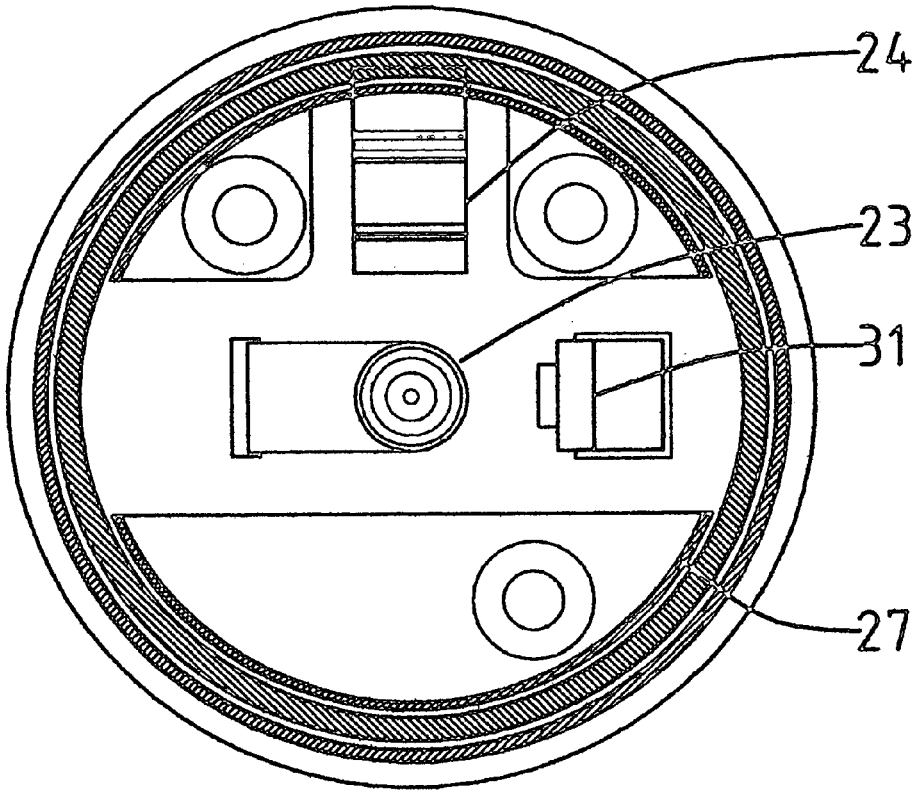

FIG. 52 shows an example of the "In-Line" contact arrangement, while FIG. 53 shows an example of the "Offset" contact arrangement. In the Offset arrangement, we can place the new contact spring in line with the socket center contact spring, because the socket middle contact element 31 is out of the way. But, in the In-Line arrangement, we don't have that kind of room. So, in the latter (In-Line) arrangement, we are forced to use the same location for both the new contact spring as well as the socket middle contact element 31. For this reason, we revert to the arrangement

DESCRIPTION OF THE PREFERRED EMBODIMENTS

While the invention is susceptible of various modifications and alternative constructions, certain illustrative embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

While I am describing the drawing in more details, I will at the same time explain the technology basis of the invention. I will also include a number of examples in this section, which should be considered as part of the embodiments for the purpose of this application as well.

This description covers more than one invention. The inventions are based partly on the same technology platform, but then each of the inventions has some additional features of its own. Not being an expert in handling patents, I would like to leave it to the patent examiner to decide on the number of the inventions contained and how to split one invention from the other.

Description of the Invention.

As mentioned earlier in the summary, there are several inventions here. I will describe them as we go along. I will however group them into four groups. The specifications will cover these four groups of inventions. Group One will cover inventions related to the Sockets; Group Two, inventions related to the Bulbs; Group Three, inventions related to the Systems that comprise both a Bulb and a Socket together; and finally Group Four, those related to Add-On devices, which I would call as Inserts or Adapters.

Group One: Inventions Related to Sockets & Socket Springs.

Basically, I will introduce some contact springs to work either together with the existing rigid socket middle contact element 31, or to replace this rigid element altogether.

The new contact springs can work in the same radial line area as the existing rigid one, as in FIG. 52; or it can be located at some relative angular position to it, for example as in FIG. 53. This is when we look down at the socket from its opening. See FIGS. 52 and 53, and as in Pictures 4 & 5. Usually, most of the sockets on the market are built to have the socket center contact spring 23 come from near the rim 47 of the socket towards the center. The socket middle contact element 31 is usually located across from socket center contact spring 23, i.e. at. 180 degrees from it. Most of the proposed new contact springs will be located in the same way. I will call this kind of spring location the "In-Line" arrangement. See also Pictures 4 and 5.

However, if the socket has a pull chain actuator built-in, the arrangement is slightly different. In this case, the socket middle contact element 31 can be at 90 degrees with respect to the socket center contact spring 23. This can be beneficial. We can take advantage of this "acceptable" arrangement and do the same thing with our new proposed contact springs. I will call this kind of spring location the "Offset" arrangement, as in FIG. 53?.

PREFERRED EMBODIMENTS

Socket/Spring Embodiment #1

Figure 9:
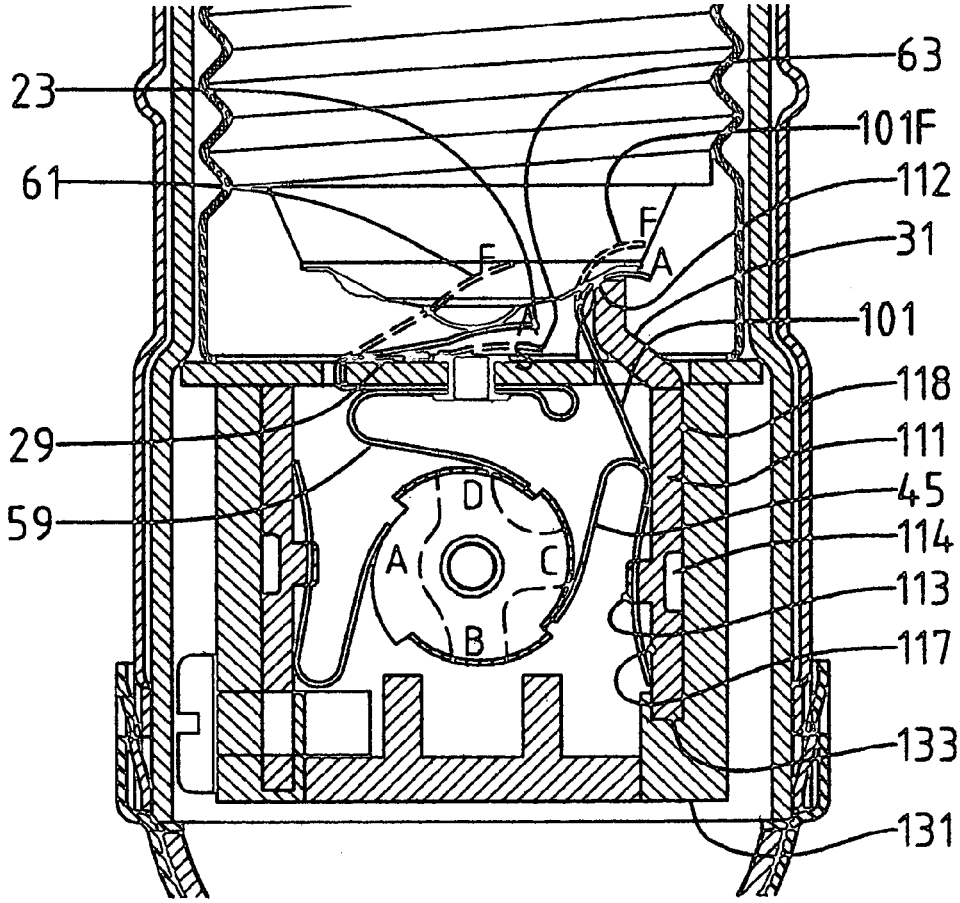
Figure 10:
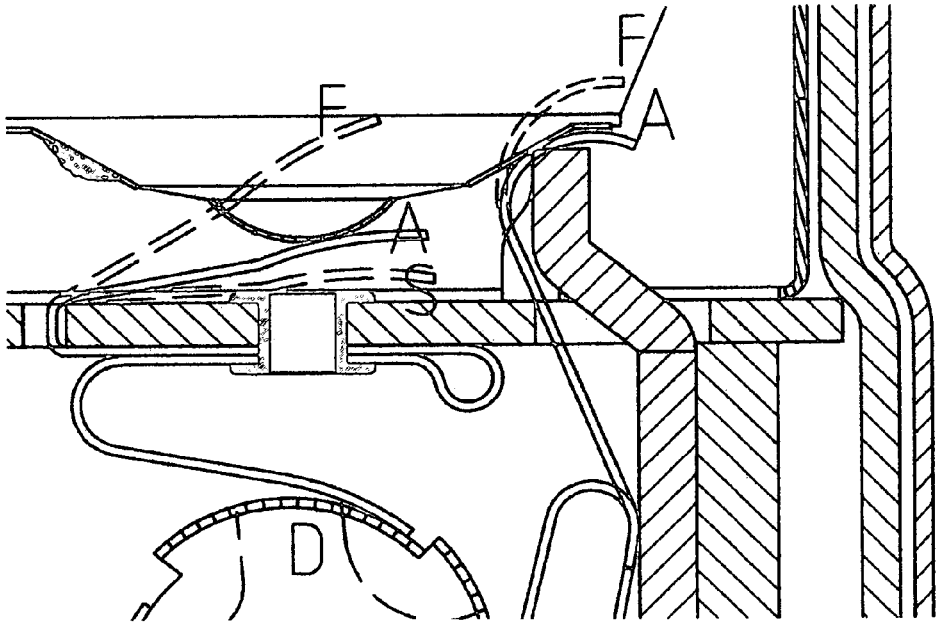

FIGS. 9 and 10 show a new contact spring 101. This can work either in conjunction with the existing socket middle contact element 31, or it can replace it. FIG. 9 gives the general picture or configuration, while FIG. 10 gives a close-up view.

I will repeat this same approach in many of the following embodiments. The first figure will show the general picture or configuration of the new proposed contact spring, while the second figure will give a close-up view.

I will also describe al the new springs in more detail at the notes below and at the end of this overview.

Socket/Spring Embodiment #2

Figure 11:
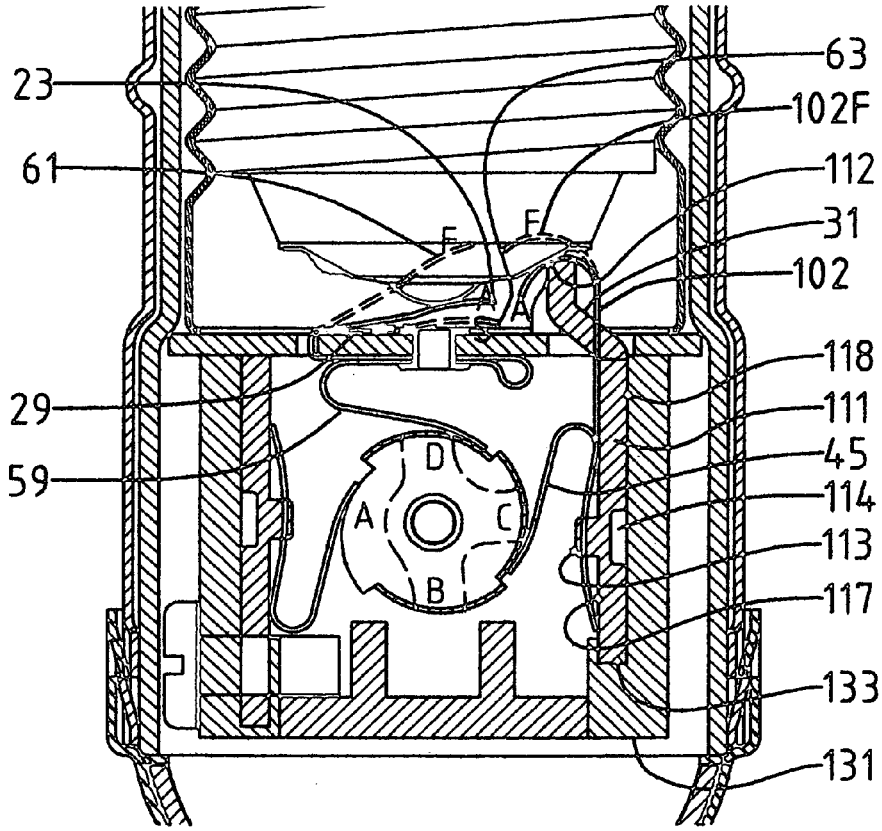
Figure 12:
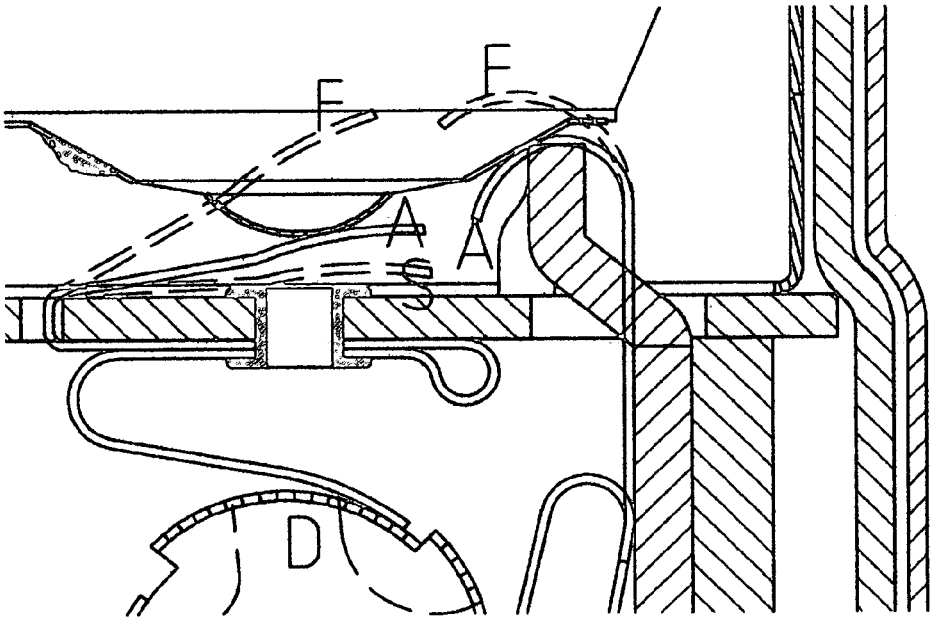

FIGS. 11 and 12 show a second contact spring 102. Again, this can work either in conjunction with the existing socket middle contact element 31, or it can replace it.

Notes Re Embodiments #1 and 2.

In both these two embodiments, the spring is on the left side or "inside face" 117 of the main body 111 of socket middle contact element 31. The new spring can be a new additional one, or it can be an integral part of the existing switch middle wiper 45. Please see FIGS. 9 and 13 for terminology and for the Ref #s.

I am calling this kind of new contact springs the Group "A" springs.

Socket/Spring Embodiment #3

Figure 13:
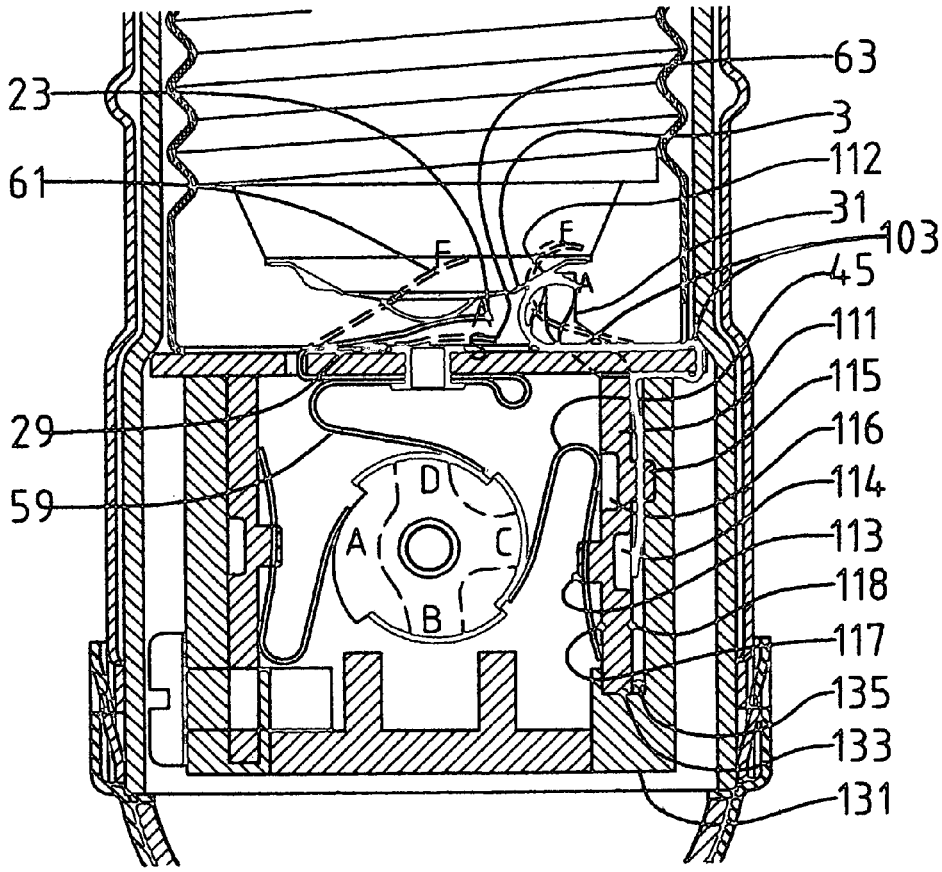
Figure 14:
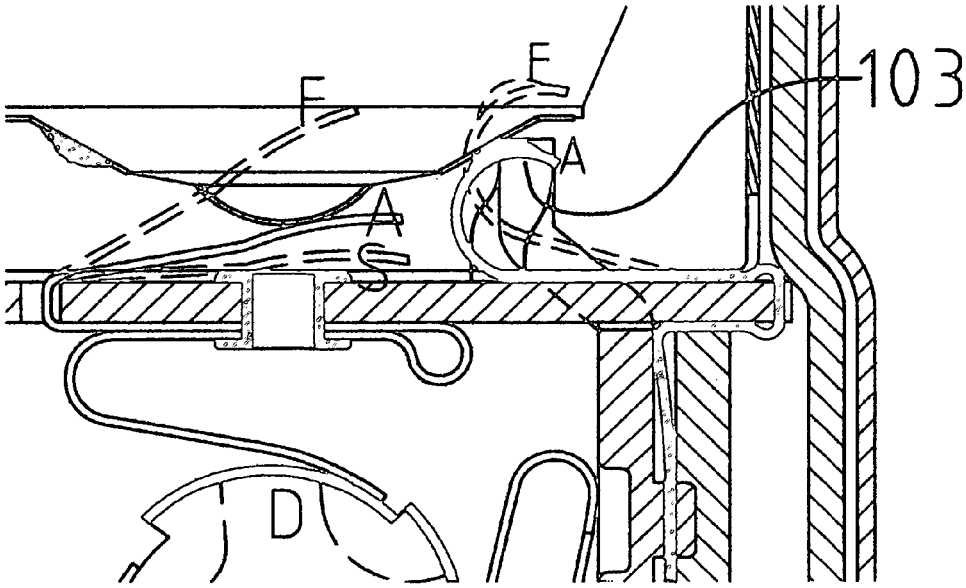

FIGS. 13 and 14 show a 3rd contact spring 103. Again, this can work either in conjunction with the existing socket middle contact element 31, or it can replace it.

Socket/Spring Embodiment #4

Figure 15:
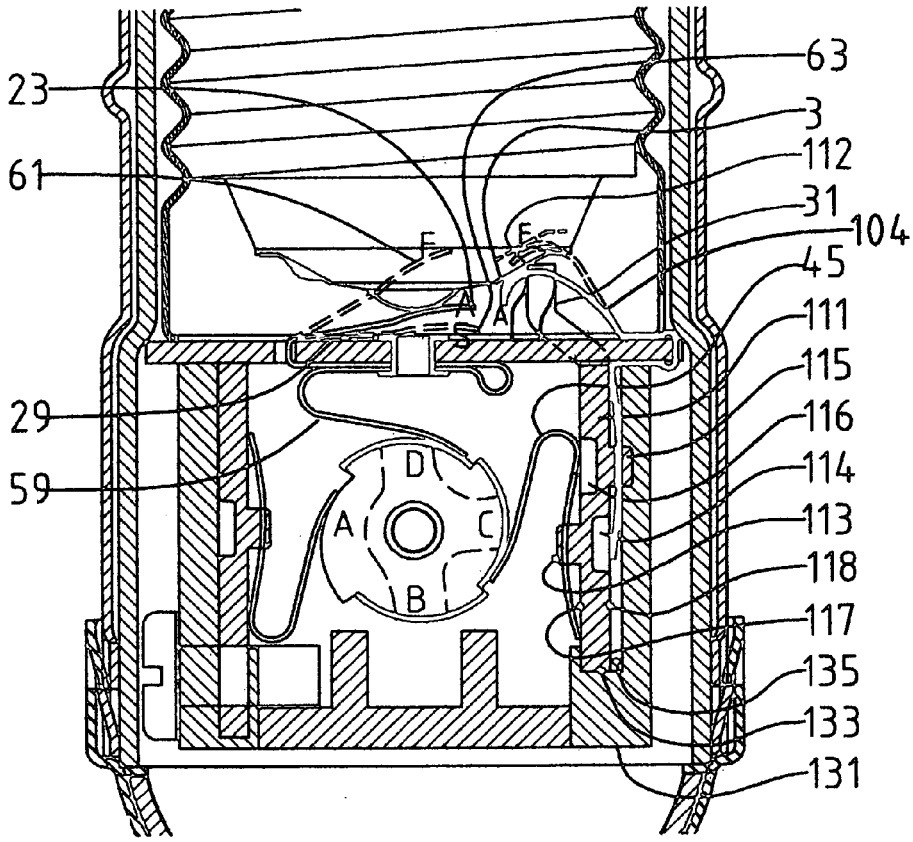
Figure 16:
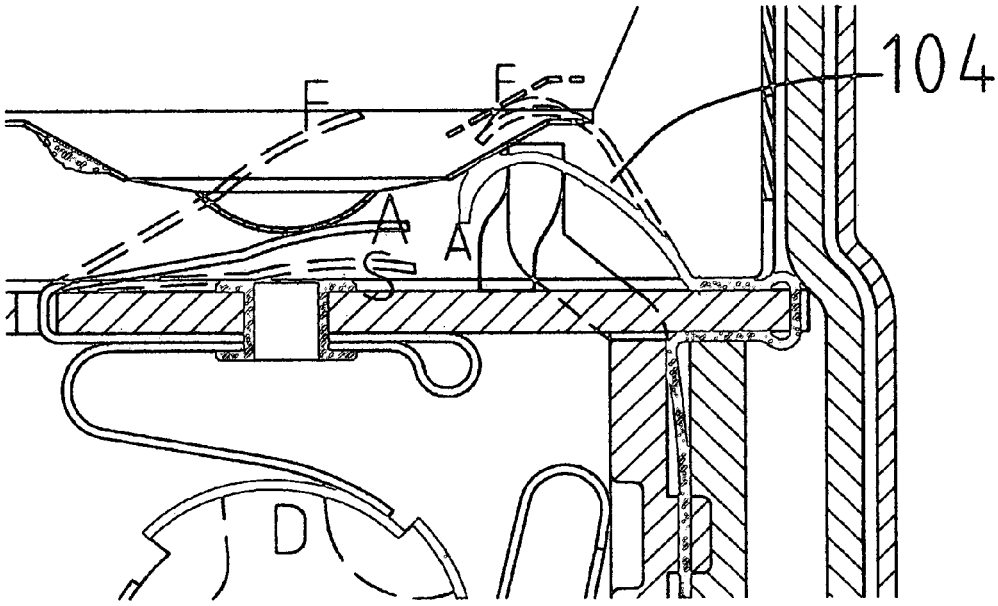

FIGS. 15 and 16 show a 4th contact spring 104. Again, this can work either in conjunction with the existing socket middle contact element 31, or it can replace it.

Socket/Spring Embodiment #5

Figure 17:
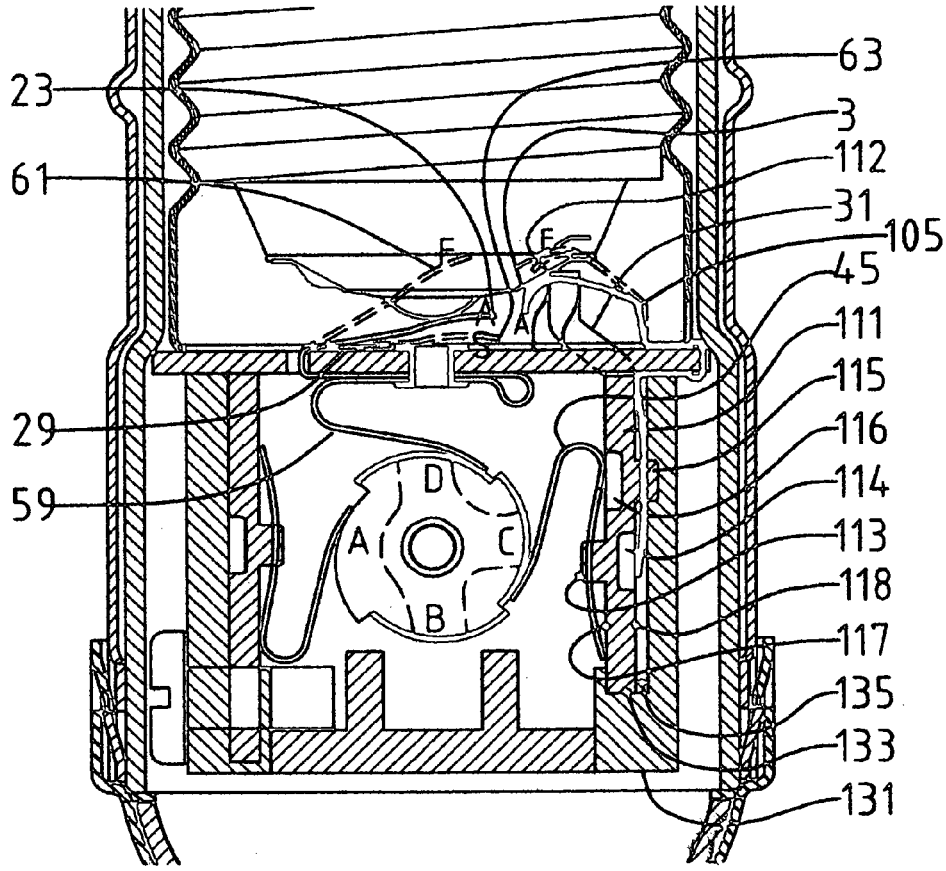
Figure 18:
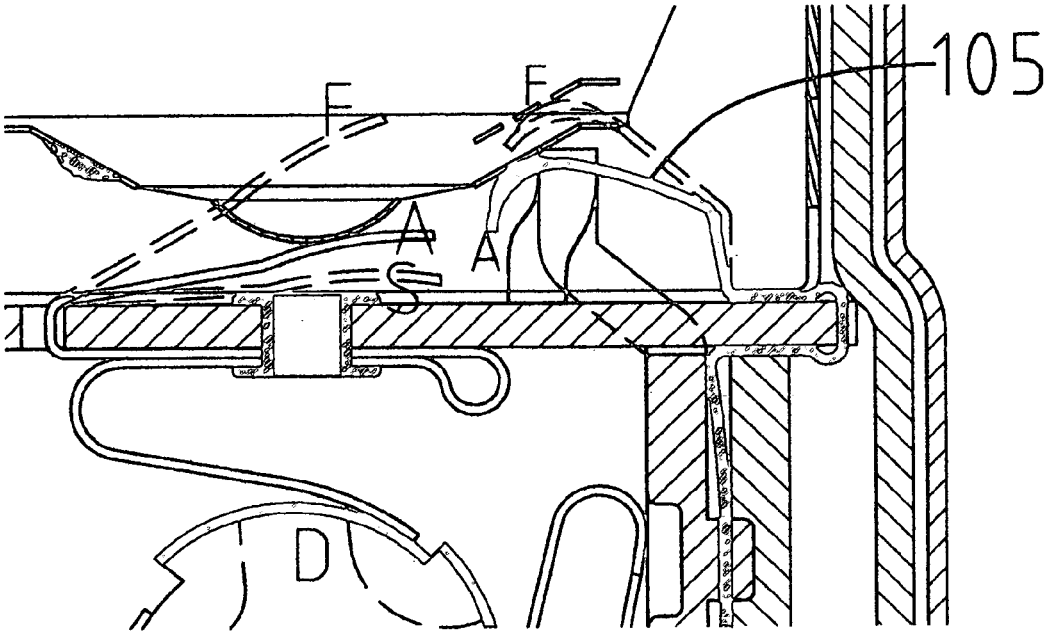

FIGS. 17 and 18 show a 5th contact spring 105. Again, this can work either in conjunction with the existing socket middle contact element 31, or it can replace it.

Socket/Spring Embodiment #6

Figure 19:
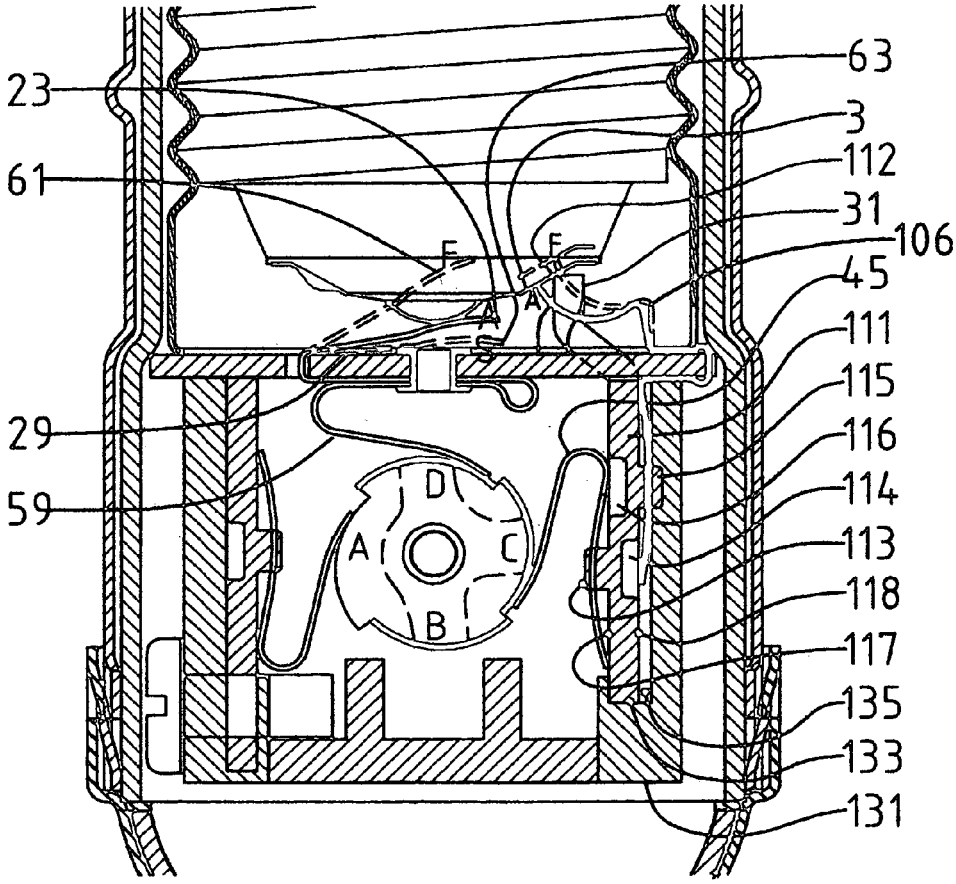
Figure 20:
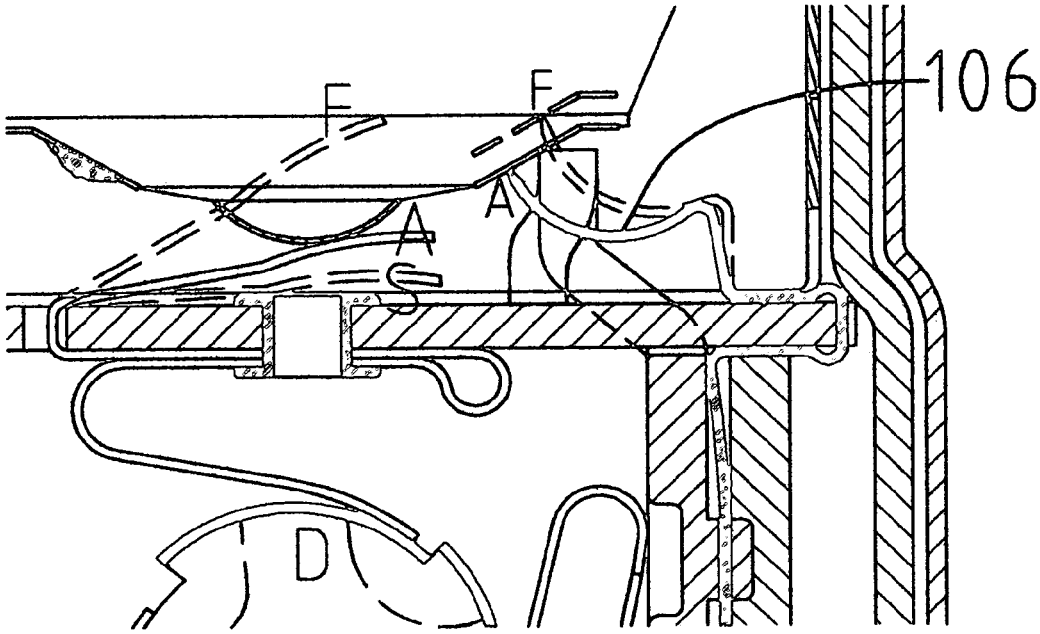

FIGS. 19 and 20 show a 6th contact spring 106. Again, this can work either in conjunction with the existing socket middle contact element 31, or it can replace it.

Socket/Spring Embodiment #7

Figure 21:
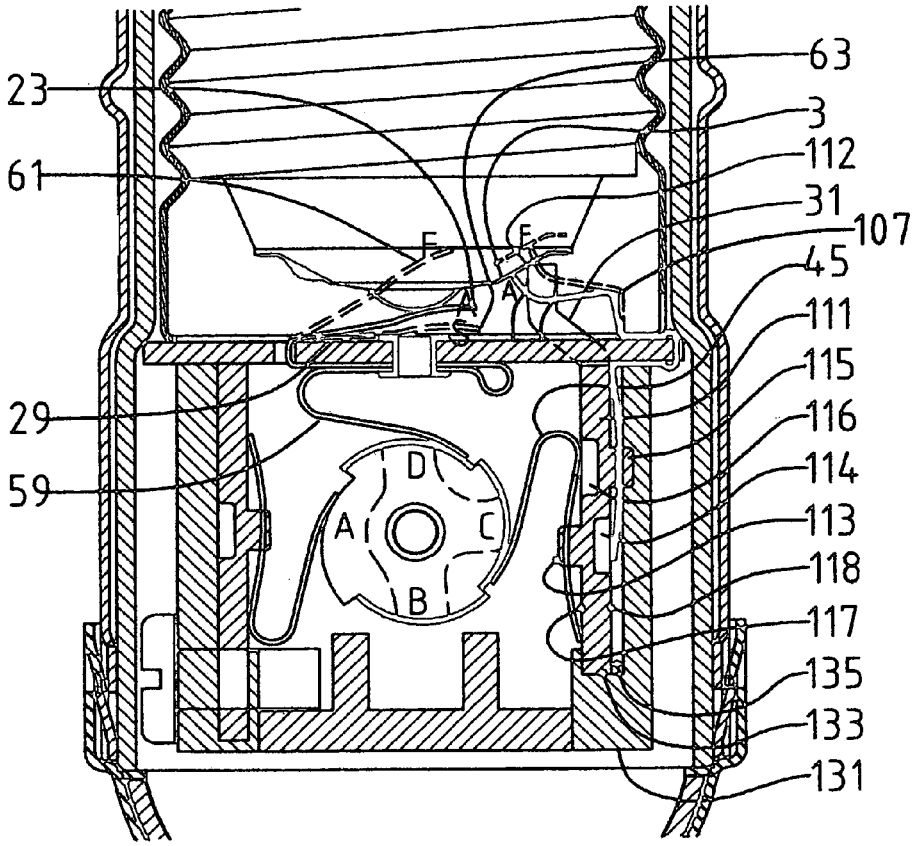
Figure 22:
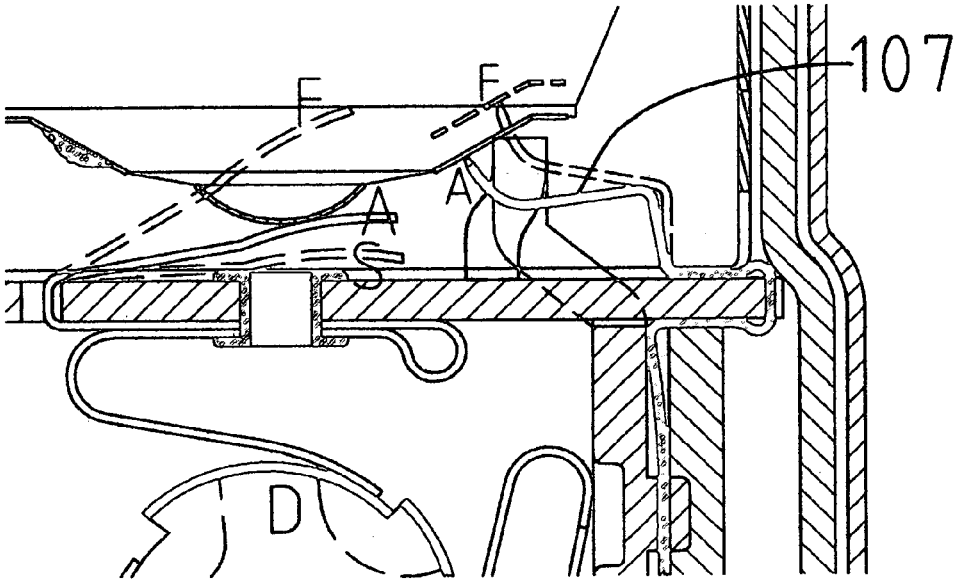
Figure 23:
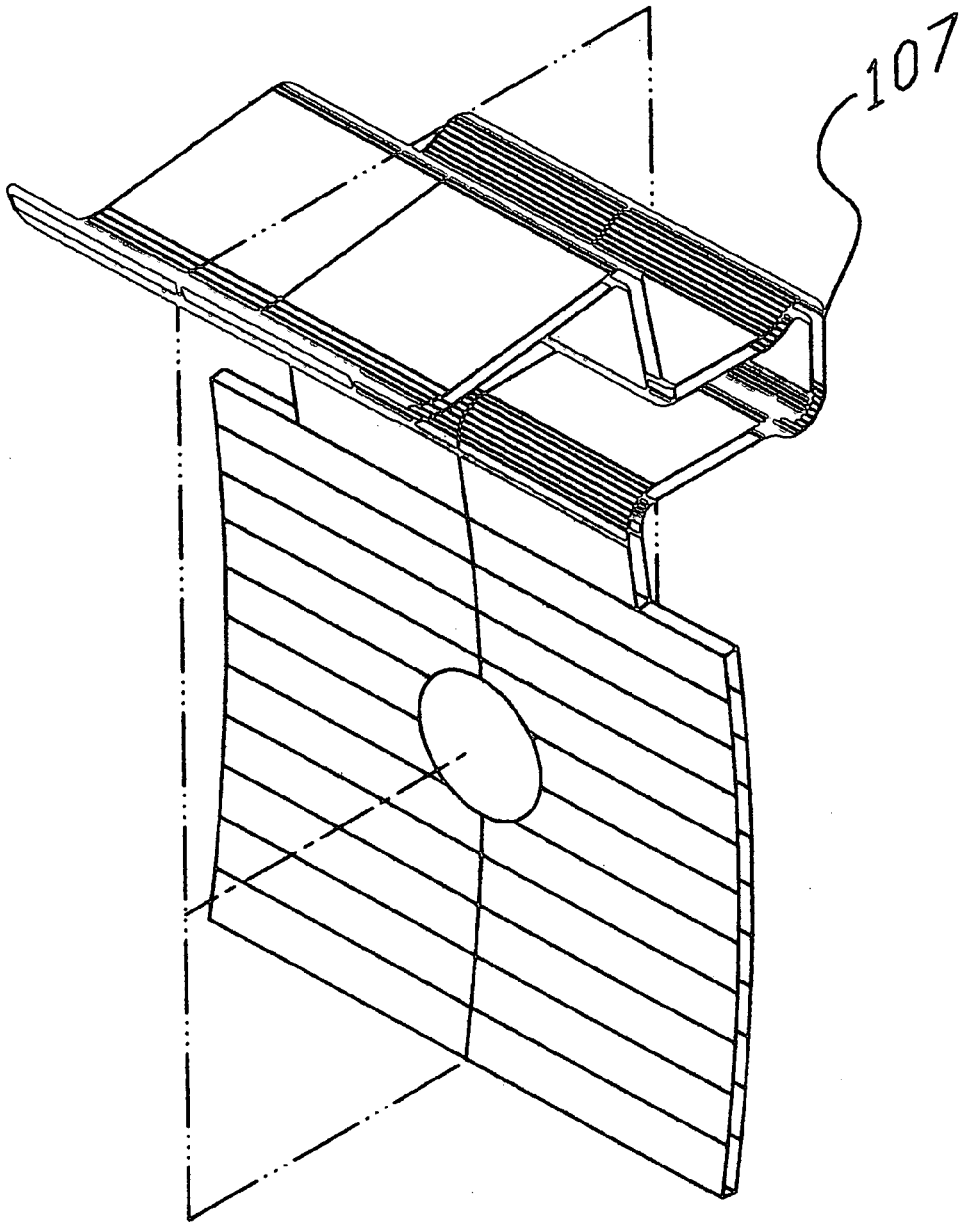
Figure 24:
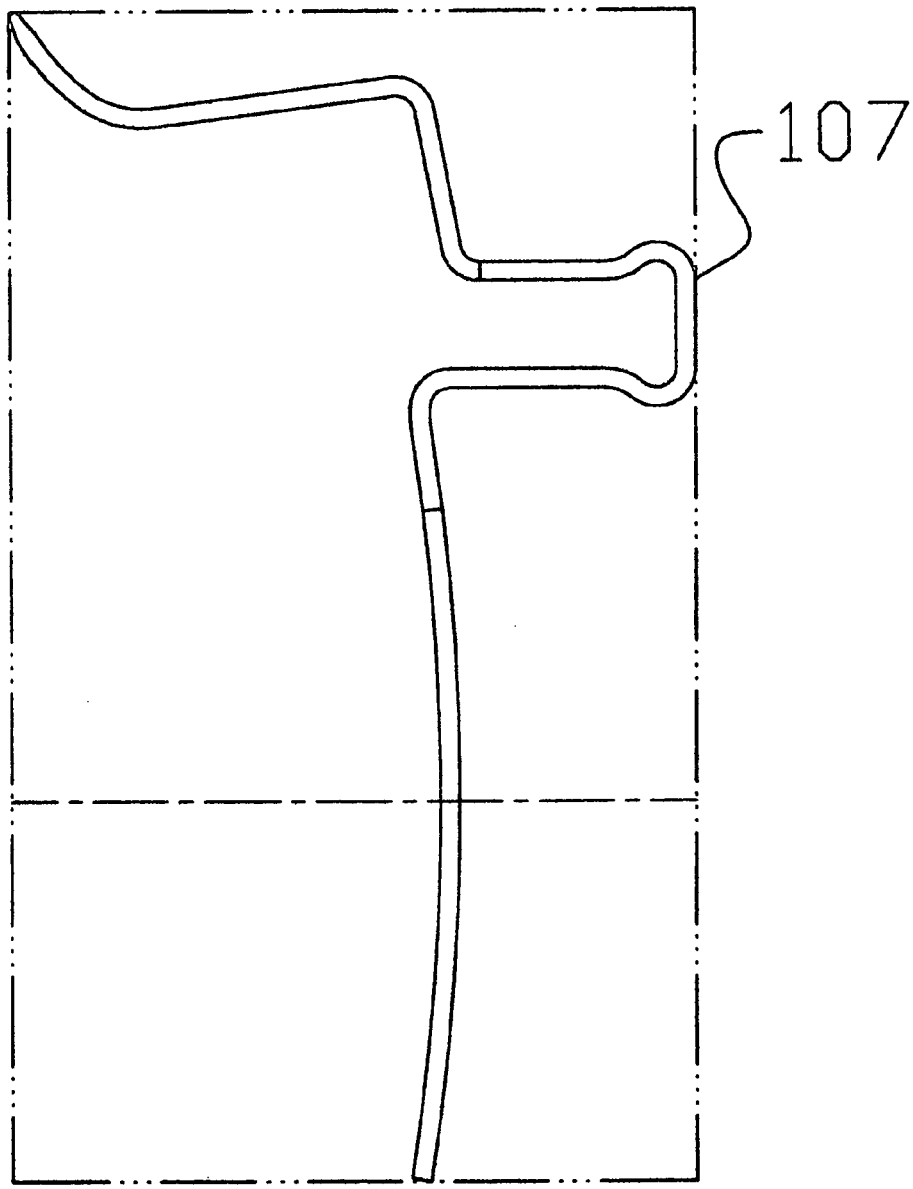
Figure 25:
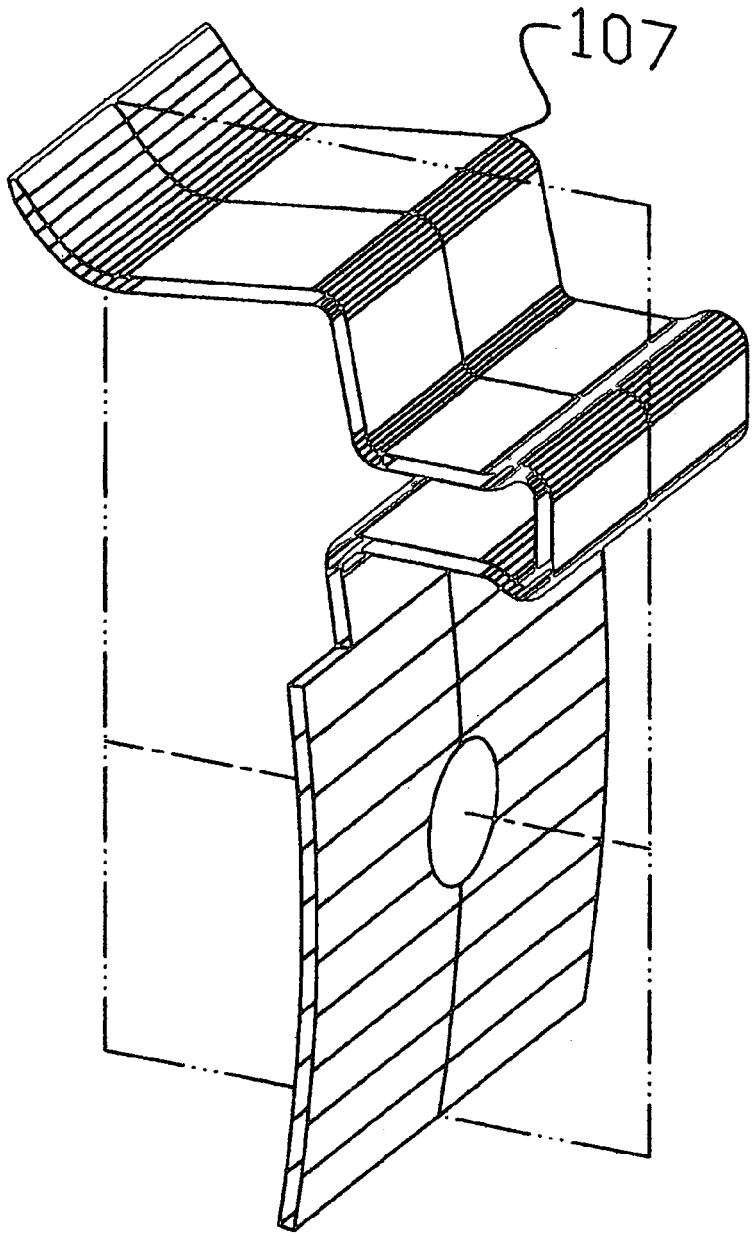
Figure 26:
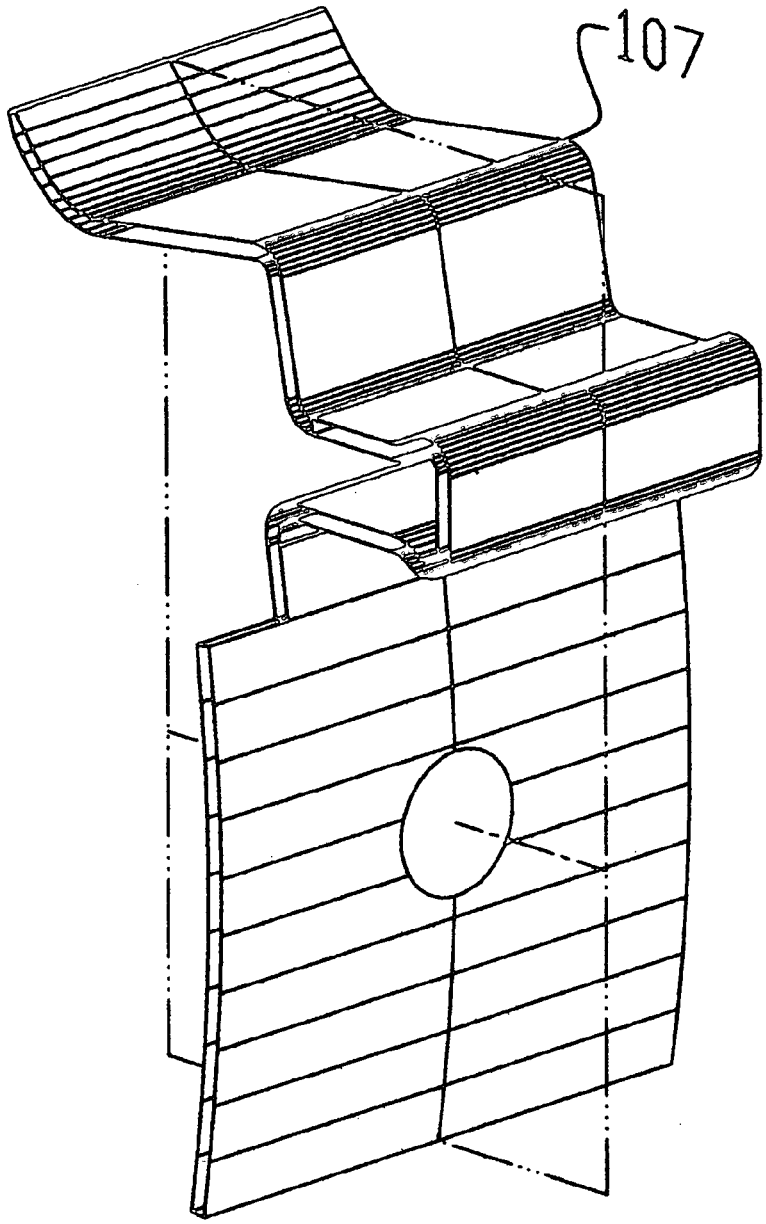
Figure 27:
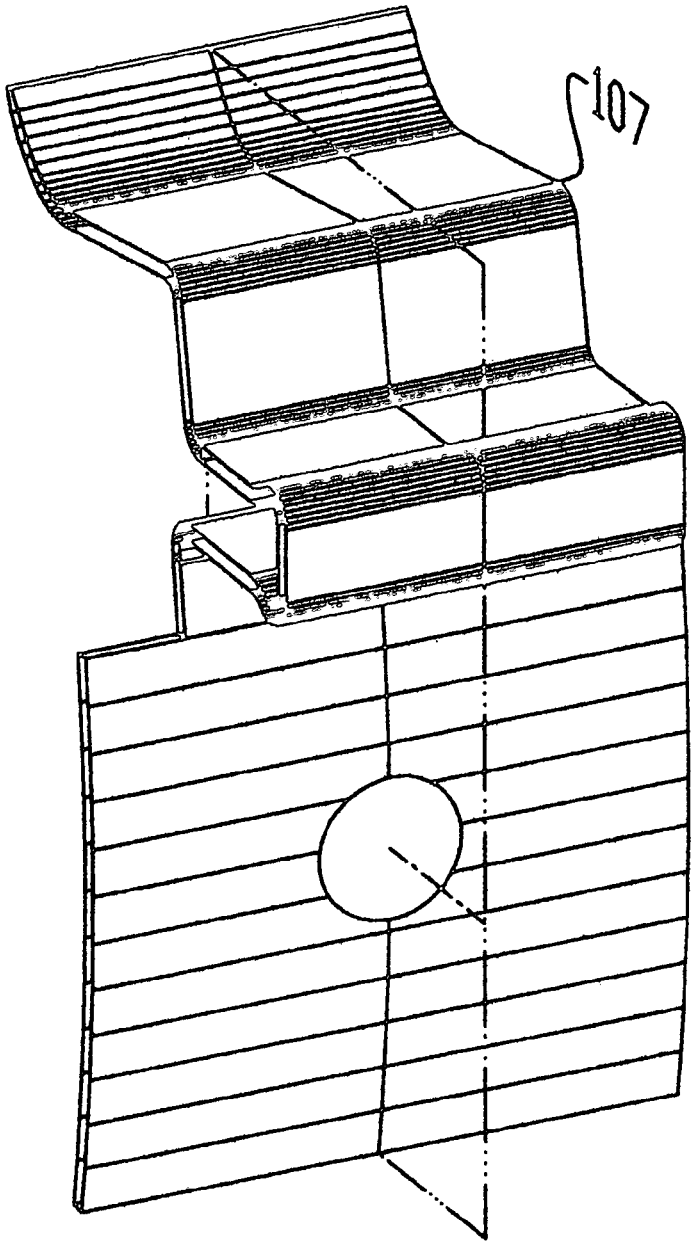

FIGS. 21 and 22 show a 7th contact spring 107. Again, this can work either in conjunction with the existing socket middle contact element 31, or it can replace it.

Notes Re Embodiments #3 through 7.

In all the embodiments #3 through 7, the spring is on the right side or outside face 118 of the main body 111 of socket middle contact element 31. The new spring can be a new separate additional one, or it can be an integral part of the existing main body 111 of socket middle contact element 31, if it is possible to do so. Please see FIGS. 9 and 13 for terminology and for the Ref #s.

I am calling this kind of new contact springs the Group "B" springs.

With group B springs, I am proposing to make a change in the base 131 of the socket, which is the insulating body, which carries the springs and other components shown in the figures. I propose to increase the width of the slot 133 in FIG. 9, which holds the existing main body 111 of socket middle contact element 31 and the switch middle wiper 45, so that the new spring(s) would fit in the same, though enlarged slot 135 in FIG. 13. This can be seen in FIGS. 13 through 22.

Notes Re All the Above Embodiments:

As I said at the beginning of this section, we can have at least two different arrangements for the new contact springs. The "In-Line" arrangement or the "Offset" arrangement.

If we look at the drawings closely, we will notice that the new contact springs are drawn on top of the socket middle contact element 31, which may give the impression that there would be some kind of interference between the two. The answer is two-fold.

If the new springs are "Offset", then there is no interference. The drawing is simply showing them together, but in reality they are located at two different "radial" position with respect to each other. See FIG. 53.

But it is possible that we might decide to place them in the same radial location, i.e. using the "In-Line" arrangement, as in FIG. 52.

I will show next, how to handle both cases.

OFFSET Arrangement

FIGS. 23 through 27 show the new contact spring #7 (Ref #107), which was shown in FIGS. 21 and 22. The figures show the spring, looking at it from various viewpoints. I have done this, to help the reader better visualize the shape of the spring.

This would be the shape of the spring, if it is located in an "OFFSET" arrangement, as in FIG. 53, and there would be no interference between it and any of the other existing contact elements of the socket.

However, if we want to "co-locate" the new spring together with the socket middle contact element 31, as in FIG. 52, or more accurately, with the "STOP" portion 112 of the socket middle contact element 31, i.e. in an "IN-LINE" arrangement as in FIG. 52, then we would do something like in FIGS. 28 through 40.

Figure 28:
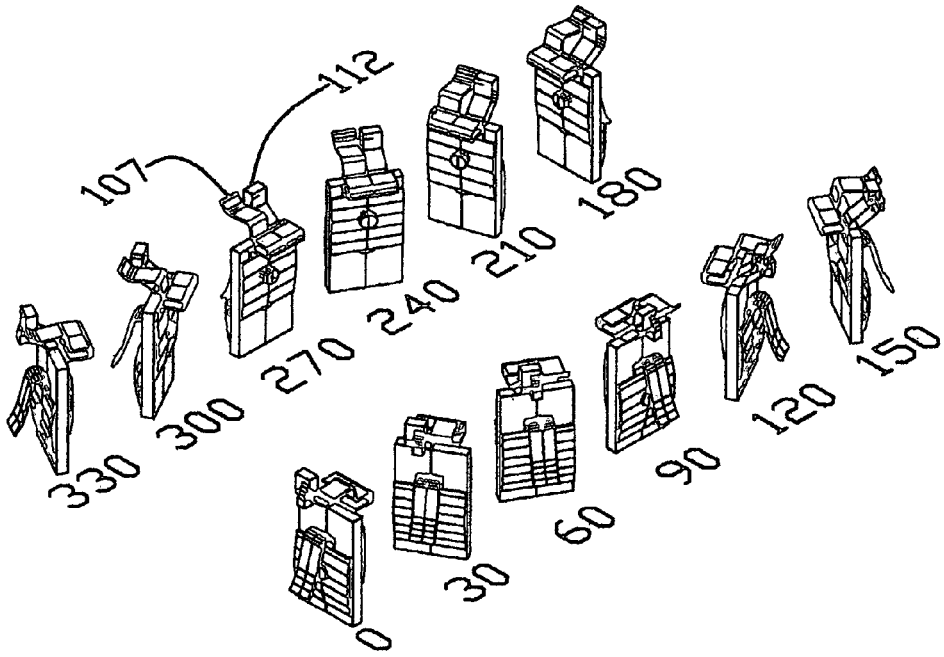
Figure 29:
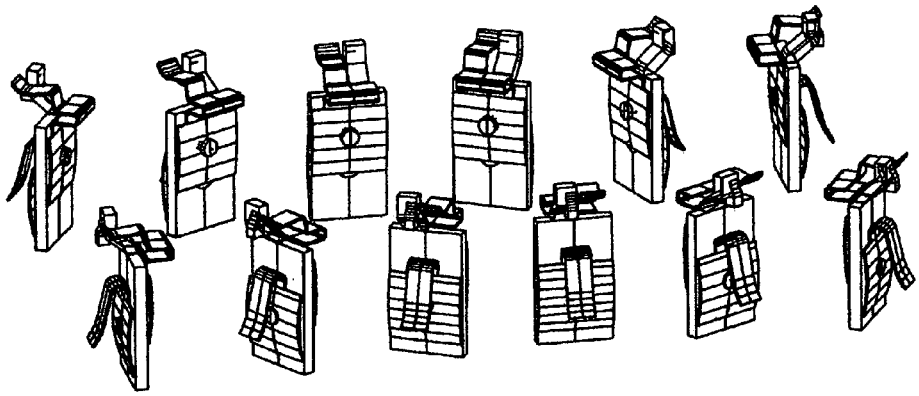
Figure 30:
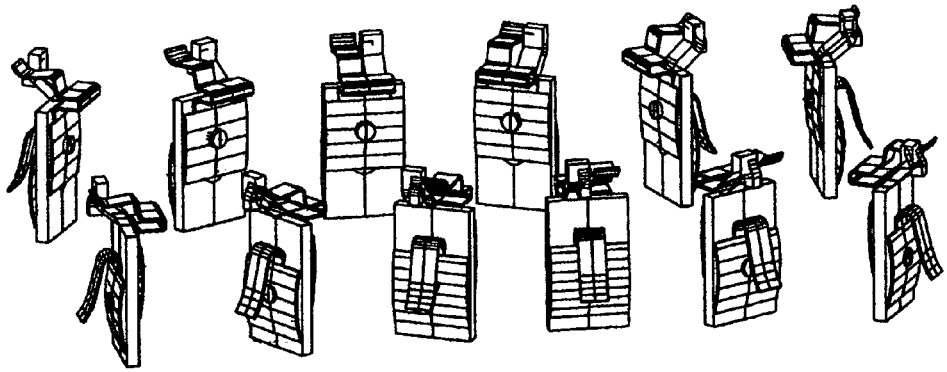
Figure 31:
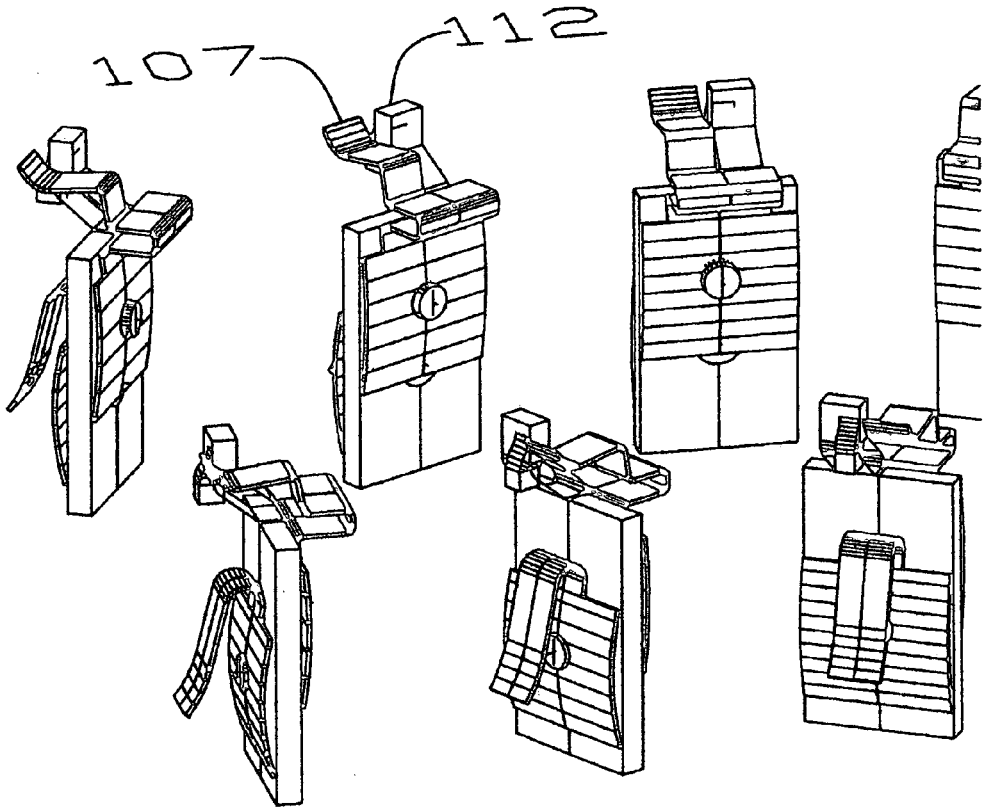

FIGS. 28 through 30 show the new contact spring, together with the existing switch middle wiper 45 and the socket middle contact element 31, viewed from various angles and viewpoints. FIG. 28 shows the viewing angles, i.e. 0°, 30°, 60°, . . . up to 330°, to have a total of 12 views. FIG. 31 shows an enlarged view of some of the figures in FIG. 29. And FIGS. 32 through 40 show the same set of springs, but again enlarged even more, to be able to discern as many of the details as possible.

I have given Ref #s to the particular portions of the socket middle contact element 31, and shown them in FIG. 21. They are:

Ref #31 is the whole middle contact element of the socket, including all the following portions.

Ref #111 is the main body of socket middle contact element 31

Ref #112 is the top tip, which touches the middle contact ring 3 of the bulb Ref #113 is the "boss", which accepts the switch middle wiper 45. It looks that it is "coined" out of the main body 111.

Ref #114 is the coined recess behind the boss 113.

Ref #115 is the new boss, which will accept the new proposed springs, as per this invention. It, too, could be coined, like the boss 113.

Ref #116 is the new coined recess behind the new boss 115.

Ref #117 is the left hand side face of socket middle contact element 31, or the "inside" face.

Ref #118 is the right hand side face of socket middle contact element 31, or the "outside" face.

Figure 32:
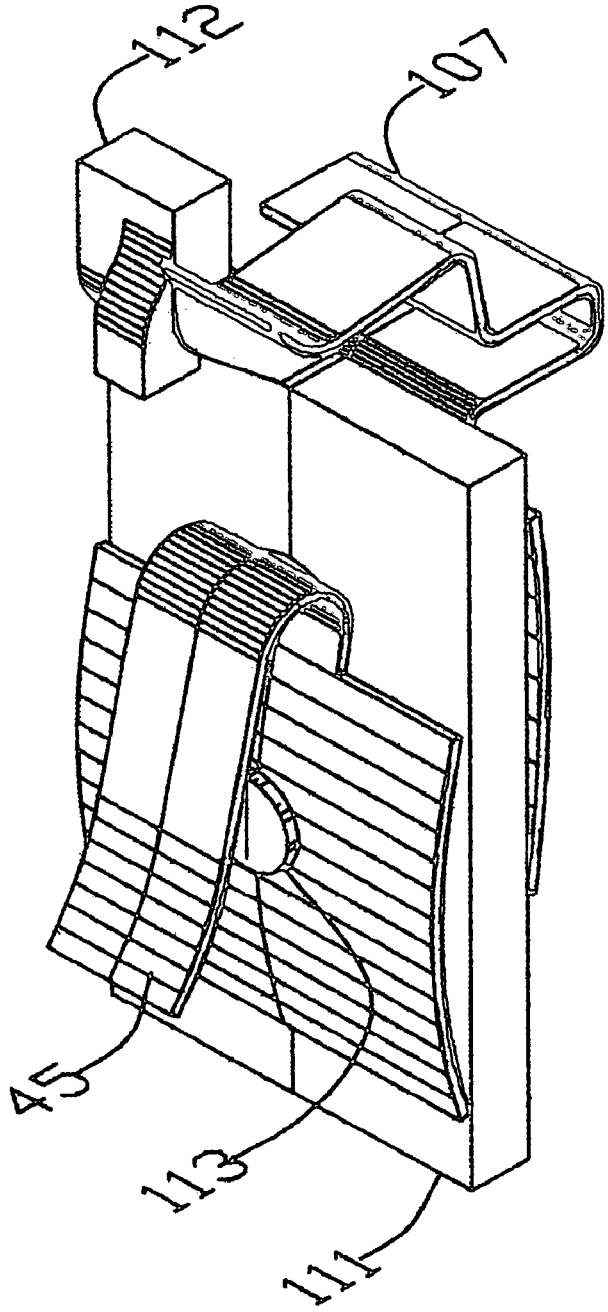
Figure 33:
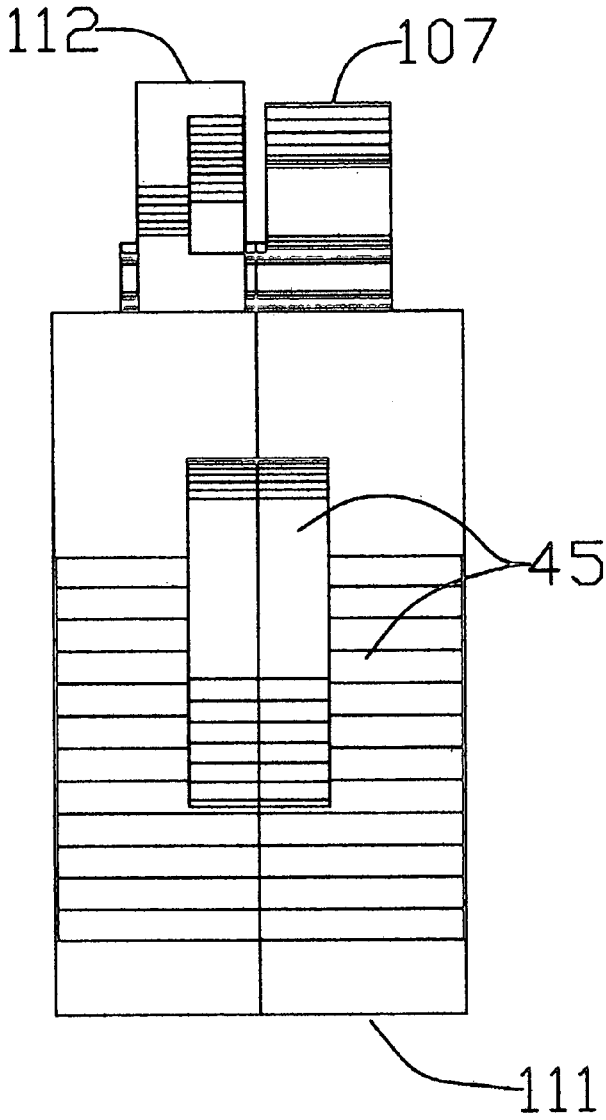
Figure 34:
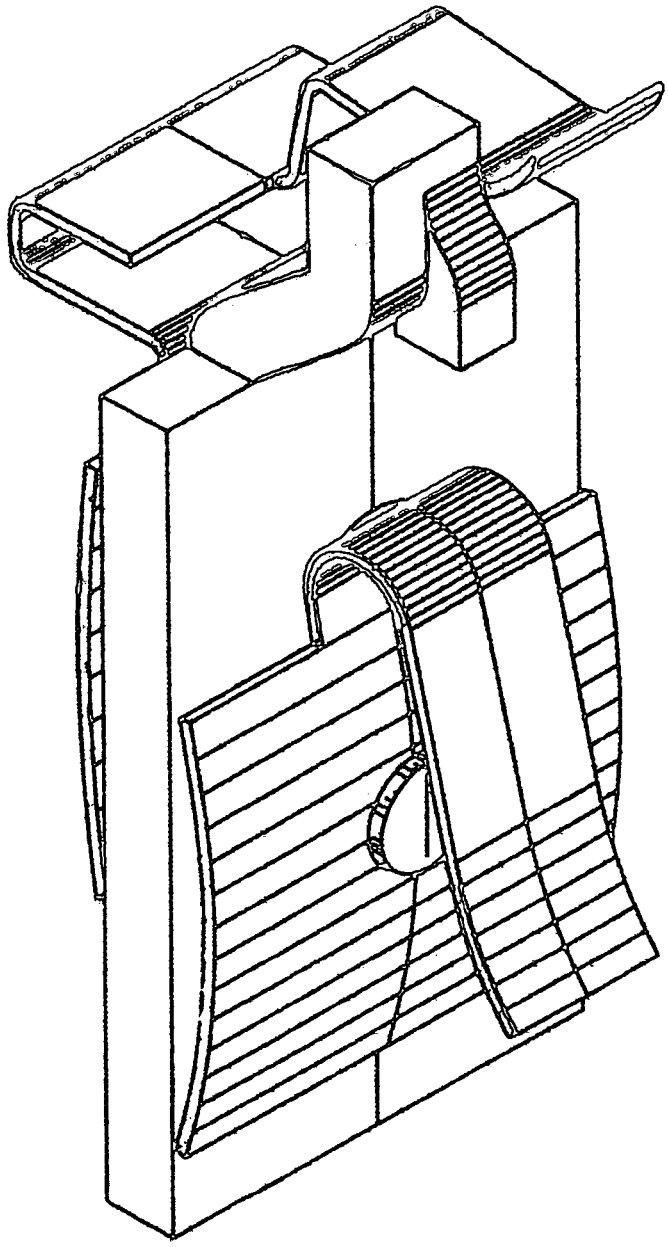
Figure 35:
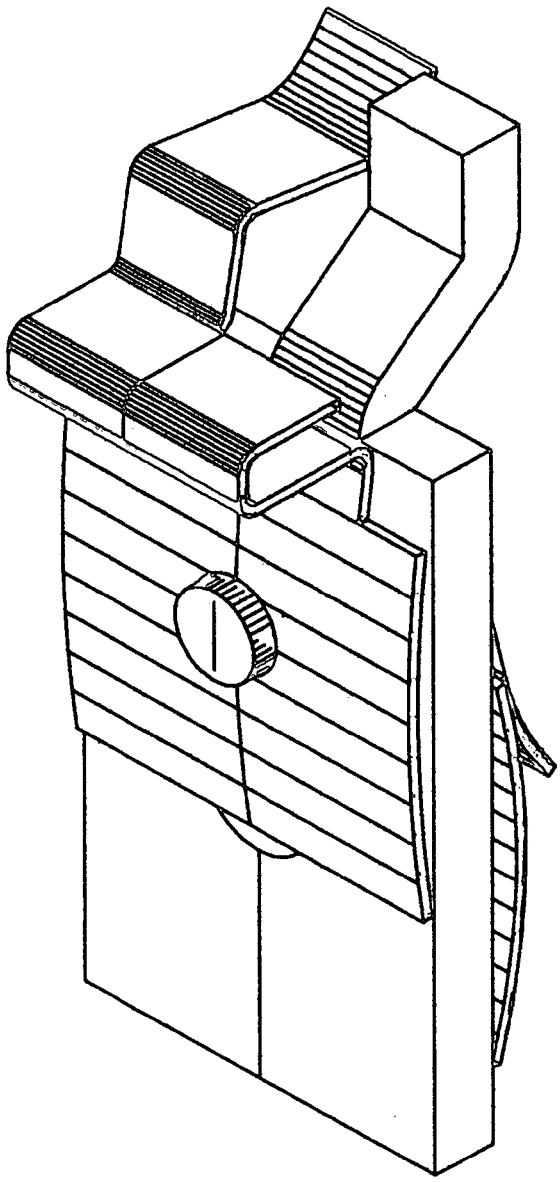
Figure 36:
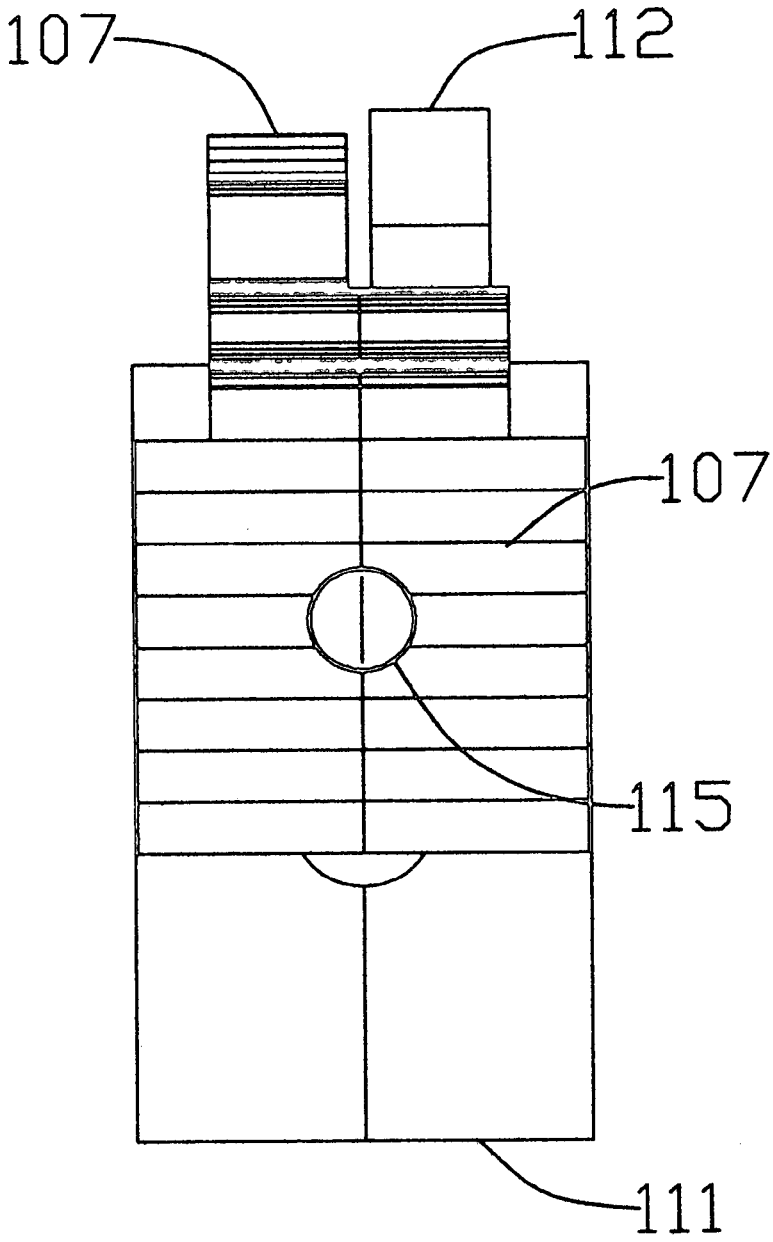
Figure 37:
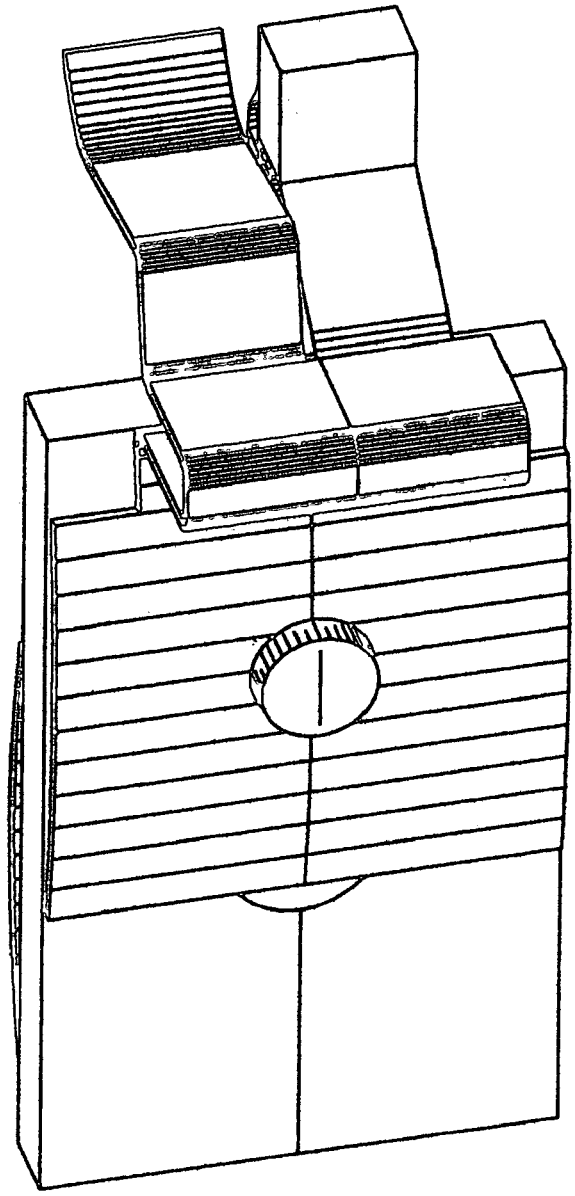
Figure 38:
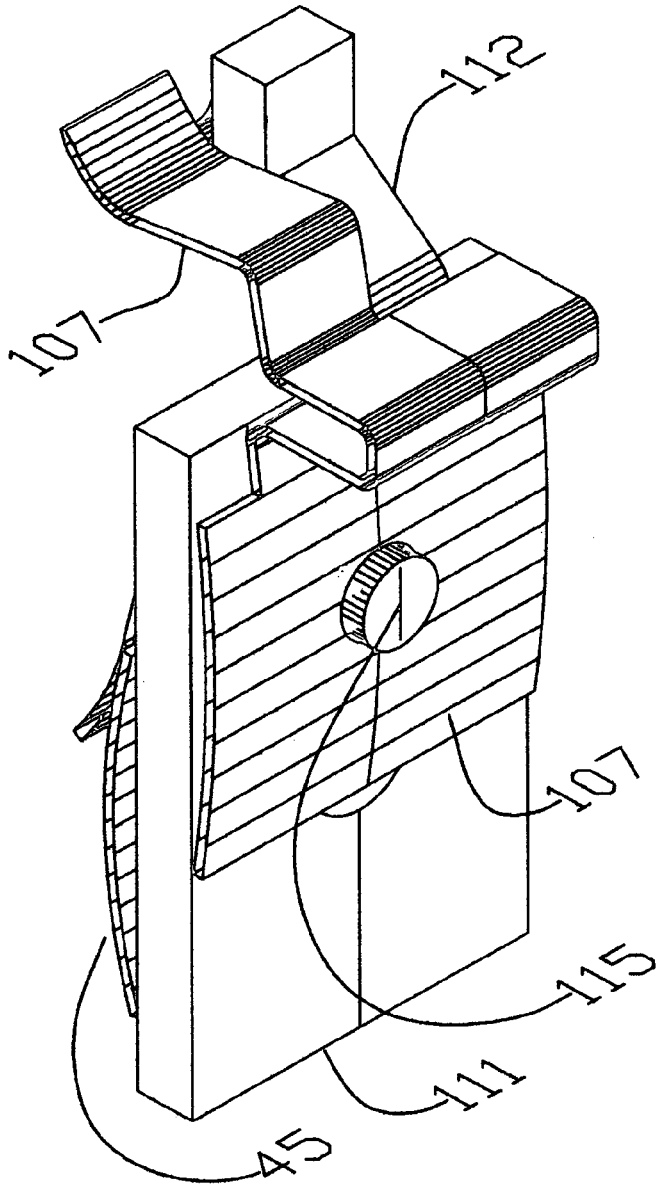
Figure 39:
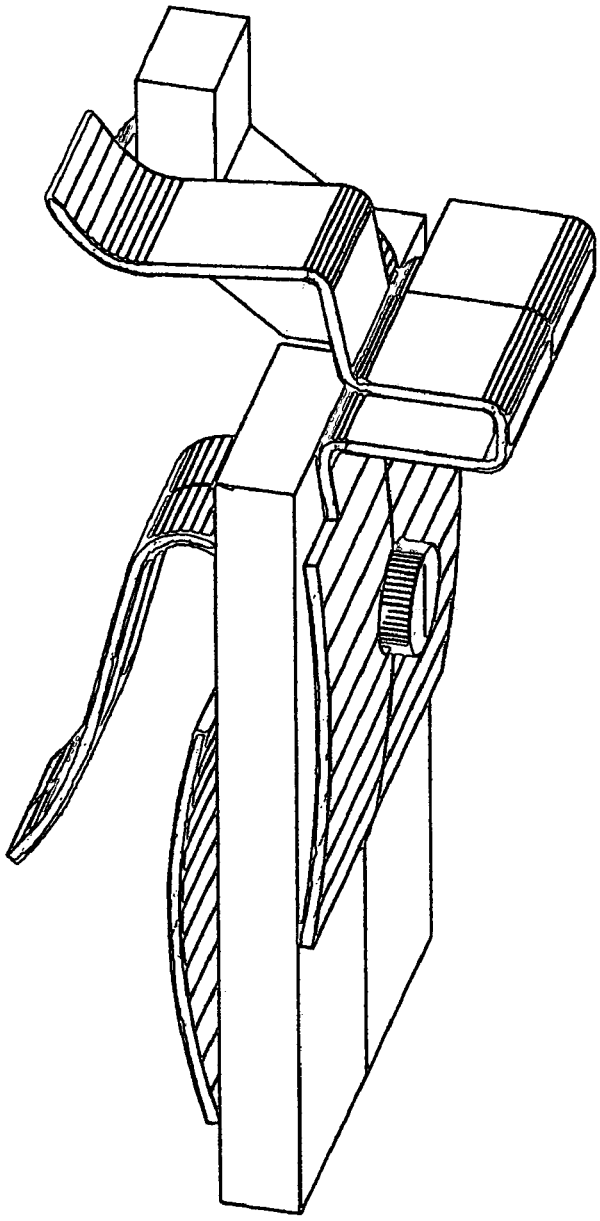
Figure 40:
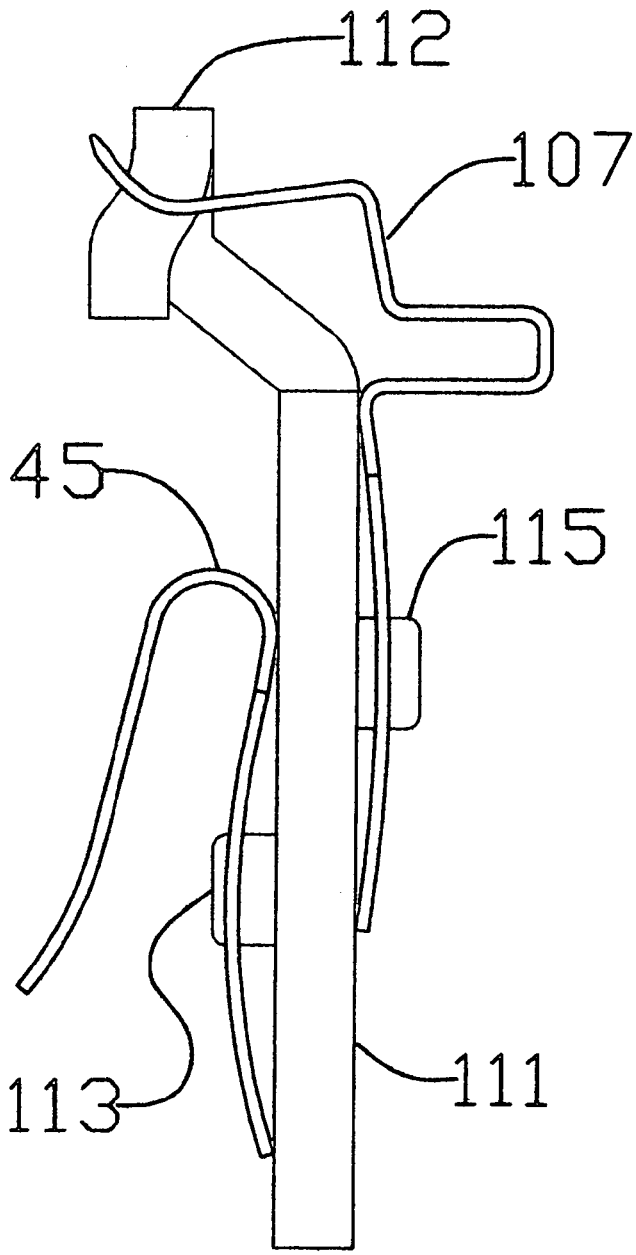
Figure 41:
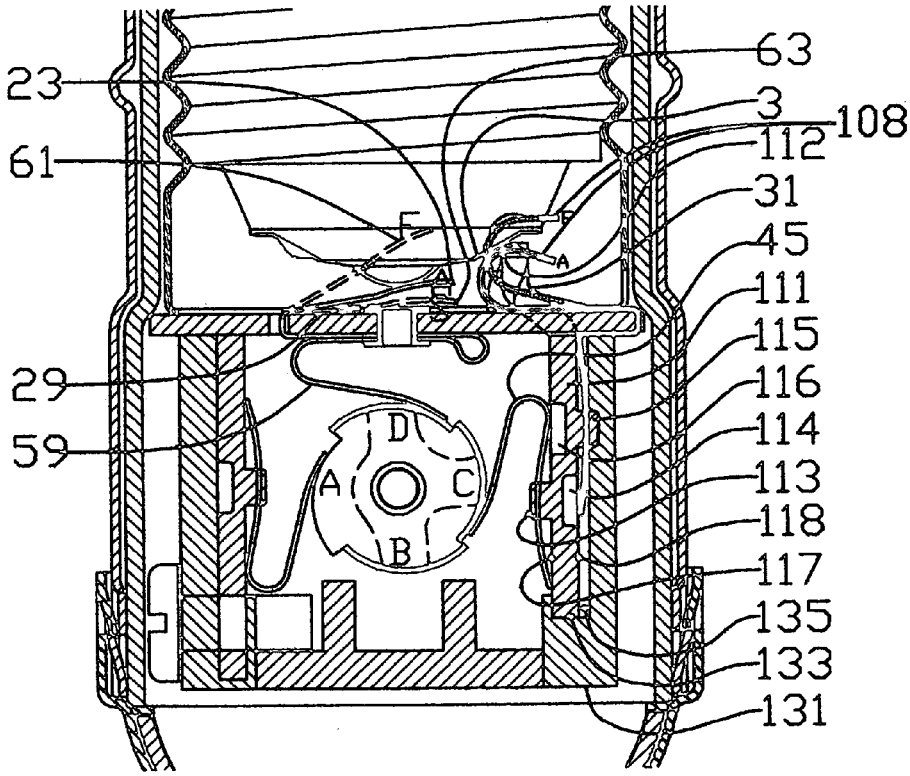
Figure 42:
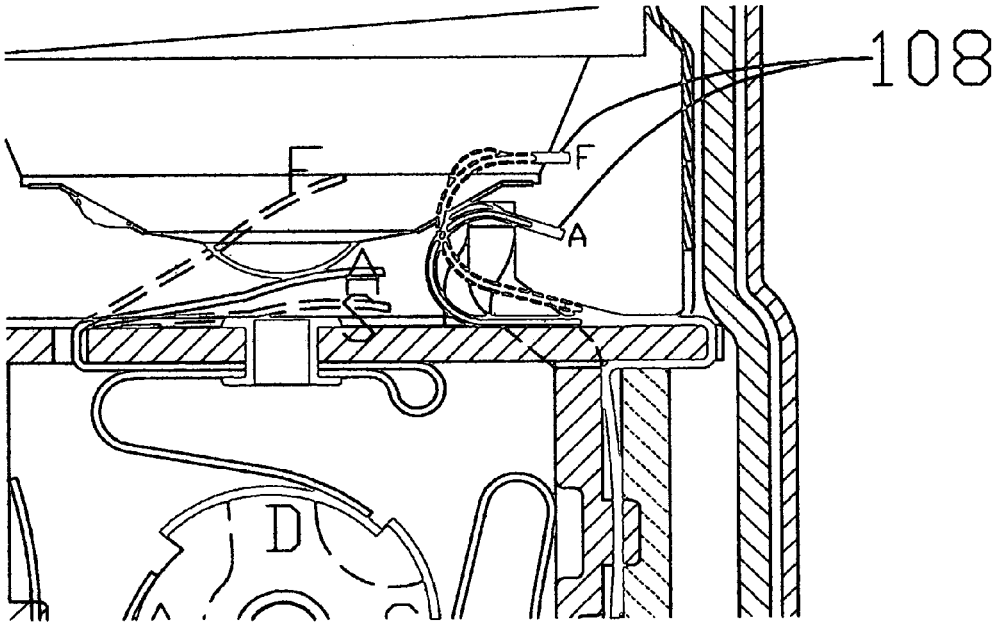
Figure 43:
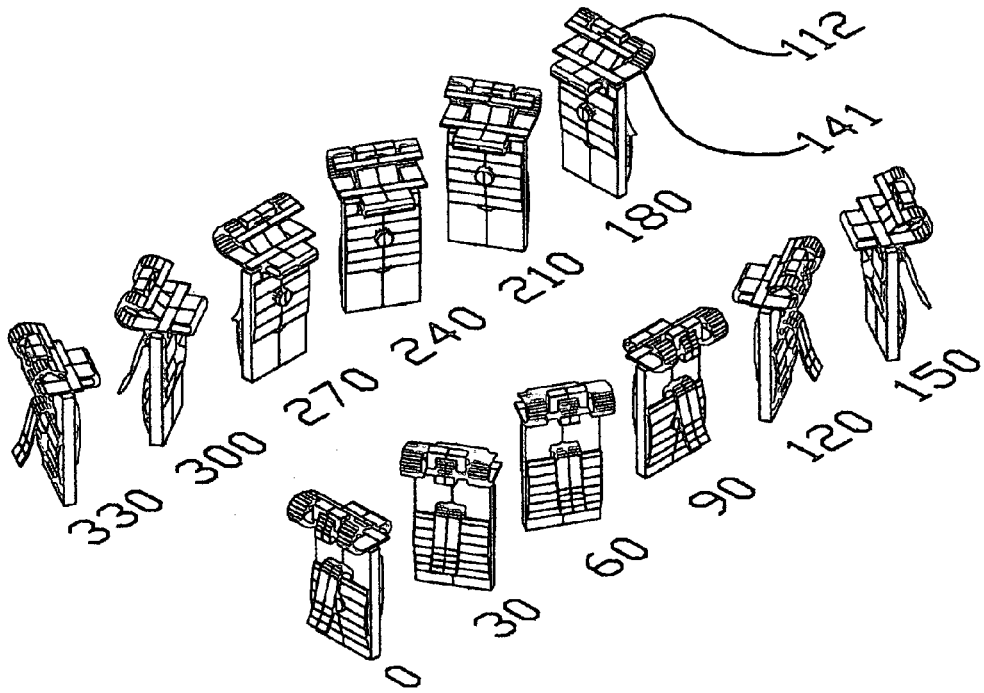
Figure 44:
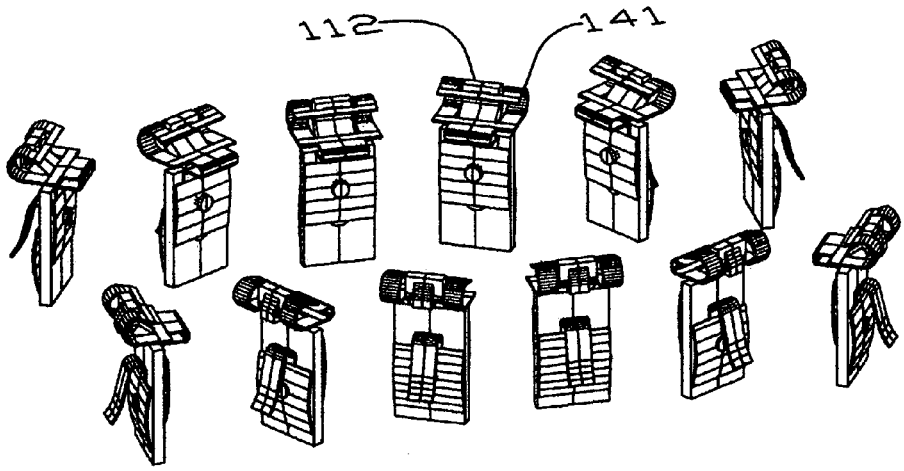
Figure 45:
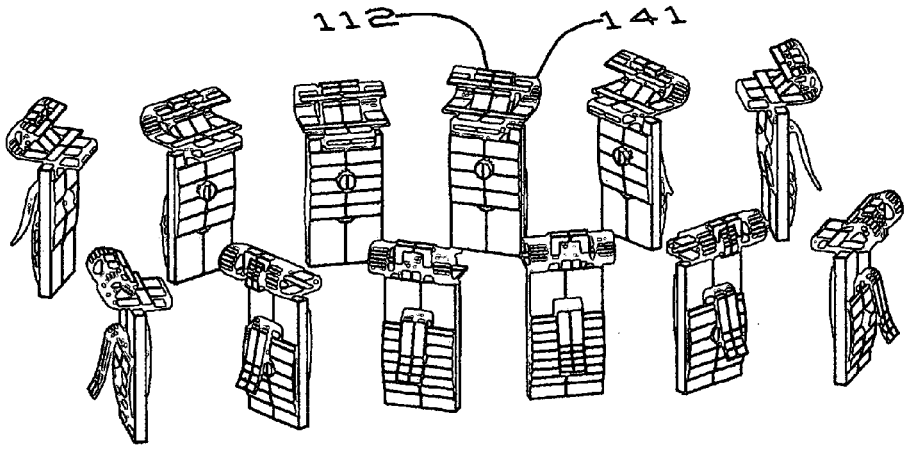
Figure 46:
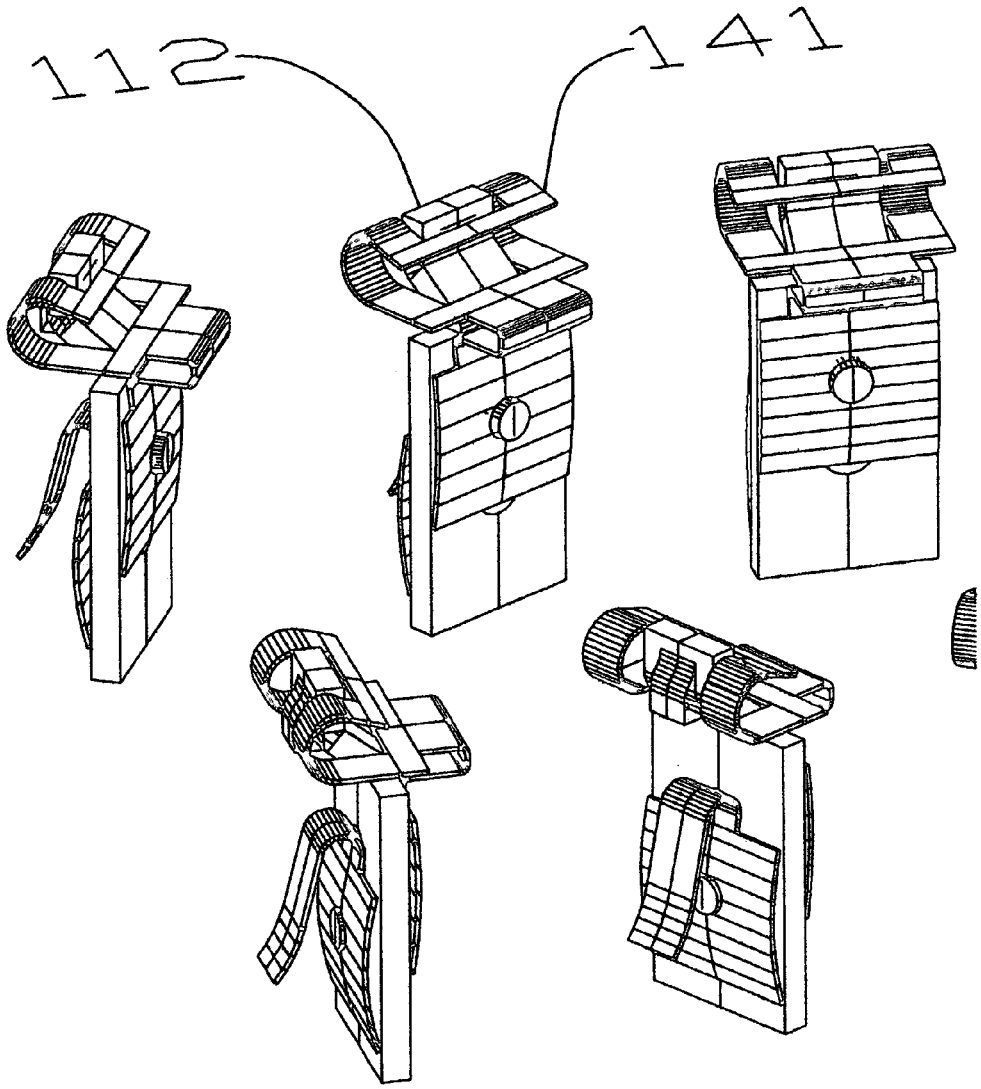

In FIGS. 32, 38 and 40, I have used the above Ref #s to clarify the views, as much as possible.

The key point in all these figures is to show that the old/existing elements have been slightly changed to adapt to the new situation. And the new spring is shaped to be able to "co-habitate" with the modified old elements.

Socket/Spring Embodiment #8

FIGS. 41 through 46 show an 8th contact spring 108. Again, this can work either in conjunction with the existing socket middle contact element 31, or it can replace it.

The main new feature here is the double pronged shape of the top portion 141 of the new spring. Here, the new spring "straddles" the "stop" 112 of socket middle contact element 31, but without touching it or rubbing against it. The main purpose of this feature is to protect the new spring and to prevent it from getting distorted when the bulb is threaded in or out of the socket.

Socket/Spring Embodiment #9

Picture 4 shows two sockets. The socket 91 on the LHS (left hand side) shows a conventional present state of the art socket. The socket 93 on the RHS (right hand side) shows an embodiment of the present invention.

We can see in the conventional socket 91 the parts that were described earlier, for example, the socket center contact spring 23, the rigid socket middle contact element/stop 31 and the socket threaded shell 27. The socket 93 on the RHS of the picture shows the same components as the conventional socket 91 on the LHS. However, we can also see in it the new component that was added. It is the new contact spring 95, which sits near the rigid socket middle contact element 31.

Picture 5 shows a close-up view of the same improved socket 93, which was shown on the RHS of picture 4. You can also see that the socket threaded shell 27 has also been modified slightly. Some metal has been removed from the area 97, to ensure that the new contact spring 95 does not touch any part of the socket threaded shell 27, so as to avoid any electrical connections between the new contact spring 95 and the socket threaded shell 27. Compare the area 97 with its corresponding area 99 in the conventional socket 91 in picture 4.

I would like to call this my SOCKET/SPRING EMBODIMENT #9.

The spring 95 is similar to all the other new springs proposed in the previous embodiments #1 through 8, from the point of view that it can sit near the socket middle contact element 31, and actually can co-locate with it. We can do one of at least two things. One is to enlarge the slot 133 (FIG. 9) to look like the enlarged slot 135 in FIG. 13, and then place the new spring 95 adjacent to the socket middle contact element 31. Or two, we can shave off some material from main body 111 of socket middle contact element 31, enough to equal at least the thickness of the new spring 95 and then fit both the main body 111 and the new spring 95 in the same existing slot 133, without modifying it. I chose the second alternative when I built my prototype shown in pictures 4 and 5.

Picture 6 shows two enlarged views of the new spring 95. I simply placed the spring on the platen of a scanner and scanned its picture into the computer. The view on the LHS is the spring laying flat on the platen of the scanner. The view on the LHS is an end view of the spring. I place the spring between two rubber erasers to hold it upright on its edge and then scanned the image.

Picture 7 shows the various components that go into a 3-way socket, plus the additional parts, 95 and 96, that I have used to build my prototype shown in Pictures 4 and 5. The parts are usually held together by the rivets 98. When I disassemble the socket, I had to destroy these rivets 98, and I used the "screws and nuts" 96 shown in the picture. Then I filed the main body 111 of the socket middle contact element 31 by about 0.010", which is the thickness of the new spring 95. Then I place both the new spring 95 and the socket middle contact element 31 in the slot 133 of the socket base 131, and reassembled the socket as seen in pictures 4 and 5.

Review and Collection of Preferred Embodiments of Inventions Related to Sockets I would like to summarize the main basic concepts that represent the inventions related to sockets as follows:

#S1. A socket with the middle contact is a spring.

A socket for use with 3-way electrical light bulbs, hereinafter referred to as bulb, where said socket is comprising a center contact spring, a middle contact element and a threaded shell, which is adapted to accept said bulb, and where said bulb comprises a center contact point, a middle contact ring and a threaded base, which is adapted to fit inside said socket threaded shell, and where said bulb comprises also a connection means that connects said middle contact ring with one of the filaments inside said bulb, wherein said middle contact element of said socket is flexible and can act as a spring.

#S2. A socket that has an additional member that would act as a stop

A socket, as in #1 above, wherein said socket has another element that acts as a stop to limit how far said bulb can be threaded inside said socket.

#S3. A socket that has the middle contact & the stop near or straddling each other.

A socket, as in #2 above, wherein said middle contact element of said socket and said stop of said socket are near each other or even straddling each other.

#S4. A socket that has the middle contact & the stop not near each other.

A socket, as in #2 above, wherein said middle contact element of said socket and said stop of said socket are not near each other.

#S5. A socket that has the shell with proper electrical clearance for the new spring.

A socket, as in #1 above, wherein said shell of said socket is shaped so as to provide enough clearance between it and said middle contact element so as not to have electrical contact between said shell and said contact.

#S6. A socket that has the shell with proper electrical clearance for both the new spring and the stop.

A socket, as in #2 above, wherein said shell of said socket is shaped so as to provide enough clearance between it and said middle contact element and said stop so as not to have electrical contact between said shell and said contact or between said shell and said stop.

Group Two: Inventions Related to Bulbs.

Notes

1. The inventions here spill over to Group Four, which are related to Inserts, Adapters and the like. Some of the parts that can be used for Group 2 can also be used for Group 4 and vice versa. I will point to that as I go along.

2. The five drawings in FIGS. 47 through 51, which I am using for both Groups 2 and 4, have a flaw. All these five drawings show the bulb at a higher position than it should be at if it is supposed to work properly. The more correct position is shown in FIGS. 66A, 66B, 67A and 67B. The flaw in FIGS. 47 through 51 is that, the socket middle contact spring 23 is shown as if it has not been compressed at all. In fact, it looks like as if the bulb middle contact point 1 has not even touched that socket middle contact spring 23. All this, while at the same time, the figures show that the flexible conductive doughnut 151 has already touched and is sitting on top of the socket middle contact element 31. That would not work. I have corrected the situation by doing two things.

a. In FIGS. 66A through 67B, I selected the dimensions, mainly the thicknesses, of the donuts so that I would make simultaneous contacts at both the socket middle contact element 31 and socket middle contact spring 23. More accurately, I would first touch and compress the socket middle contact spring 23 to the proper deflection position 66 before I touch socket middle contact element 31. At this proper deflection position 66, socket middle contact spring 23 would exert the proper amount of contact force against center contact point 1 of the bulb, so as to provide an acceptable electrical connection.

b. In order to accomplish this "dimensional" agreement, I had to lower the bulb further down than it was shown in FIGS. 47 through 51. In turn, to accomplish this, I deleted the part of the socket shell 27, which showed the thread. The reason is because I could not show both threads, that of the bulb and that of the shell, in the same configuration as in all the other drawings, and at the same time show the bulb at the height that was required. I could draw the bulb at the elevation of one thread pitch or at one pitch higher or one pitch lower. That would be either too high or too low. I needed to "turn" the bulb a portion of a full turn, e.g. a quarter of turn or two thirds of a turn for example to reach the desired height. That would have been a little more difficult to show on the drawing. So, to make it easy on myself, I simply did not show the thread of the socket shell. Please note that this effect of the location of the thread and the height of the bulb is very important and it is one of the reasons, that the solder spot 19 would sometimes hit the socket middle contact element 31 and at other times it would not. If we could control the starting point of the thread helix of the socket thread and that of the bulb thread, then we would be able to control the end resting position of the solder spot 19 and we would eliminate all of our headaches. This will be the basis of the inventions in Group 4.

PREFERRED EMBODIMENTS

BULB Embodiment #1—Changes to the Bulb Itself

The bulb could be manufactured from the beginning on by the manufacturer, such that there would be no irregularities in the shape of the solder/connecting spots 19, e.g. no ups and down and no sharp interruptions in elevation, no bumpiness and no level differences between the socket middle contact spring 23 and solder spot 19 outer surfaces. There are at least two conceivable ways to accomplish that goal.

Embodiments 1-a

One is to first create an indentation in the bulb middle contact ring 3, where the solder spot 19 is expected to be located. Then after the soldering operation is completed, and the solder spot has filled that indentation and probably has overflown the space, then the outer surface of the solder spot would be sanded or otherwise worked/machined, so that its outer surface would be smooth and flush with the surrounding surface of the bulb middle contact ring 3.

Embodiments 1-b

The second way is to keep the present situation as is, and then during the operation of creating the solder spot 19, the solder would be smoothened and rounded and tapered so as to gradually join the level of the adjacent surfaces of the bulb middle contact ring 3. If necessary, then some solder or appropriate material could be added to the contact ring 3, to create a smooth transition between its surface lever and the outer surface of the solder spot 19. This however, would probably make the contact ring slightly "out of round". It may not work with the rigid socket middle contact element 31, but it could work nicely with the "springy" contact elements that I am proposing in this present invention.

BULB Embodiment #2—Add-ons to the Bulb.

BULB DOUGHNUT #1—1-layer, Compressible (151)

Figure 47:
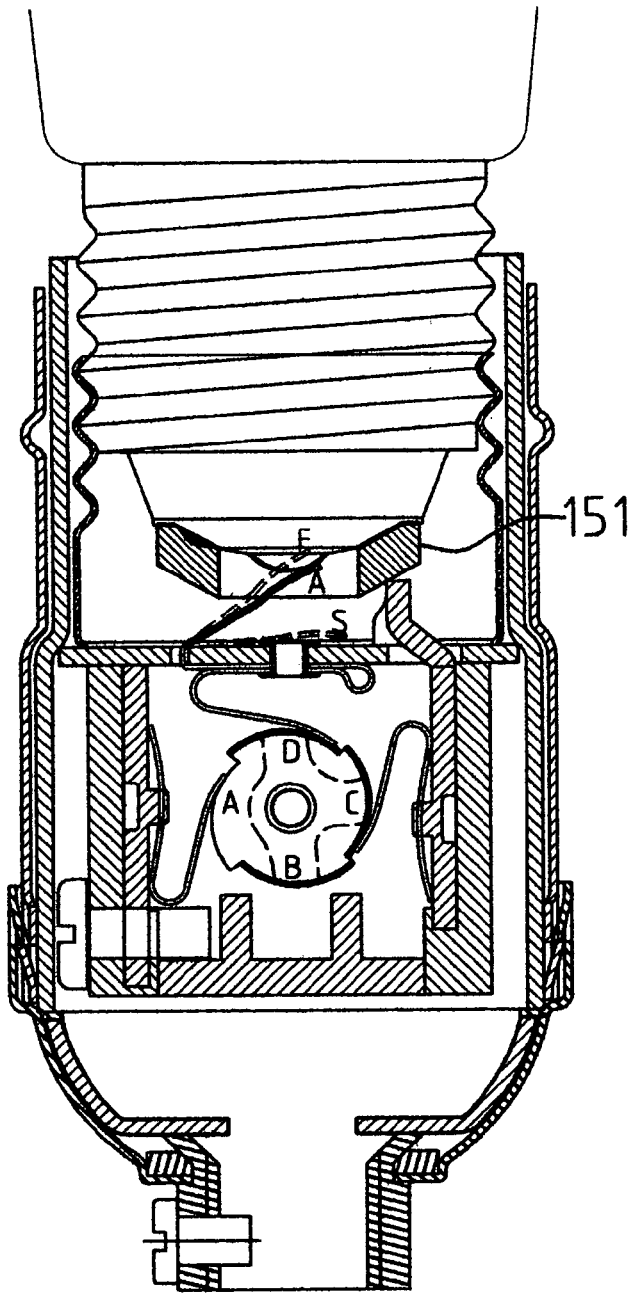

FIG. 47 shows a doughnut 151 that is applied to the bottom of the bulb, at the area of the bulb middle contact ring 3. This is not to scale. The thickness of the doughnut is shown exaggerated, just to highlight it. In reality it could be somewhere from a few thousands of an inch thick, all the way up to ⅛ of an inch thick. The proper thickness would depend on the chosen material, its flexibility, durability, compressibility, etc. Also the conductivity of the material is important.

Figure 48:
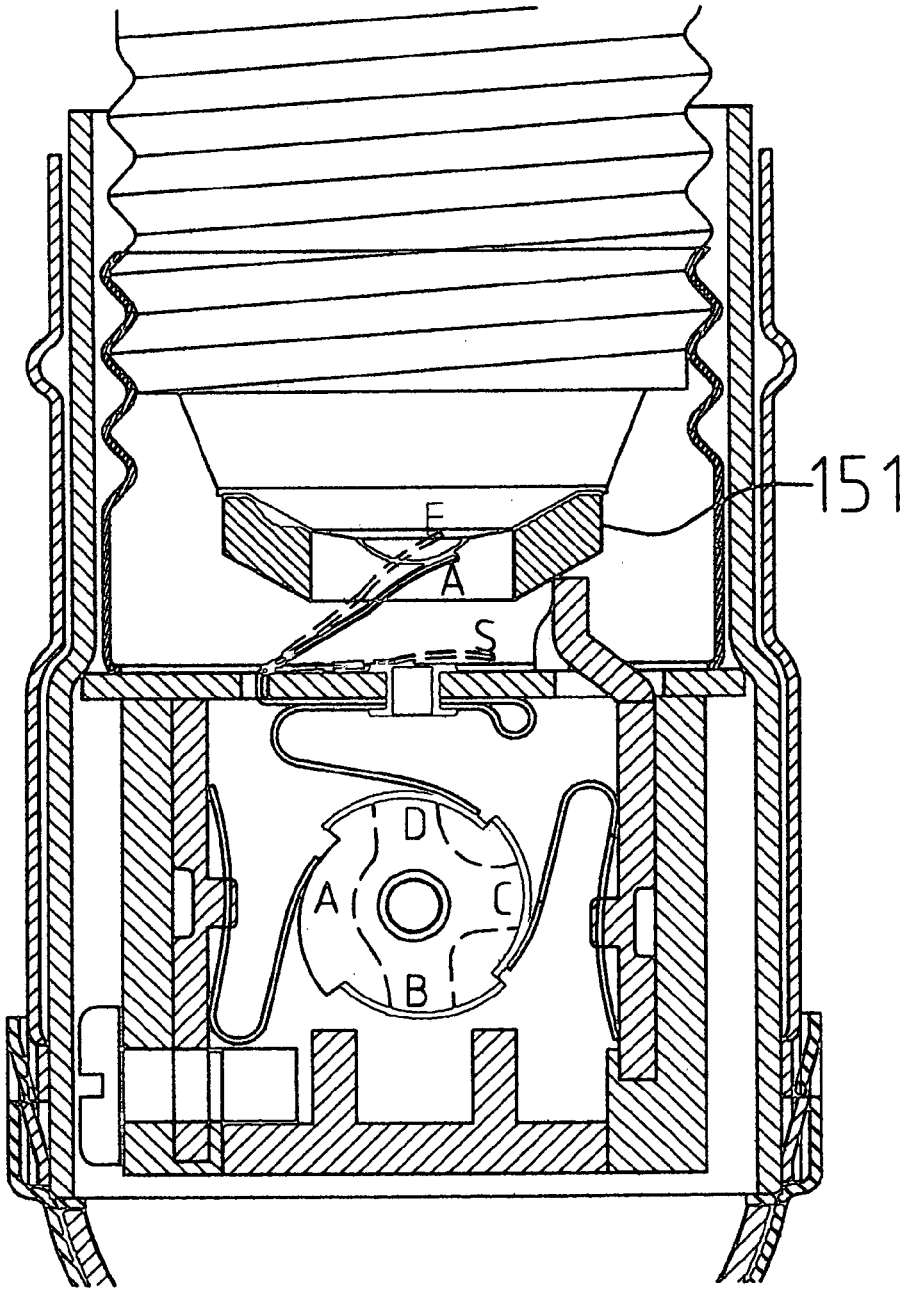
Figure 49:
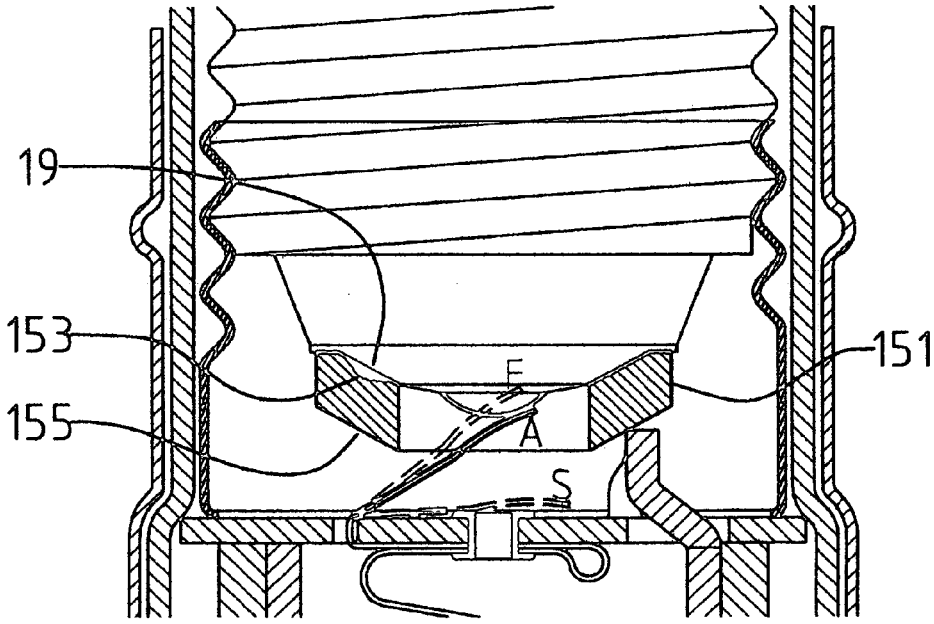

FIGS. 48 and 49 show the same thing, but in enlarged views.

Figure 54:
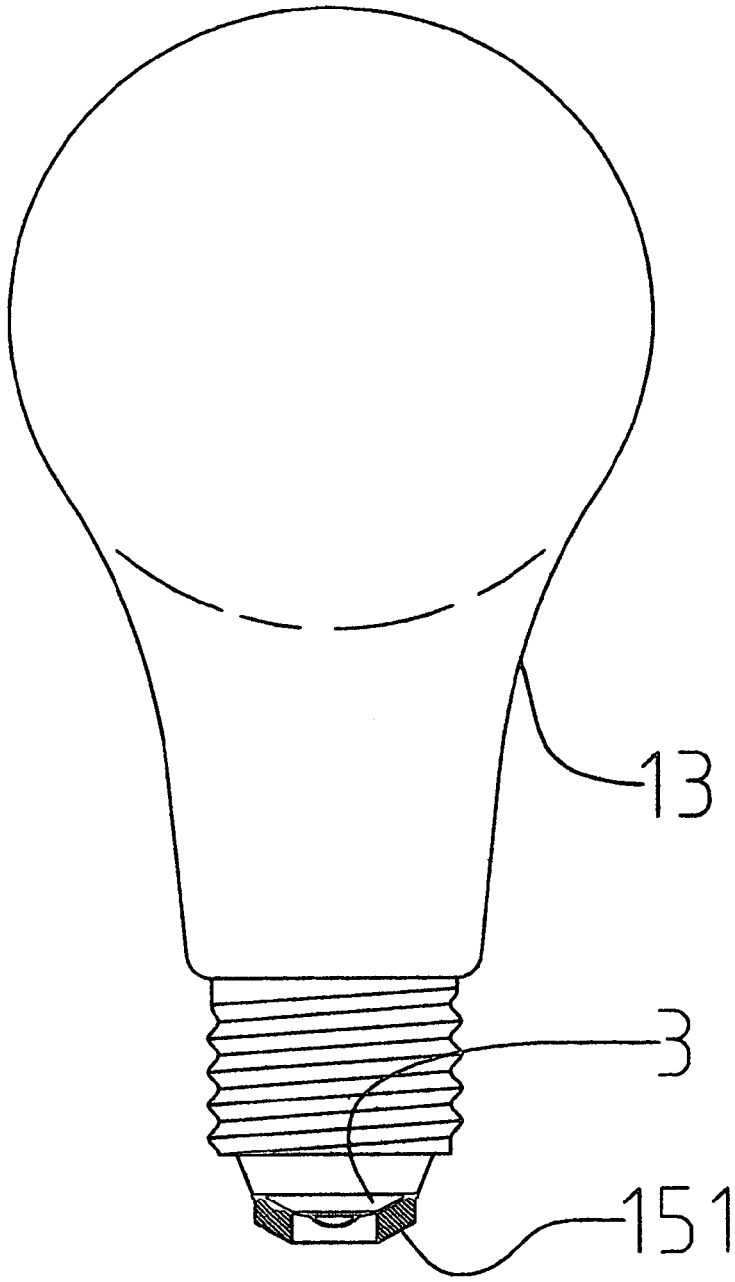
Figure 55:
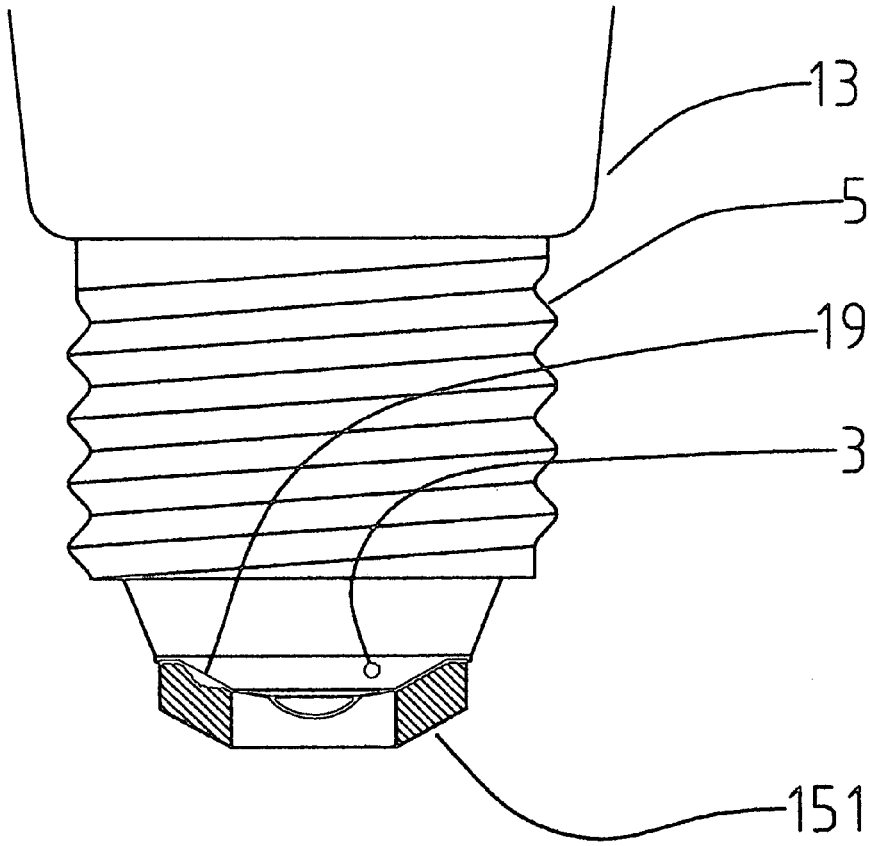

FIGS. 54 and 55 show the bulb with the donut, outside of the socket. Socket not shown.

Figure 56:
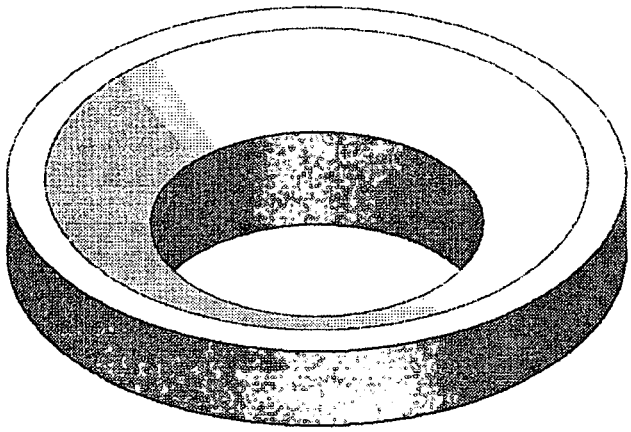
Figure 56:
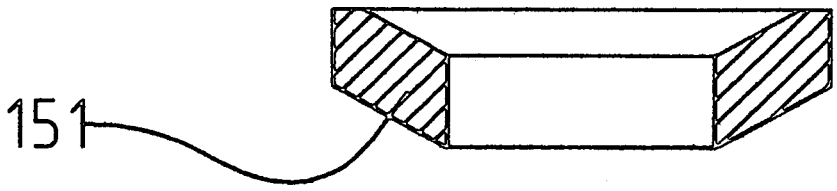

FIG. 56 shows the donut by itself, in top view, side view and in cross-section view.

Pictures 8 and 9 show isometric views of the donut, from different viewpoints.

The donut should be made of a material that is relatively compressible, so that the uneven surfaces of the solder spot 19 could dig into it, as shown at point 153 in FIG. 49, yet at the same time, the material should be firm enough and electrically conductive to make good electrical contact with solder spot 19. Examples of materials that could be used here are conductive polymers or conductive elastomers, or even something like a steel wool, but made of a good electrically conductive material like copper, brass or bronze. A material like the latter is being used to make electrical connectors. The lower surface 155 of the donut should be smooth and uniform and firm enough to make good contact with the socket middle contact element 31.

BULB DOUGHNUT #2—2-layers: 1. Compressible, 2. Hard (161)

Figure 57:
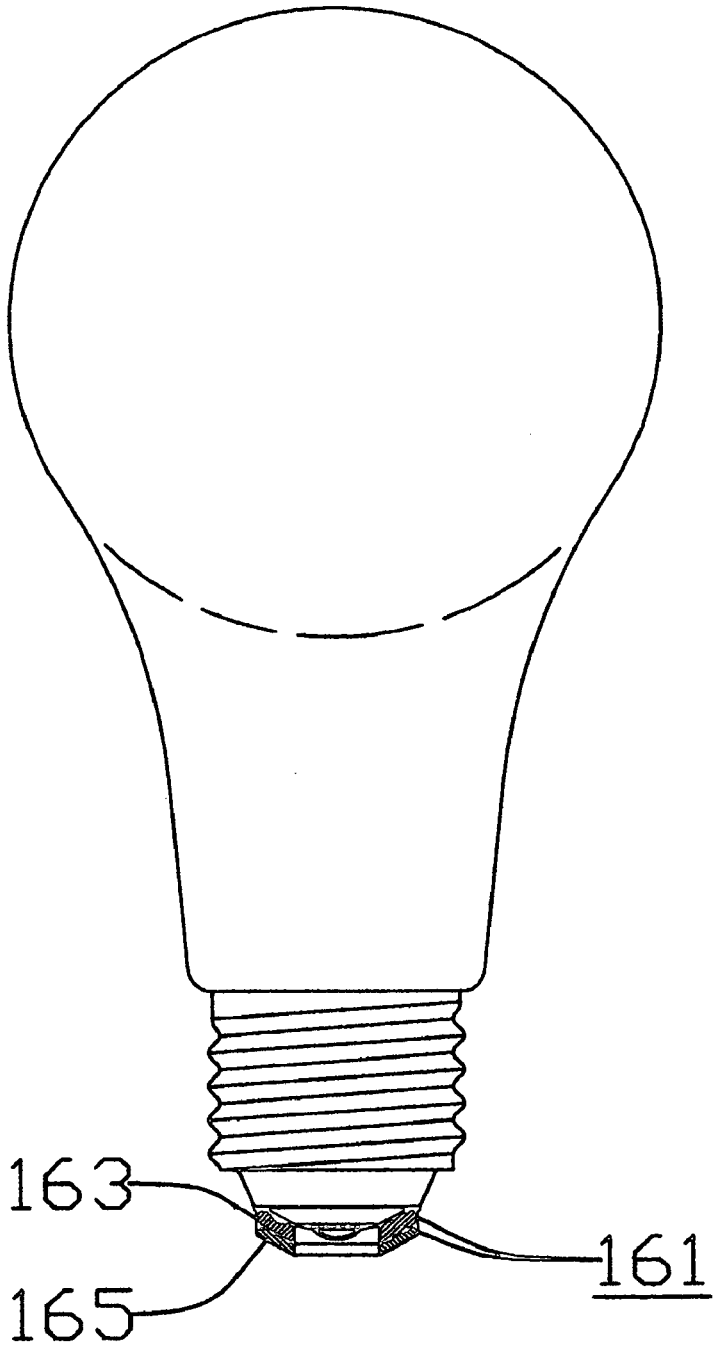
Figure 58:
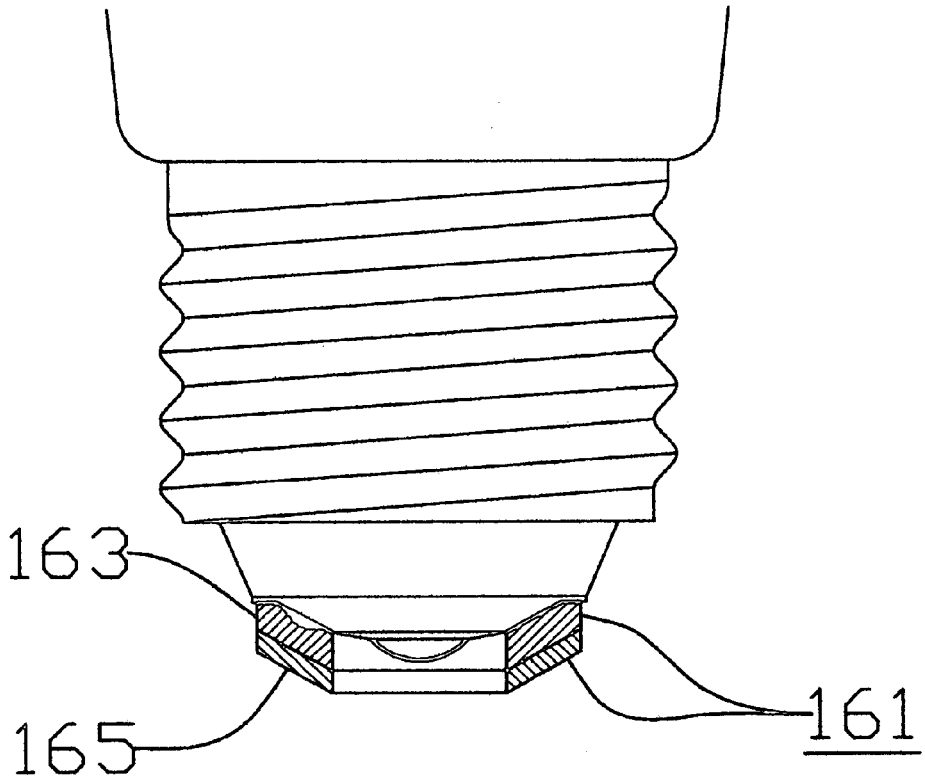

FIGS. 57 and 58 show a similar donut as donut #1 (Ref#151) except that it is made out of two layers. This was not included in the PPA, Ref1. I will refer to it as the 2-layer donut 161. The first layer 163 is made of a material similar to the one used for donut 151, i.e. compressible, conductive, etc., but the second layer 165 is made of a material that is harder, like for solid sheet of copper, brass or bronze, formed to the proper shape. The two layers would be properly joined or laminated to form a good electrical connection between them. Layer 163 is positioned towards the bulb, to absorb any irregularities at the bulb, e.g. the irregular solder/connection spots 19. Layer 165 is positioned towards the socket middle contact element 31. Layer 165 should be a comparatively harder material than the softer layer 163. This hard layer 165 would also have a smooth uniform surface. Thus when it sits on top of the socket middle contact element 31 and is rotated around, when the bulb is being threaded inside the socket, there would be no bumps or irregularities to disturb the interconnection between it and the socket middle contact element 31.

BULB DOUGHNUT #3—3-layers: 1. Compressible, 2. Hard, 3. Less Hard (167)

A third way to make such donuts is to add a third layer at the bottom of the second hard layer described in donut #2 above. The purpose of this third layer is for it to work better and to cooperate with the socket middle contact element 31. The socket middle contact element 31 would have an easier time to dig into this third layer and to make a "stable" connection, which I would call a "locked-in" connection, as I had explained elsewhere in these specifications. I did not feel that I needed to make a special drawing for this version. The reader can easily visualize it from my description here. But if the Examiner prefers, I would gladly provide a drawing for it. Although there is no drawing for this version, I will still give it a reference #. It will be the 3+layer donut 167.

BULB DOUGHNUT #4—Substitute.

The doughnut could be replaced by a "paint" or "putty" or the like, that would be applied directly to the bulb at the proper location, i.e. on the bulb middle contact ring 3. The paint could be "thick" enough to cover the uneven connection/solder spots 19 and to create a smooth surface at the area of the bulb middle contact ring 3.

BULB DOUGHNUT #4—With Insulation Ring, 1-layer (171)

Figure 50:
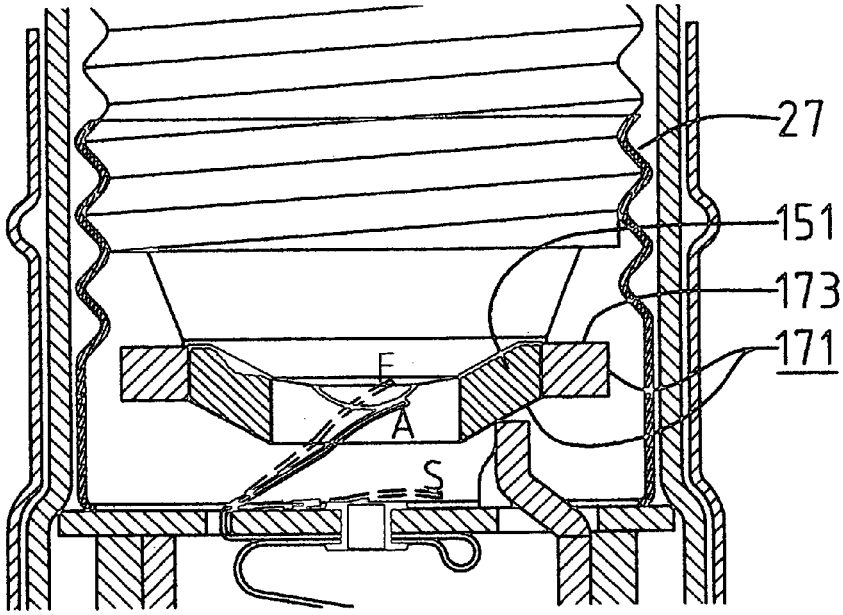
Figure 59:
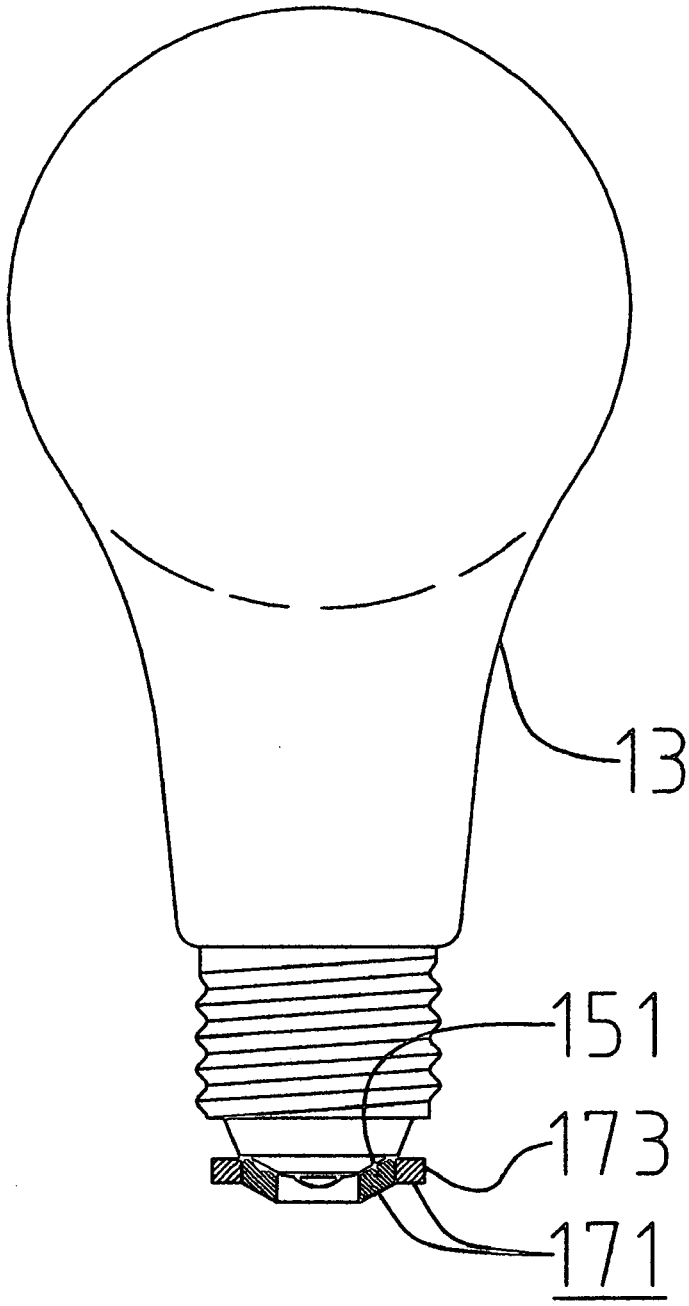
Figure 60:
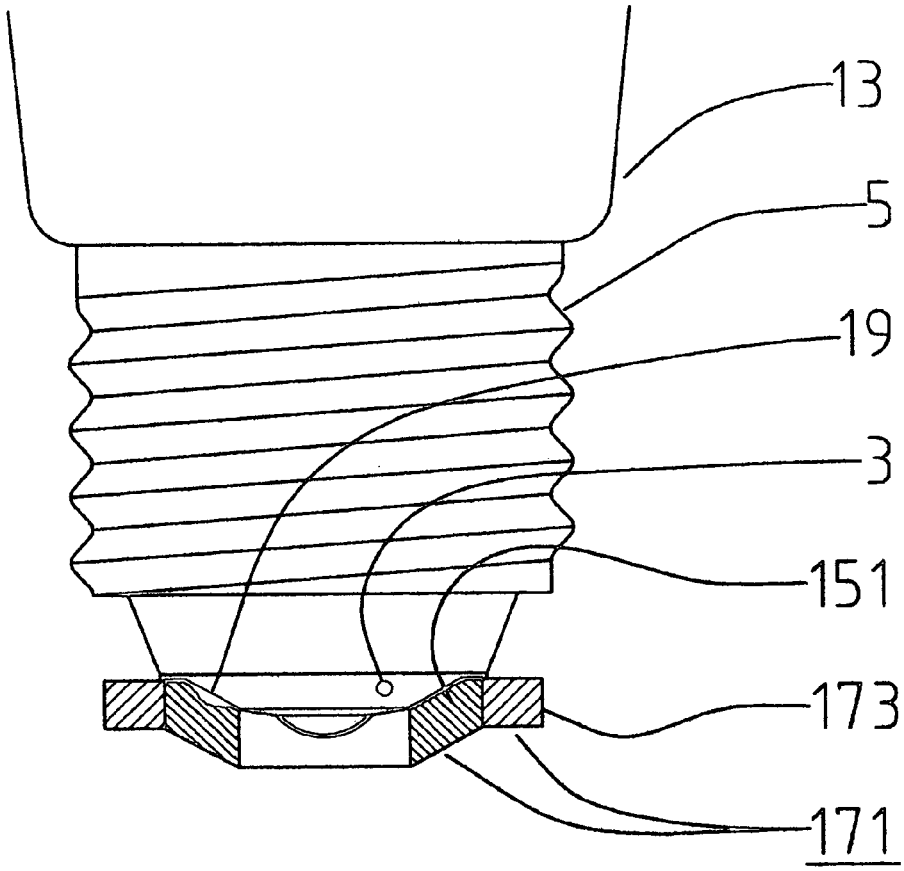
Figure 61:
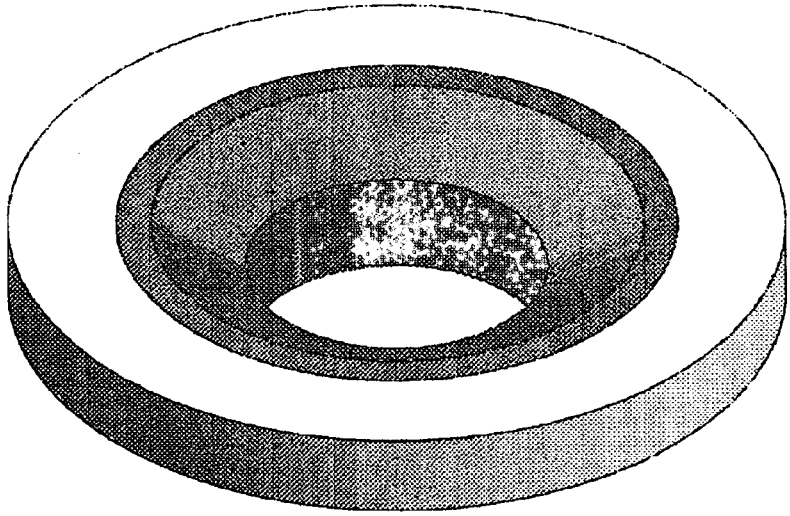
Figure 61:
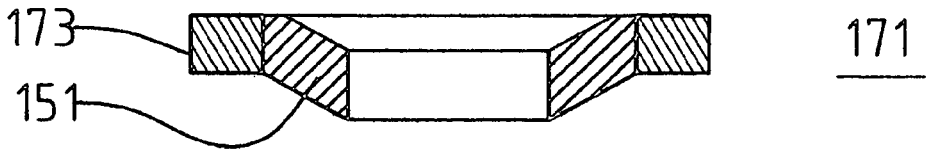

FIG. 50 shows a new "ringed" donut 171. It uses the previous donut 157, but adds to it the insulating ring 173, as shown. I will refer to this combination of 151 together with 171, as the ringed donut 173. FIGS. 59 and 60 show a similar ringed donut 173, attached to a bulb 13. FIG. 61 shows the ringed donut 173 by itself, in top view, side view and in cross-section view.

Pictures 10 through 12 show isometric views of the ringed donut 173.

BULB DOUGHNUT #5—With Insulation Ring, 2-layers

Figure 62:
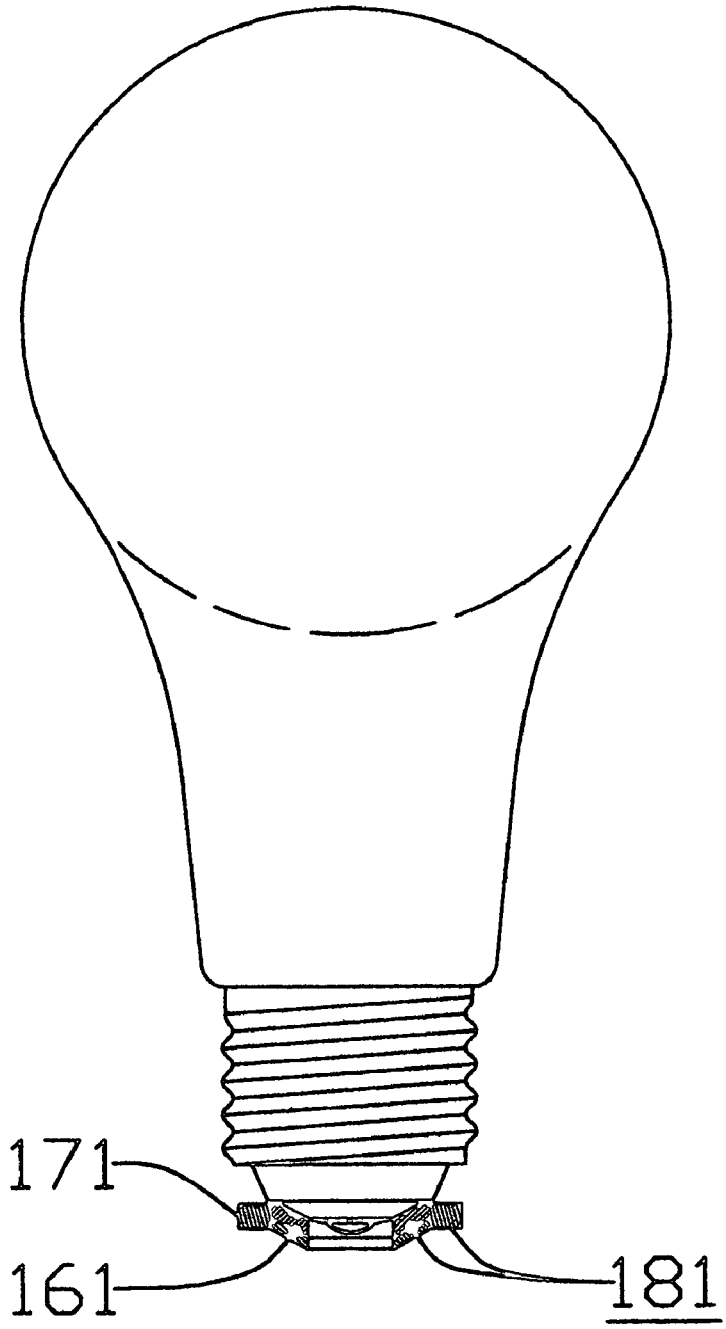
Figure 63:
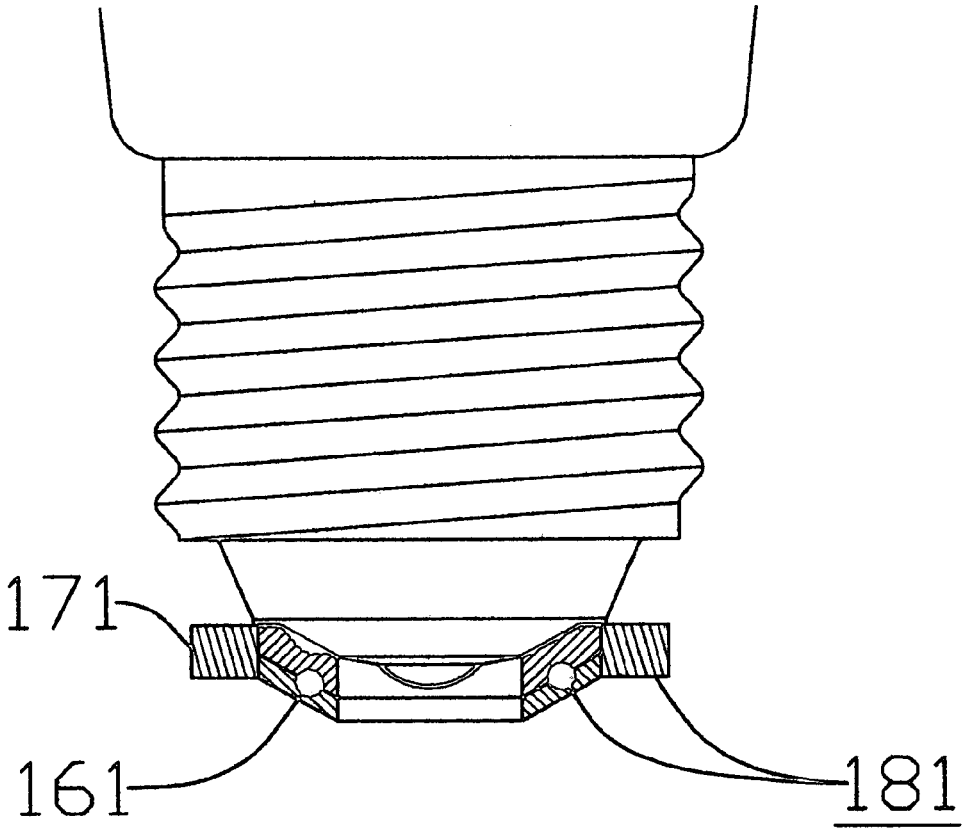

FIGS. 62 and 63 show yet another embodiment. It is a 2-layer ringed donut 181. It consists of a two-layer donut 161, like the 2-layer donut 161 described earlier, but it is surrounded by the insulating ring 171.

BULB DOUGHNUT #6—With Insulation Ring, 3+-layers

I guess the reader can also visualize that we could make another donut like the above one, but using the 3-layer donut 167, together with a similar insulating ring 171. I will refer to this one as the 3-layered ringed donut 177, although I do not have a drawing for it.

Notes Re All the Above Donuts.

The whole idea of these donuts here is to provide a cushiony interface between the bulb and the rigid middle contact element 31 of the socket, thus "covering up" the irregularities of the solder/connection spots 19 of the bulb and presents a smooth regular surface to the socket middle contact element 31.

Of course, there are certain criteria that such a doughnut must satisfy. I have touched on some of that earlier, but I would like to recap here.

First, it must have the necessary elasticity or compressibility, but at the same time, it should withstand the wear and tear and friction that will be expected when the bulb is threaded in or out of the socket.

Second, it should not touch the other contact elements of the socket or of the bulb. Otherwise, it may cause an electrical short and defeat the purpose. For this reason, the insulating ring 171 shown in the figures is provided.

The shape of the doughnut is optional, as long as it provides the conductive elasticity or compressibility and satisfy the other requirements. But since it is supposed to mainly cover the bulb middle contact ring 3, then the most obvious shape would be a ring/donut with almost the same inner and outer diameters.

Some possible material for this doughnut could be conductive (filled) polymers or elastomers, as stated earlier.

Review and Collection of Preferred Embodiments of Inventions Related to Bulbs

I would like to summarize the main basic concepts that represent the inventions related to bulbs as follows:

#B1. Bulb with its connection spot(s) flush.

An electrical light bulb, comprising a base, which in turn comprises a contact ring, having a connection means, where said connection means connects said contact ring to a filament inside of said bulb, whereby said connection means of said bulb is made flush with the surface of said middle contact ring of said bulb.

#B2 Bulb with a transfer means to its middle contact ring.

An electrical light bulb, comprising a base, which in turn comprises a contact ring, and where said contact ring is adapted to make electrical contact with outside contact elements, wherein a transfer means is provided between said middle contact ring of said bulb and said outside contact elements.

#B3 Bulb with a transfer means to its middle contact ring and solder spots.

An electrical light bulb, as in #B2, wherein said contact ring, further comprises one or more uneven connection means along the surface of said contact ring, and where said uneven connection means are connected to a filament inside said bulb, and wherein said transfer means is provided between said middle contact ring of said bulb and said uneven connection means on one side and between any outside electrical contact element that may come in contact with said ring or uneven connection means.

#B4. Bulb with its transfer means being a pliable conductive.

An electrical light bulb, as in #B3, wherein said transfer means is made of a pliable compressible conductive material.

#B5. Bulb with its transfer means being pliable conductive and insulated.

An electrical light bulb, as in #B3, wherein said transfer means is provided with means to prevent said transfer means from electrically touching undesirable surfaces.

#B6. Bulb with its transfer means shaped as a donut.

An electrical light bulb, as in #B2, wherein said transfer means is shaped like a doughnut.

Bulb Insert/Adapter Embodiment #3

Figure 51:
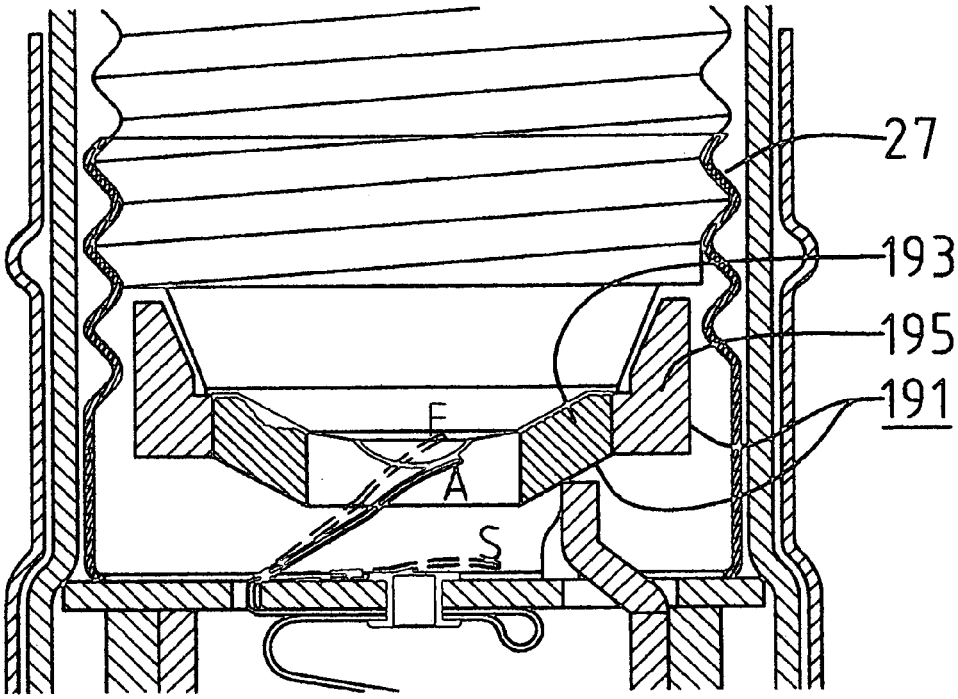

FIG. 51 shows another similar doughnut, also with an insulating ring around it, but the insulating ring 195 is shaped to more closely conform to the shape of the bulb and the socket. It slides freely up and down inside the socket threaded shell 27, and comes to rest on top of the socket middle contact element 31, and hugs the bottom of the bulb. It acts as a guide, to guide the donut inside the socket and to locate it properly in place, e.g. to prevent it from sliding out of position or from tilting too far out of line.

The insulating ring 195 shown in FIG. 51 does not need to fit tightly against the bulb. It can have enough clearances, to ensure that the real contact would occur at the right spots, again that means at the bulb middle contact ring 3.

Group Three: Inventions Related to Systems.

As I had mentioned under POTENTIAL PROBLEM SOURCES, I had discovered basically THREE potential sources for the problem:

1) The bulbs have a problem, but by themselves and on their own, they are OK.

2) The sockets have a problem, but by themselves and on their own, they are OK.

3) The system, or the combination of, using such bulbs and sockets creates problems. It is mainly the orientation or correlation of the threads in the bulbs and sockets together with the presence of the solder spot 19 of the bulb that create the problems.

The inventions in Groups 1 and 2 would take care of most of the weak points inherent in the sockets and in the bulbs. But there are still other features that would become relevant, only when we combine a bulb together with a socket, i.e. when we mate a bulb and a socket, by inserting the bulb into the socket. This would then be creating what is considered a "system".

Here are some ways to reduce the possibilities of problems with such systems.

The main goal here would be to ensure that we do not get the solder spots 19 to clash with the socket middle contact element 31. If we do some of the improvements/embodiments suggested above, then we would not need to do any of the following ones. But, if we ignore the above suggestions, then the following ones may come to the rescue. Basically, we want to avoid getting the unstable contact conditions that I described earlier.

So, here are a number of suggested embodiments to accomplish this goal:

Preferred Embodiments

Figure 70:
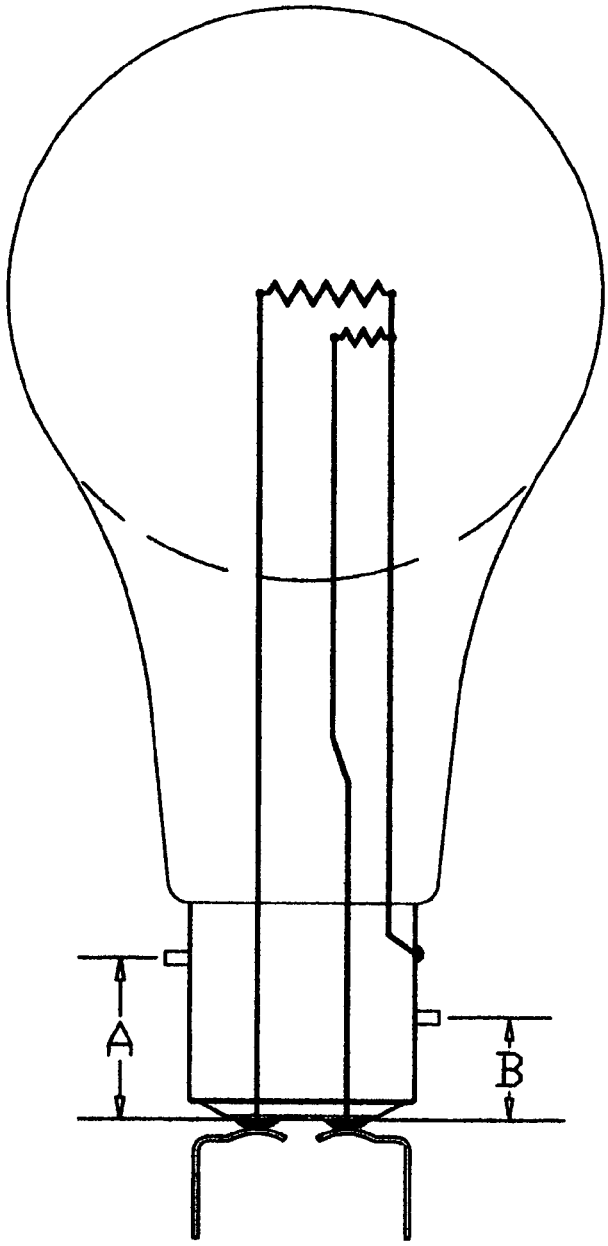

Use a bayonet type of mating feature, instead of threads, i.e. push and twist, as in FIG. 70, and have 2 contact points, instead of one center point and a ring, i.e. replace the ring by a point.

Here the contacts for the two filaments could be at the bottom and the return would still be at the side of the base. The two pins that would hold the bulb in place inside the socket, would be located at some different height to make sure that the bulb would go into the socket in the proper orientation.

Figure 71:
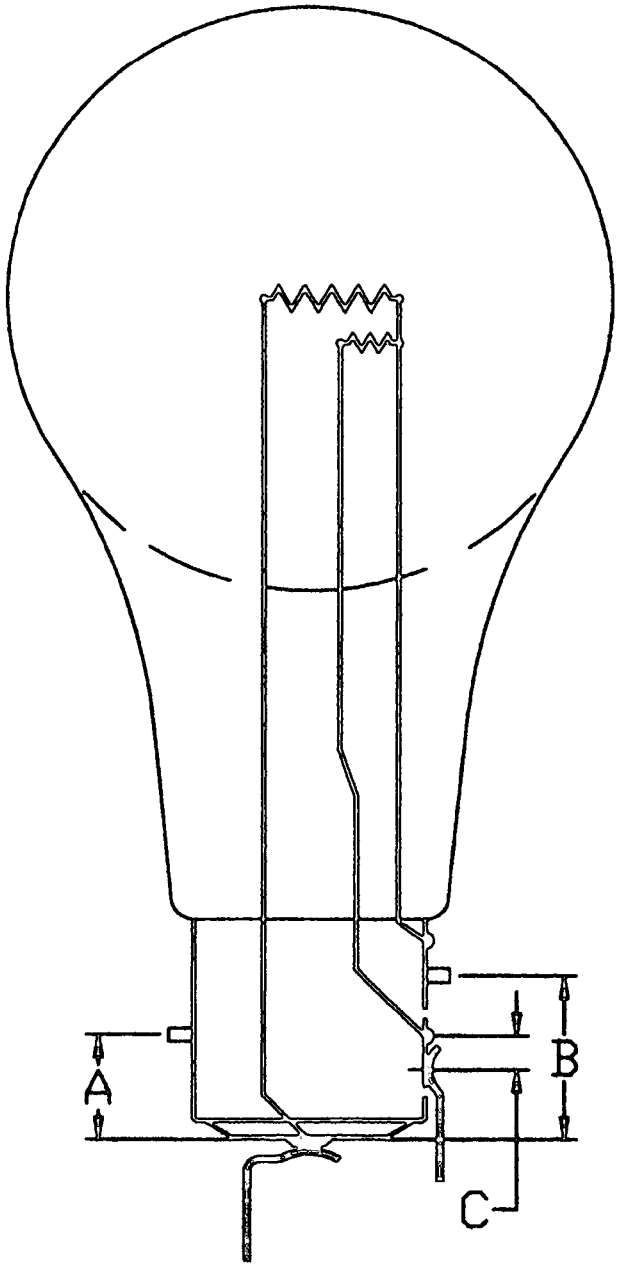

FIG. 71 is another embodiment. The contact "ring" is on the side of the bulb base. The socket middle contact spring would touch that ring, but the solder spot 19 would be higher than the middle contact spring, or since we are using the bayonet approach here, then the solder spot could simply placed at a different angular position away from the socket middle contact spring.

Figure 72:
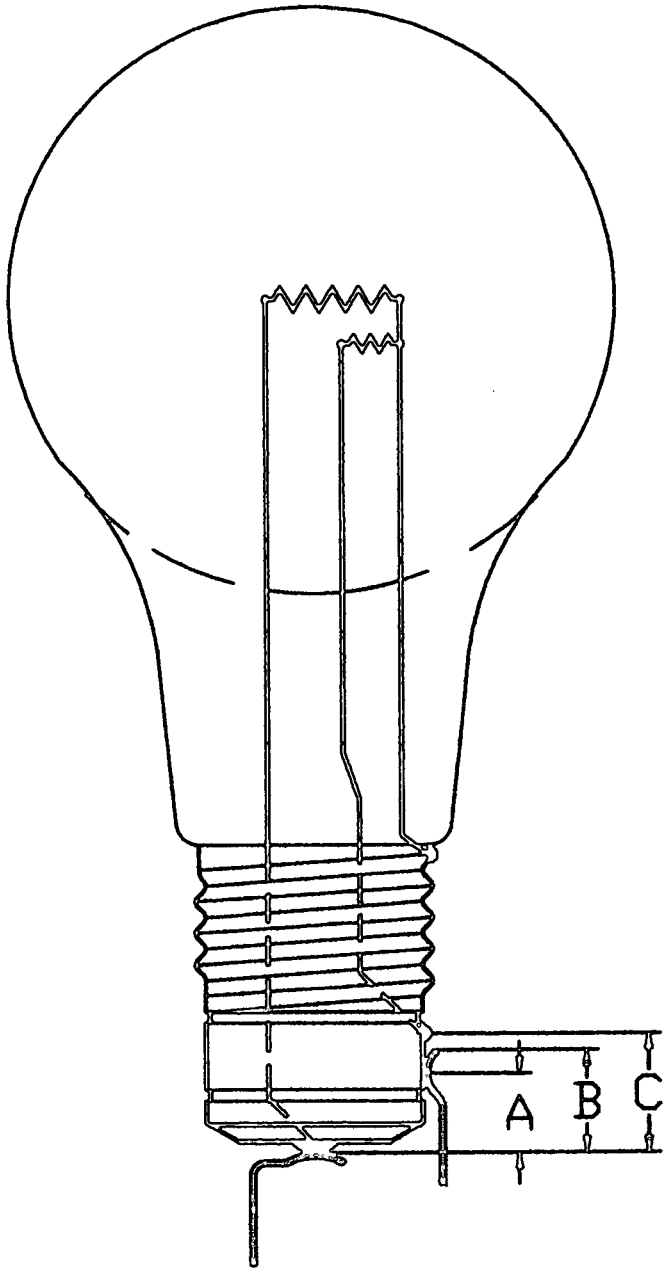

FIG. 72 is yet another embodiment. It is similar to the one in FIG. 71, except that here we would have a thread instead the bayonet. Here we definitely need to have the solder spot higher than the socket middle contact spring.

Orbit of solder spots 19 does not coincide with orbit of the socket middle contact element 31.

Figure 73:
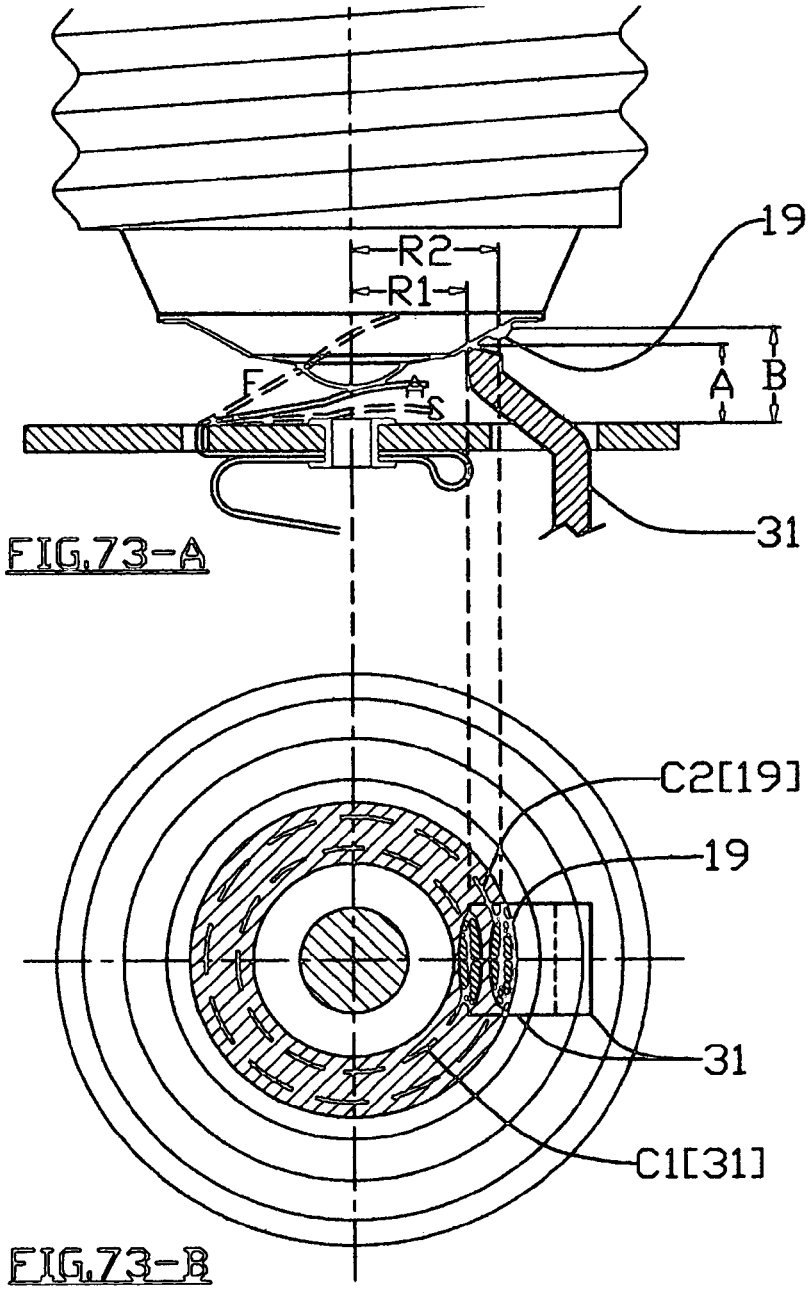

FIG. 73 shows the bulb almost identical to the standard conventional bulbs, except that we make sure here, that the solder spot is located at a different "orbit" than that of the socket middle contact element 31. The socket middle contact element 31 would touch bulb middle contact ring 3 along the orbit circle C1, but the solder spot would be located at any point along the orbit circle C2. The radius R1 of C1 would be smaller than the radius R2 of C2, so then the solder spot 19 would never come close to the socket middle contact element 31 and would never touch it. This means that we would not get that undesirable unstable contact between the socket middle contact element 31 and solder spot 19, which was described earlier above.

Figure 74:
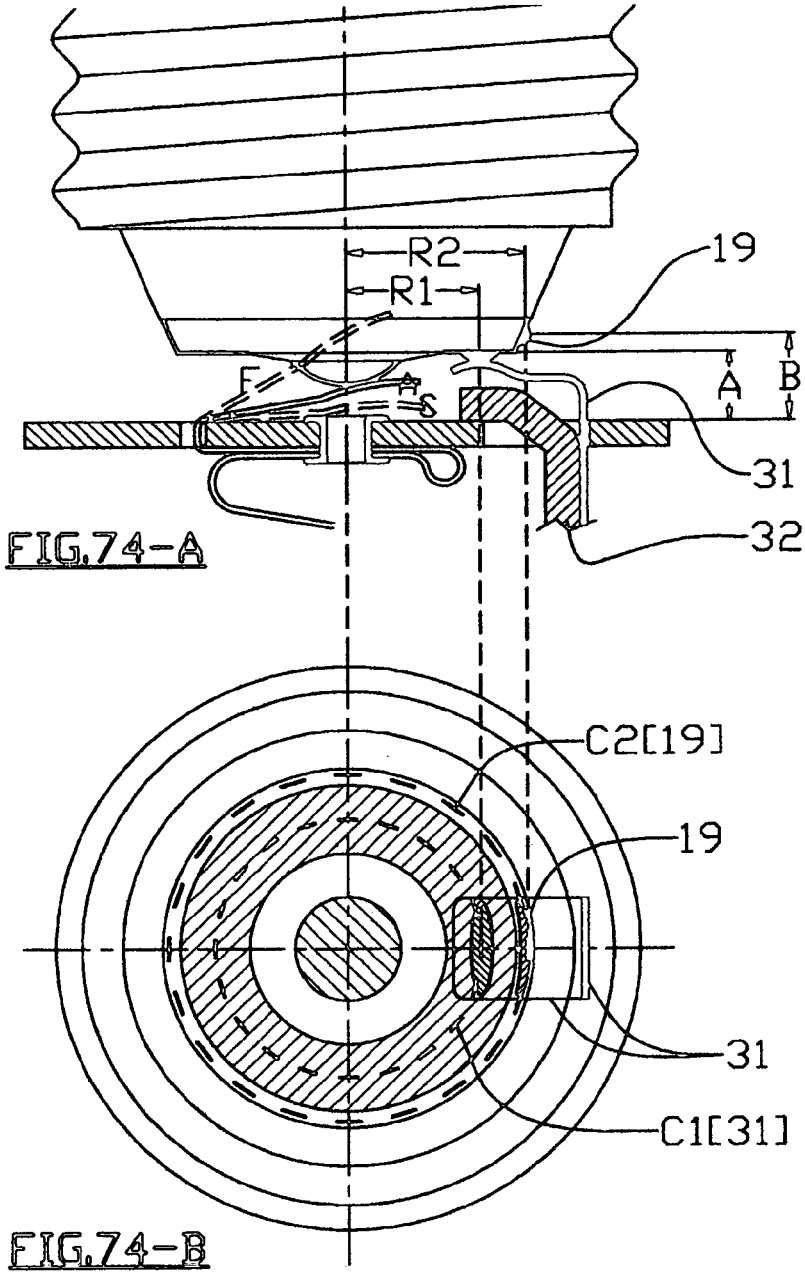

FIG. 74 shows an embodiment that is slightly different yet. Here the solder spot is at a totally different location than the bulb middle contact ring 3. So, there would never be any clash between the two.

Proper Orientation and Location of the threads and of solder spot, to avoid collision of solder spot 19 and the socket middle contact element 31. What I mean here is ensure that when the bulb is treaded in the socket and is fully seated, the solder spot 19 would never touch the socket middle contact element 31, actually would not be even near it. This would need that the threads on both the socket shell and on the bulb base are designed and manufactured to accomplish that end goal. For example by starting and ending the thread at certain points on both the sockets and by locating the solder spot always in a certain relation to the thread on the bulb base. It can be done, but would need special attention in manufacturing same. This can be done on an individual basis, i.e. a matched set, each set consisting of one bulb and one socket. This is obviously extremely expensive and impractical (Rolls Royce approach).

Do the same orientation and location of threads and of solder spot, but for all the bulbs and all the sockets, so as to ensure interchangeability. (Ford approach, or generic Mass Production approach).

Review and Collection of Preferred Embodiments of Inventions Related to Systems

I would like to summarize the main basic concepts that represent the inventions related to SYSTEMS as follows:

T1. System: Bulb & Socket, Where Spot Does Not Touch or Comes Near Contact. [No Thread] [e.g. FIGS. 70 and 71]

A system comprising a 3-way light bulb, hereinafter referred to as bulb, and a 3-way light socket, hereinafter referred to as socket, wherein said bulb comprises a base, which in turn comprises a bulb middle contact having a connection means 19, where said connection means connects said bulb middle contact to one of the filaments inside said bulb, and where said socket comprises a shell and a socket middle contact, where said shell of said socket is adapted to accept said base of said bulb, and said socket middle contact is adapted to make physical and electrical contact with said bulb middle contact whereby said socket shell and said bulb base are so designed and manufactured, that when said bulb with its said bulb base is inserted into said socket in said socket shell and is fully seated, then said connection means of said bulb will not touch, actually will not be near enough to touch said socket middle contact.

T2. System: Bulb & Socket: >>Spot Not Touch or Near Contact. [Orbit No Thread]

A system, as in T1, wherein the location of said connection means of said bulb and the location of said socket middle contact are such that during the insertion and mating of said bulb into said socket, the path of said connection means of said bulb will not intersect the path of said socket middle contact, so that said connection means of said bulb will not make touch said socket middle contact during said insertion and mating process.

T3. System: Bulb & Socket: >>Spot Not Touch or Near Contact. [Orbit with Thread]

A system as in T1, wherein said bulb base is threaded, so as to be threaded into said socket shell, and said socket shell is also threaded, so as to accept said threaded bulb base, and wherein said thread of said socket shell and said thread of said bulb base are so designed and manufactured, that when said bulb and said bulb base is inserted into said socket and said socket shell and is threaded in all the way until fully seated, then said connection means of said bulb will not touch, actually will not be near enough to touch said middle contact element of said socket.

T4. System: Bulb & Socket: >>Thread Orientation of Bulb & Socket and Location of Spot >>Spot Not Touch or Near Contact. [Matched Set] [e.g. FIGS. 72–74]

A system, as in T1, wherein the disposition, i.e. location, orientation, etc., of said thread of said shell of said socket with respect to said middle contact element of said socket and the disposition, i.e. location, orientation, etc., of said thread of said bulb base with respect to said connection means on said middle contact ring of said bulb are such, that when said bulb is inserted into said socket and is threaded in all the way until fully seated, then said connection means of said bulb will not touch, actually will not be near enough to touch said middle contact element of said socket.

T5. System: Bulb & Socket: >>Thread Orientation of Bulb & Socket and Location of Spot >>Spot Not Touch or Near Contact. [Generic, Mass Production, Interchangeability]

A system, as in T1, wherein the disposition, i.e. location, orientation, etc., of said thread of said shell of said socket with respect to said middle contact element of said socket is kept the same within all sockets of this kind, and wherein the disposition, i.e. location, orientation, etc., of said thread of said bulb base with respect to said connection means on said middle contact ring of said bulb is kept the same within all bulbs of this kind, whereby when any such bulb from said kind of bulbs is inserted into any such socket from said kind of sockets and is threaded in all the way until fully seated, then said connection means of said bulb will not touch, actually will not be near enough to touch said middle contact element of said socket.

Group Four: Inventions Related to Adapters or Inserts.

I have already talked earlier about two groups of such adapters or inserts, when I talked about the improvements to "bulbs".

Here I want to add one third group of such devices.

Preferred Embodiments

Adapters or Inserts with a GUIDE.

Guided Donut 191

FIG. 51 shows a guided donut 191. It is composed of a conductive center 193, and an outside insulating guide 195. The conductive center 193 can be identical to the flexible conductive doughnut 151 described above. The outside insulating guide 195 surrounds conductive center 193 and has a number of functions and properties. First, it prevents conductive center 193 from making electrical contact with surfaces other than the intended bulb middle contact ring 3. Second, it guides 193 within the socket shell 27, preventing the whole device from straying out of position or from tilting out of line. It glides up and down, with enough clearance between it and the socket shell so as not to bind, and has enough clearance between it and the bulb base, so as to allow all the contact function to work without loss of contact force.

Figure 64:
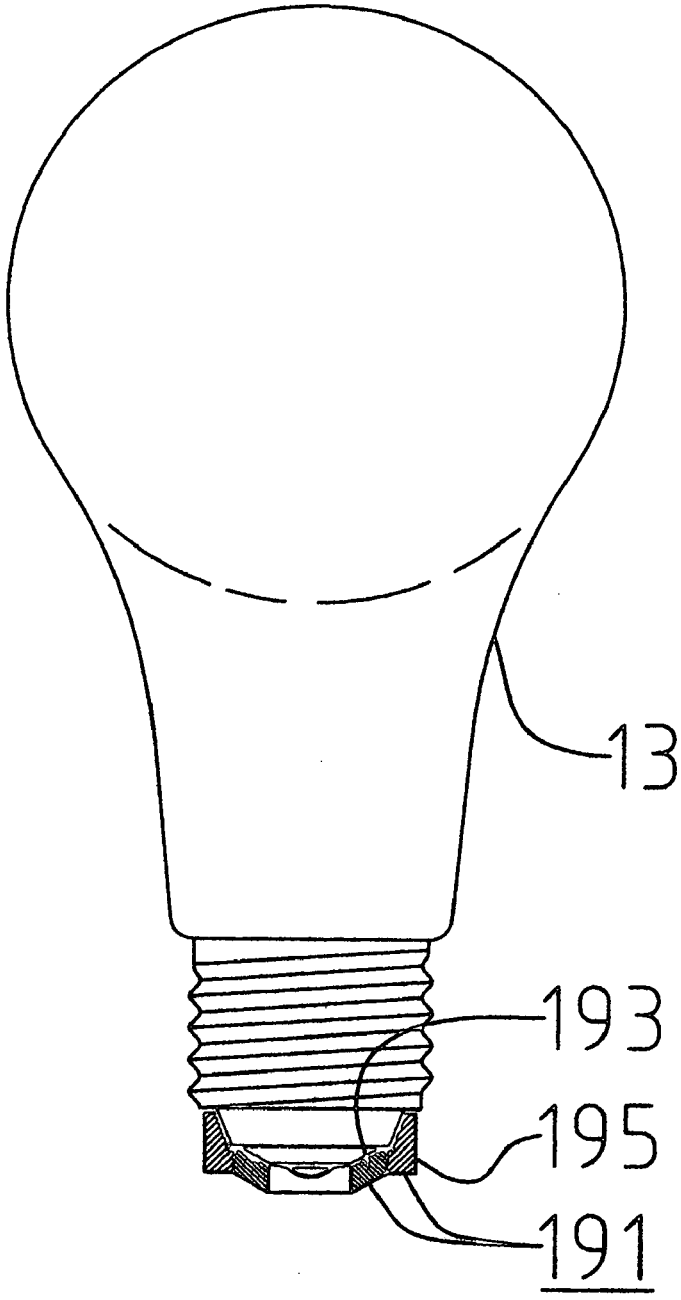
Figure 65:
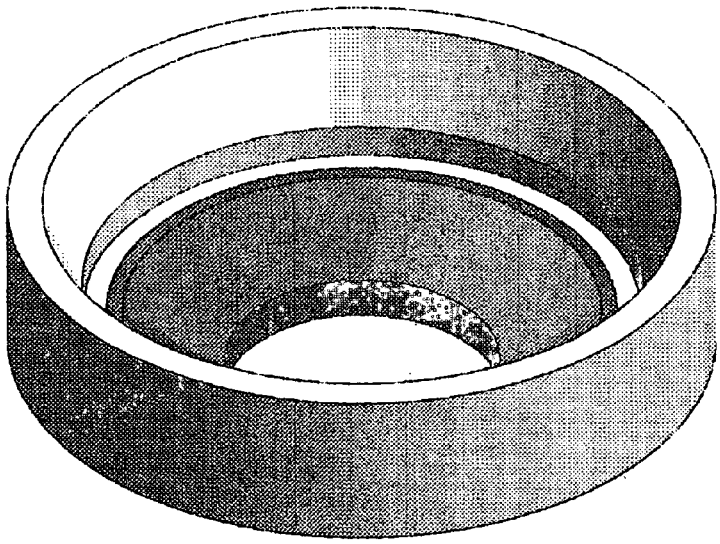
Figure 65:
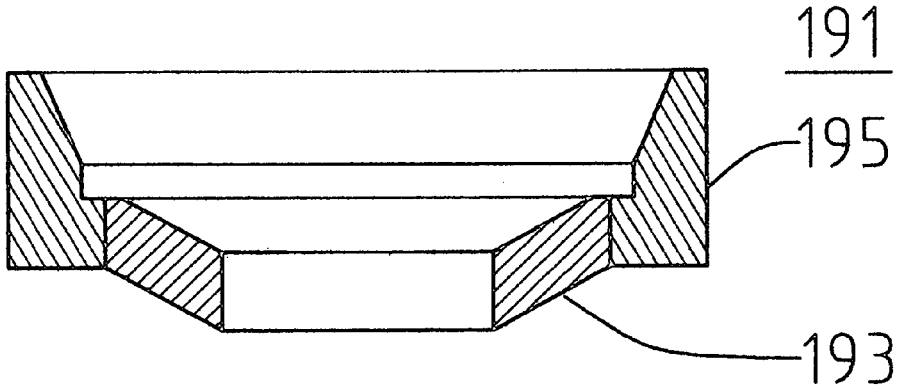

FIG. 64 shows the same guided donut 191, hugging the base of the bulb 13. FIG. 65 shows the guided donut 191 by itself, in top view, side view and in cross-section view.

Guided Donut 201

FIGS. 66A and 66B show a guided donut 201. It is composed of a 2-layer conductive center 203, and an outside insulating guide 205. The 2-layer conductive center 203 can be identical to the two-layer donut 161 described above. The outside insulating guide 205 is identical to the outside insulating guide 195.

Figure 67:
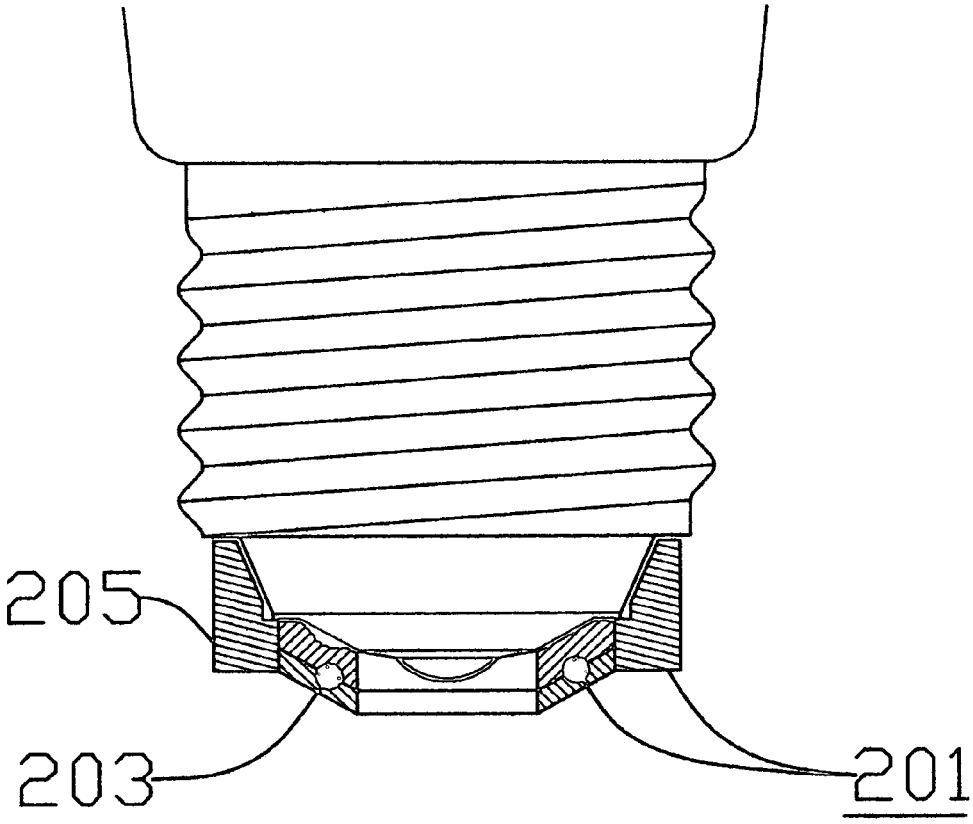
Figure 68:
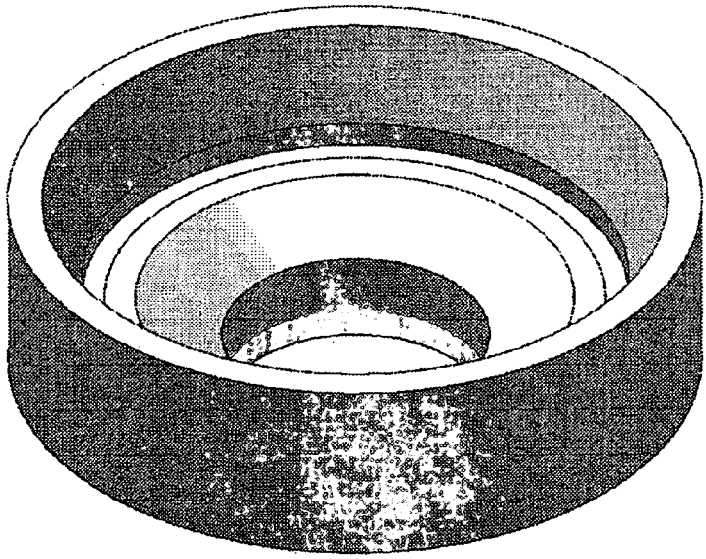
Figure 68:
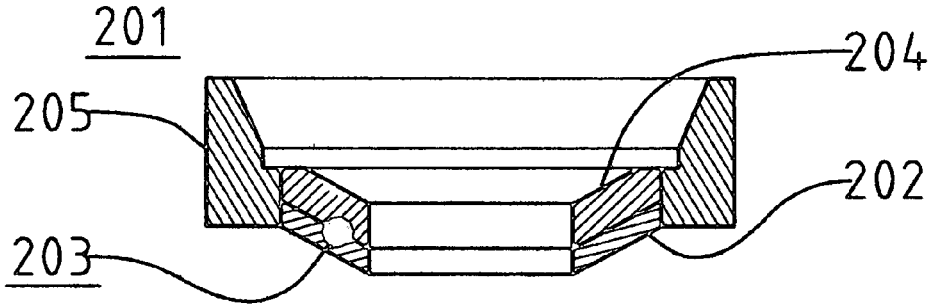

FIG. 67 shows the same guided donut 201, hugging the base of the bulb 13. FIG. 68 shows the guided donut 201 by itself, in top view, side view and in cross-section view.

Pictures 13 through 15 show isometric views of the guided donut 201.

Guided Donut 211

FIGS. 69A and 69B show a guided donut 211. It is composed of a 1-layer hard conductive center 213, and an outside insulating guide 215. The 1-layer hard conductive center 213 would be made of a hard metal, such as copper, brass, or bronze, in contrast to the compressible material used for example for doughnut 151. The outside insulating guide 215 is identical to the outside insulating guide 195.

In this case, we do not want that the solder spot 19 dig into the central donut, but they would simply sit on top of the surface of the 1-layer hard conductive center 213. The rest of the function of this guided donut 211 is identical to the guided donut 191 or 201.

Pictures 16 through 18 show isometric views of the guided donut 211.

Various Combinations

TABLE 1

A good number of the possible combinations of Adapters or Inserts.

| | | DONUT | | | | | | | |
|---|---|---|---|---|---|---|---|---|---|
| | | MUSHY | | HARD | | RING | | GUIDE | |
| Combinations: | # | THIN | THICK | THIN | THICK | THIN | THICK | THIN | THICK |
| Thin Mushy | 1 | Y | | | | | | | |
| | 2 | Y | | | | Y | | | |
| | 3 | Y | | | | | | Y | |
| Thick Mushy | 4 | | Y | | | | | | |
| | 5 | | Y | | | | Y | | |
| | 6 | | Y | | | | | | Y |
| Thin Mushy | 7 | Y | | Y | | | | | |
| with Thin Hard | 8 | Y | | Y | | | Y | | |
| | 9 | Y | | Y | | | | | Y |
| Thin Hard | 10 | | | Y | | Y | | | |
| | 11 | | | Y | | | | Y | |
| Thick Hard | 12 | | | | Y | | Y | | |
| | 13 | | | | Y | | | | Y |

Note: I have used the word "Mushy", as a short expression, to denote the "compressible conductive material" that is used for the donut.

A lot of combinations and variations can be thought of, as how to shape those adapters and inserts, and which components to include in each combination. The table above gives a good start as to what combinations are possible. I am sure that we could of a couple more at least.

TABLE 2

The combinations described in these Specifications.

| Combinations: | # | Part Ref# | FIGS. | Pictures |
|---|---|---|---|---|
| Thin Mushy | 1 | 151 | 47, 48, 49, 54, 55, 56 | 8, 9 |
| | 2 | | | |
| | 3 | | | |
| Thick Mushy | 4 | | | |
| | 5 | 171 | 50, 59, 60, 61 | 10, 11, 12 |
| | 6 | 191 | 51, 64, 65 | |
| Thin Mushy with | 7 | 161 | 57, 58 | |
| Thin Hard | 8 | 181 | 62, 63 | |
| | 9 | 201 | 66, 67, 68 | 13, 14, 15 |
| Thin Hard | 10 | | | |
| | 11 | | | |
| Thick Hard | 12 | | | |
| | 13 | 211 | 69 | 16, 17, 18 |

Table 2 shows which of the combinations listed in Table 1 have been included in these Specifications. It also shows the Ref#s of the individual parts, and the Numbers of the Figures that show these combinations. Also, if any Pictures have been included, then Table 2 shows the number of these Pictures.

For example, part Ref#201 represents Combination #9. FIGS. 66, 67 and 68 show this part. And Pictures 13, 14 and 15 shows the part in 3-D.

I did not feel that I had to show each and every possible combination. I felt rather that the sampling that I have chosen and already included in the present application is sufficient to give the reader the gist of what I am trying to convey, i.e. the many different ways we can solve the problem.

Notes About the Three Above Bulb Insert/Adapters Embodiments:

General Notes Re Inserts/Adapters

The doughnuts could be pre-molded or pre-shaped. They could then be sold as part of the bulb, or separately.

If the donut is provided without the insulators, then it could be attached/glued to the bottom of the bulb, specifically to the bulb middle contact ring 3, by the manufacturer and sold as an improved bulb. The donut itself could also be sold in the after-market, together with an appropriate glue material, such as electrically conductive glue, so that the end user would first glue the donut to the bulb, before inserting the "modified" bulb into the socket.

If the donut is sold as an integral part with a proper insulating ring or insulating guide, then the end user would simply install/drop the donut into the socket threaded shell 27 and then would insert the bulb in the socket behind the donut, and then thread the bulb in, until it is seated properly. Thus the donut would be trapped between the socket middle contact element 31 and the bulb.

Obviously, any of these adapters or inserts could be used in conjunction with the systems mentioned earlier, to enhance the performance of such systems. Systems being a light bulb together with an electric socket.

Review and Collection of Preferred Embodiments of Inventions Related to Inserts and Adapters I would like to summarize the main basic concepts that represent the inventions related to Inserts and Adapter as follows. Some of these were included in the group on bulbs.

A1 Adapter/Transfer device: >>Conductor/Washer

A transfer device to be used in conjunction with an electrical light bulb, hereinafter referred to as bulb, and an electrical socket, hereinafter referred to as socket, said socket being adapted to receive such said bulb, wherein said transfer device comprises a layer of conductive material.

A2 Adapter/Transfer device: >>with Insulator

A transfer device as in A1, wherein said transfer device further comprises an insulating material, to prevent said conductive material from touching and electrically connecting to undesirable surfaces or objects of said socket.

A3 Adapter/Transfer device: >>with Guide

A transfer device as in A1, wherein said transfer device further comprises a means, to guide said transfer device inside said socket to locate it properly in place, e.g. to prevent it from sliding out of position or from tilting too far out of line.

A4 Adapter/Transfer device: >>Multi-Layer Conductor, Soft & Hard a) A transfer device as in A1, wherein said transfer device is made of two or more layers of material, whereby a first layer of pliable compressible conductive material would be located adjacent to said contact ring and any connection means that may be on said contact ring, and where at least a second layer of conductive material, laminated to said first layer, would be located towards said outside contact elements and where said second layer material is harder than said first layer material.

A5 Adapter/Transfer device: >>Conductor, Insulator & Guide

A transfer device as in A1, wherein said transfer device is made of a conductive layer of material, and wherein an insulating material surrounds said conductive material to prevent said conductive material from touching and electrically connecting to undesirable surfaces or objects of said socket, and wherein a means, to guide said transfer device inside said socket to locate it properly in place, e.g. to prevent it from sliding out of position or from tilting too far out of line.

A6 Adapter/Transfer device: >>Multi-Layer Conductor, Soft & Hard, Insulator & Guide.

A transfer device as in A1, wherein said transfer device is made of two or more layers of material, whereby a first layer of pliable compressible conductive material would be located adjacent to said contact ring and any connection means that may be on said contact ring, and where at least a second layer of conductive material, laminated to said first layer, would be located towards said outside contact elements, and wherein an insulating material surrounds said conductive layers, to prevent said conductive material from touching and electrically connecting to undesirable surfaces or objects of said socket, and wherein a means is provided to guide said transfer device inside said socket to locate it properly in place, e.g. to prevent it from sliding out of position or from tilting too far out of line.

I claim:

1. A socket for actuating a 3-way electrical light bulb, comprising:

an electrically insulating housing base;

a conductive threaded shell attached to the housing base;

a conductive center contact having a spring arm attached to the housing base;

a conductive middle contact element attached to the housing base and being electrically connected to a socket switch wiper;

the bulb comprising a center contact point electrically and mechanically engaging the spring arm, a middle contact ring electrically and mechanically engaging the middle contact element, and a threaded base electrically and mechanically engaging the conductive threaded shell;

wherein an additional contact member electrically and mechanically engages the middle contact ring of the bulb; and wherein the additional conductive contact member comprises a flexible spring arm; and wherein the additional conductive contact member is electrically connected to the socket switch wiper.

2. A socket, as in claim 1, wherein a) said bulb comprising also a connection means, hereinafter referred to as solder blob, connecting said bulb middle contact ring with one of the filaments inside said bulb, and b) said additional contact member can engage said solder blob as well.

3. A socket, as in claim 2, wherein a) said additional contact member is flexible and can act as a spring and can deflect to cooperate with said bulb middle contact ring and said solder blob.

4. A socket, as in claim 2, wherein a) said additional contact member is flexible and can act as a spring and can deflect to cooperate, mechanically and electrically, with said bulb middle contact ring and said solder blob.

5. A socket, as in claim 2, wherein a) said solder blob has a generally rough uneven surface, and sometimes protruding beyond the general surface of said bulb middle contact ring, and b) said additional contact member is flexible and can act as a spring and can deflect to cooperate, mechanically and electrically, with said bulb middle contact ring and said solder blob.

6. A socket, as in claim 1, wherein a) said additional contact member and said socket middle contact element are adjacent to each other.

7. A socket, as in claim 1, wherein a) said additional contact member and said socket middle contact element are straddling each other.

8. A socket, as in claim 1, wherein a) said middle contact element of said socket and said stop of said socket are not near each other.

9. A socket, as in claim 1, wherein a) said additional contact member and said socket middle contact element are at 90 degrees radially from each other, looking inside said socket from the opening of said socket shell.

10. A socket, as in claim 1, wherein a) said threaded shell of said socket is shaped so as to provide enough clearance between it and said additional contact member so as not to have electrical contact between said shell and said member.

11. A socket, as in claim 1, wherein a) said socket has another element that acts as a stop to limit how far said bulb can be threaded inside said socket.

12. A socket, as in claim 11, wherein a) said socket shell is shaped so as to provide enough clearance between it and said middle contact element and said stop so as not to have electrical contact between said shell and said contact or between said shell and said stop.

13. A socket, as in claim 1, wherein a) said additional contact member itself acts as a stop to limit how far said bulb can be threaded inside said socket.

14. A socket, as in claim 1, wherein a) said additional contact member replaces the function of the original socket middle contact element and voids the need to have it.

15. In a socket for actuating a 3-way electrical light bulb, comprising:

an electrically insulating housing base;

a conductive threaded shell attached to the housing base;

a conductive center contact having a spring arm attached to the housing base;

a conductive middle contact element attached to the housing base and being electrically connected to a socket switch wiper;

the bulb comprising a center contact point electrically and mechanically engaging the spring arm, a middle contact ring electrically and mechanically engaging the middle contact element, and a threaded base electrically and mechanically engaging the conductive threaded shell;

a combination with said socket of an additional contact member that electrically and mechanically engages the middle contact ring of the bulb;

wherein the additional conductive contact member comprises a flexible spring arm; and wherein the additional conductive contact member is electrically connected to the socket switch wiper.

16. An improved socket for actuating a 3-way electrical light bulb, comprising:

an electrically insulating housing base;

a conductive threaded shell attached to the housing base;

a conductive center contact having a spring arm attached to the housing base;

a conductive middle contact element attached to the housing base and being electrically connected to a socket switch wiper;

the bulb comprising a center contact point electrically and mechanically engaging the spring arm, a middle contact ring electrically and mechanically engaging the middle contact element, and a threaded base electrically and mechanically engaging the conductive threaded shell;

wherein the improvement comprises an additional contact member that electrically and mechanically engages the middle contact ring of the bulb; and wherein the additional conductive contact member comprises a flexible spring arm; and wherein the additional conductive contact member is electrically connected to the socket switch wiper.

17. An improved socket, as in claim 16, wherein a) said bulb comprising also a connection means, hereinafter referred to as solder blob, connecting said bulb middle contact ring with one of the filaments inside said bulb, and b) said additional contact member can engage said solder blob as well.

18. improved socket, as in claim 17, wherein a) said additional contact member is flexible and can act as a spring and can deflect to cooperate with said bulb middle contact ring and said solder blob.

19. improved socket, as in claim 17, wherein a) said additional contact member is flexible and can act as a spring and can deflect to cooperate, mechanically and electrically, with said bulb middle contact ring and said solder blob.

20. An improved socket, as in claim 17, wherein a) said solder blob has a generally rough uneven surface, and sometimes protruding beyond the general surface of said bulb middle contact ring, and b) said additional contact member is flexible and can act as a spring and can deflect to cooperate, mechanically and electrically, with said bulb middle contact ring and said solder blob.

* * * * *